US009651216B2

(12) United States Patent
Rodgers et al.

(10) Patent No.: US 9,651,216 B2
(45) Date of Patent: May 16, 2017

(54) LIGHTING SYSTEMS INCLUDING ASYMMETRIC LENS MODULES FOR SELECTABLE LIGHT DISTRIBUTION

(71) Applicant: EcoSense Lighting Inc., Los Angeles, CA (US)

(72) Inventors: Elizabeth Rodgers, Long Beach, CA (US); Don Peifer, Mountain View, CA (US); Raghuram L. V. Petluri, Cerritos, CA (US); Paul Pickard, Acton, CA (US); Robert Fletcher, Pasadena, CA (US); Edward R Adams, Englewood, TN (US)

(73) Assignee: ECOSENSE LIGHTING INC., Los Angeles, CA (US)

( * ) Notice: Subject to any disclaimer, the term of this patent is extended or adjusted under 35 U.S.C. 154(b) by 126 days.

(21) Appl. No.: 14/702,800

(22) Filed: May 4, 2015

(65) Prior Publication Data

US 2016/0258593 A1 Sep. 8, 2016

Related U.S. Application Data

(63) Continuation-in-part of application No. 14/636,205, filed on Mar. 3, 2015, and a continuation-in-part of application No. 14/636,204, filed on Mar. 3, 2015.

(51) Int. Cl.
*F21V 5/00* (2015.01)
*F21V 5/04* (2006.01)
(Continued)

(52) U.S. Cl.
CPC ..... *F21V 5/008* (2013.01); *F21V 5/004* (2013.01); *F21V 5/005* (2013.01); *F21V 5/04* (2013.01);
(Continued)

(58) Field of Classification Search
CPC .. G02B 6/0076; G02B 6/0016; G02B 6/0021; G02B 6/0025; G02B 6/0028;
(Continued)

(56) References Cited

U.S. PATENT DOCUMENTS 2,430,472 A 11/1947 Levy
D149,124 S 3/1948 Hewitt
(Continued)

FOREIGN PATENT DOCUMENTS

CA 2623604 A1 8/2009
CN 1536686 A 10/2004
(Continued)

OTHER PUBLICATIONS

PCT/US2016/030613, Ecosense Lighting Inc., International Search Report and Opinion Dated Aug. 5, 2016.
(Continued)

*Primary Examiner* — Mary Ellen Bowman
(74) *Attorney, Agent, or Firm* — Jay M. Brown

(57) ABSTRACT

Lighting system including: lighting module having semiconductor light-emitting device; first lens module; and asymmetric second lens module. Second lens module includes diverging lens configured for causing divergence of converged light emissions away from lens axis. Second lens module includes: lens body having light output surface spaced apart along light transmission axis from light input surface, lens body having longitudinal axis and lateral axis, the longitudinal and lateral axes being transverse to light transmission axis; light output surface having asymmetric curvilinear contour formed by convex region overlapping in directions along lateral axis with concave region, the asymmetric curvilinear contour uniformly extending in directions along the longitudinal axis.

76 Claims, 32 Drawing Sheets

(51) Int. Cl.
*F21V 17/00* (2006.01)
*F21Y 115/10* (2016.01)

(52) U.S. Cl.
CPC ..... *F21V 17/002* (2013.01); *F21Y 2115/10* (2016.08)

(58) Field of Classification Search
CPC .... G02B 6/003; G02B 6/0031; G02B 6/0053; G02B 6/0055; G02B 6/0068; G02B 6/0073; F21V 5/08; F21V 5/004; F21V 5/005; F21V 5/008; F21V 5/0048; F21V 17/002
See application file for complete search history.

(56) References Cited

U.S. PATENT DOCUMENTS

D152,113 S 12/1948 Mehr
2,458,967 A 1/1949 Wiedenhoeft
2,678,380 A 5/1954 Westby
2,702,378 A 2/1955 Talty
D191,734 S 11/1961 Daher
3,040,170 A 6/1962 Chwan
3,078,366 A 2/1963 Winkler
3,120,929 A 2/1964 Henning
3,220,471 A 11/1965 Coe
3,247,368 A 4/1966 McHugh
3,435,891 A 4/1969 Parrish
D214,582 S 7/1969 Routh
D217,096 S 4/1970 Birns
3,538,321 A 11/1970 Longenecker
3,639,751 A 2/1972 Pichel
3,643,038 A 2/1972 Sato
D231,559 S 4/1974 Darling et al.
D234,712 S 4/1975 Kennedy et al.
3,989,976 A 11/1976 Tabor
4,090,210 A 5/1978 Wehling et al.
4,091,444 A 5/1978 Mori
4,138,716 A 2/1979 Muhlethaler et al.
D251,500 S 4/1979 Aigner
4,258,413 A 3/1981 Mausser
4,345,306 A 8/1982 Summey
4,414,489 A 11/1983 Young
4,420,207 A 12/1983 Nishikawa
4,423,471 A 12/1983 Gordin et al.
4,445,164 A 4/1984 Giles, III
4,453,203 A 6/1984 Pate
4,467,403 A 8/1984 May
4,473,873 A 9/1984 Quiogue
4,564,888 A 1/1986 Lewin
4,578,742 A 3/1986 Klein
4,580,859 A 4/1986 Frano
4,609,979 A 9/1986 Kristofek
4,674,015 A 6/1987 Smith
4,727,648 A 3/1988 Savage
4,733,335 A 3/1988 Serizawa
D296,717 S 7/1988 Kane et al.
4,755,918 A 7/1988 Pristash
4,757,431 A 7/1988 Cross
4,761,721 A 8/1988 Willing
D300,876 S 4/1989 Sakai
4,833,579 A 5/1989 Skegin
4,837,927 A 6/1989 Savage
4,870,327 A 9/1989 Jorgensen
4,872,097 A 10/1989 Miller
4,882,667 A 11/1989 Skegin
4,918,497 A 4/1990 Edmond
D308,114 S 5/1990 Shemitz
D308,260 S 5/1990 Shemitz
4,966,862 A 10/1990 Edmond
D315,030 S 2/1991 Jacobs et al.
D316,303 S 4/1991 Layne
D316,306 S 4/1991 Shemitz
5,027,168 A 6/1991 Edmond
D319,512 S 8/1991 Lettenmayer
D322,862 S 12/1991 Miller
5,087,212 A 2/1992 Hanami
D325,645 S 4/1992 Grange
5,140,507 A 8/1992 Harwood
D330,944 S 11/1992 Wereley
5,174,649 A 12/1992 Alston
5,177,404 A 1/1993 Cohen
5,210,051 A 5/1993 Carter, Jr.
D336,536 S 6/1993 Shaanan et al.
5,235,470 A 8/1993 Cheng
D340,514 S 10/1993 Liao
5,253,152 A 10/1993 Yang
5,282,364 A 2/1994 Cech
5,303,124 A 4/1994 Wrobel
5,324,213 A 6/1994 Frantz
5,325,281 A 6/1994 Harwood
D348,744 S 7/1994 Johnson et al.
5,335,159 A 8/1994 Chen et al.
5,337,225 A 8/1994 Brookman
5,338,944 A 8/1994 Edmond et al.
5,359,345 A 10/1994 Hunter
5,367,229 A 11/1994 Yang
5,381,323 A 1/1995 Osteen et al.
5,387,901 A 2/1995 Hardt
5,393,993 A 2/1995 Edmond et al.
5,410,462 A 4/1995 Wolfe
5,416,342 A 5/1995 Edmond et al.
5,436,809 A 7/1995 Brassier
5,440,466 A 8/1995 Belisle
5,450,303 A 9/1995 Markiewicz et al.
5,490,048 A 2/1996 Brassier
5,504,665 A 4/1996 Osteen et al.
5,515,253 A 5/1996 Sjobom
5,516,390 A 5/1996 Tomita et al.
5,523,589 A 6/1996 Edmond et al.
D373,437 S 9/1996 Kira
5,584,574 A 12/1996 Haddad
5,599,091 A 2/1997 Kira
5,604,135 A 2/1997 Edmond et al.
5,628,557 A 5/1997 Huang
5,631,190 A 5/1997 Negley
5,632,551 A 5/1997 Roney
5,634,822 A 6/1997 Gunell
5,655,832 A * 8/1997 Pelka ..... F24J 2/06 362/259
5,658,066 A 8/1997 Hirsch
D383,236 S 9/1997 Krogman
D384,336 S 9/1997 Gerber
5,676,453 A 10/1997 Parkyn, Jr.
D390,992 S 2/1998 Shemitz
5,713,662 A 2/1998 Kira
5,739,554 A 4/1998 Edmond et al.
5,757,144 A 5/1998 Nilssen
5,788,533 A 8/1998 Alvarado-Rodriguez
5,794,685 A 8/1998 Dean
5,800,050 A 9/1998 Leadford
5,806,955 A 9/1998 Parkyn, Jr.
D408,823 S 4/1999 Kirby
5,890,793 A 4/1999 Stephens
5,894,196 A 4/1999 McDermott
5,898,267 A 4/1999 McDermott
5,909,955 A 6/1999 Roorda
5,912,477 A 6/1999 Negley
5,938,316 A 8/1999 Yan
6,022,130 A 2/2000 Donato
6,051,940 A 4/2000 Arun
6,072,160 A 6/2000 Bahl
6,079,851 A 6/2000 Altman
6,083,021 A 7/2000 Lau
6,104,536 A 8/2000 Eckhardt
6,120,600 A 9/2000 Edmond et al.
6,124,673 A 9/2000 Bishop
6,149,112 A 11/2000 Thieltges
6,149,288 A 11/2000 Huang
6,176,594 B1 1/2001 Yarconi
D437,449 S 2/2001 Soller
D437,652 S 2/2001 Uhler
6,187,606 B1 2/2001 Edmond et al.
6,198,233 B1 3/2001 McConaughy

(56) References Cited

U.S. PATENT DOCUMENTS 6,201,262 B1 3/2001 Edmond et al.
D443,710 S 6/2001 Chiu
6,244,877 B1 6/2001 Asao
6,249,375 B1 6/2001 Silhengst
D445,936 S 7/2001 Mier-Langner et al.
6,260,981 B1 7/2001 Fiene
D446,592 S 8/2001 Leen
6,273,588 B1 8/2001 Arakelian
D448,508 S 9/2001 Benghozi
6,312,787 B1 11/2001 Hayashi et al.
6,318,883 B1 11/2001 Sugiyama et al.
D452,843 S 1/2002 Henrici
6,341,523 B2 1/2002 Lynam
D457,673 S 5/2002 Martinson
6,386,723 B1 5/2002 Eberlein et al.
6,390,646 B1 5/2002 Yan
6,392,360 B2 5/2002 McConaughy
6,426,704 B1 7/2002 Hutchison
6,435,693 B1 8/2002 Fiene
6,439,736 B1 8/2002 Fiene
6,439,743 B1 8/2002 Hutchison
6,439,749 B1 8/2002 Miller et al.
6,441,943 B1 8/2002 Roberts
D462,801 S 9/2002 Huang
6,450,662 B1 9/2002 Hutchison
6,450,664 B1 9/2002 Kelly
D464,455 S 10/2002 Fong
D464,939 S 10/2002 Chuang
D465,046 S 10/2002 Layne
6,473,002 B1 10/2002 Hutchison
6,474,839 B1 11/2002 Hutchison
6,478,453 B2 11/2002 Lammers
6,488,386 B1 12/2002 Yan
6,508,567 B1 1/2003 Fiene
D470,962 S 2/2003 Chen
6,525,939 B2 2/2003 Liang
D472,339 S 3/2003 Russello et al.
6,527,422 B1 3/2003 Hutchison
6,530,674 B2 3/2003 Grierson et al.
D473,529 S 4/2003 Feinbloom
6,540,382 B1 4/2003 Simon
6,561,690 B2 5/2003 Balestriero et al.
D476,439 S 6/2003 O'Rourke
6,600,175 B1 7/2003 Baretz et al.
6,601,970 B2 8/2003 Ueda
6,618,231 B2 9/2003 McConaughy
6,632,006 B1 10/2003 Rippel
6,636,003 B2 10/2003 Rahm et al.
D482,476 S 11/2003 Kwong
6,641,284 B2 11/2003 Stopa et al.
6,662,211 B1 12/2003 Weller
6,682,211 B2 1/2004 English
6,683,419 B2 1/2004 Kriparos
6,691,768 B2 2/2004 Hsieh
6,703,640 B1 3/2004 Hembree
6,733,164 B1 5/2004 Smith, Jr.
D491,306 S 6/2004 Zucker
6,744,693 B2 6/2004 Brockmann
6,752,645 B2 6/2004 Nakamura
6,773,138 B2 8/2004 Coushaine
6,787,999 B2 9/2004 Stimac
6,788,510 B2 9/2004 McConaughy
6,791,119 B2 9/2004 Slater, Jr. et al.
6,814,462 B1 11/2004 Fiene
6,824,296 B2 11/2004 Souza
6,824,390 B2 11/2004 Brown
6,827,469 B2 12/2004 Coushaine
6,853,010 B2 2/2005 Slater, Jr. et al.
6,860,617 B2 3/2005 Fiene
6,863,424 B2 3/2005 Smith
6,864,513 B2 3/2005 Lin
6,869,206 B2 3/2005 Zimmerman
6,871,993 B2 3/2005 Hecht
D504,967 S 5/2005 Kung
6,893,144 B2 5/2005 Fan
D506,065 S 6/2005 Sugino
6,902,200 B1 6/2005 Beadle
6,902,291 B2 6/2005 Rizkin
6,903,380 B2 6/2005 Barnett
6,905,232 B2 6/2005 Lin
6,946,806 B1 9/2005 Choi
6,958,497 B2 10/2005 Emerson et al.
6,966,677 B2 11/2005 Galli
6,979,097 B2 12/2005 Elam
D516,020 S 2/2006 Wong
D516,229 S 2/2006 Tang
6,998,650 B1 2/2006 Wu
7,040,774 B2 5/2006 Beeson et al.
7,063,130 B2 6/2006 Huang
7,063,440 B2 6/2006 Mohacsi et al.
7,066,617 B2 6/2006 Mandy
D524,975 S 7/2006 Oas
7,070,301 B2 7/2006 Magarill
7,077,546 B2 7/2006 Yamauchi
D527,119 S 8/2006 Maxik
D527,131 S 8/2006 McCarthy, III
7,093,958 B2 8/2006 Coushaine
7,095,056 B2 8/2006 Vitta et al.
7,097,332 B2 8/2006 Vamberi
7,098,397 B2 8/2006 Lange
7,111,963 B2 9/2006 Zhang
7,111,971 B2 9/2006 Coushaine
7,112,916 B2 9/2006 Goh
D530,683 S 10/2006 Rivas
7,131,749 B2 11/2006 Wimberly
7,132,804 B2 11/2006 Lys
7,138,667 B2 11/2006 Barnett
7,149,089 B2 12/2006 Blasko
7,150,553 B2 12/2006 English
D535,774 S 1/2007 Weston et al.
7,159,997 B2 1/2007 Reo et al.
7,160,004 B2 1/2007 Peck
7,172,319 B2 2/2007 Holder et al.
D538,951 S 3/2007 Maxik
D539,459 S 3/2007 Benghozi
7,198,386 B2 4/2007 Zampini
7,207,696 B1 4/2007 Lin
D541,957 S 5/2007 Wang
7,210,957 B2 5/2007 Mrakovich et al.
7,213,940 B1 5/2007 Van De Ven et al.
7,221,374 B2 5/2007 Dixon
D544,110 S 6/2007 Hooker
D545,457 S 6/2007 Chen
7,234,950 B1 6/2007 Wickett
7,237,930 B2 7/2007 Onishi et al.
D548,691 S 8/2007 Krieger
7,273,299 B2 9/2007 Parkyn et al.
D552,779 S 10/2007 Starck
7,282,840 B2 10/2007 Chih
7,286,296 B2 * 10/2007 Chaves ..... F21K 9/00
257/E33.071
7,288,902 B1 10/2007 Melanson
7,293,908 B2 11/2007 Beeson et al.
7,303,301 B2 12/2007 Koren
D561,924 S 2/2008 Yiu
D563,013 S 2/2008 Levine
7,329,907 B2 2/2008 Pang et al.
D564,119 S 3/2008 Metlen
7,344,279 B2 3/2008 Mueller
7,344,296 B2 3/2008 Matsui
7,357,534 B2 4/2008 Snyder
7,358,657 B2 4/2008 Koelger
7,358,679 B2 4/2008 Lys et al.
7,360,925 B2 4/2008 Coushaine
D568,829 S 5/2008 Yamashita
7,369,386 B2 5/2008 Rasmussen
D570,505 S 6/2008 Maxik
7,381,942 B2 6/2008 Chin et al.
D574,095 S 7/2008 Hill
7,396,139 B2 7/2008 Savage
7,396,146 B2 7/2008 Wang
7,413,326 B2 8/2008 Tain
D576,545 S 9/2008 Mandel
D576,964 S 9/2008 Shaner

(56) References Cited

U.S. PATENT DOCUMENTS

| | | | |
|---|---|---|---|
| D577,453 | S | 9/2008 | Metlen |
| D577,836 | S | 9/2008 | Engebrigtsen |
| 7,422,347 | B2 | 9/2008 | Miyairi et al. |
| D579,421 | S | 10/2008 | Chu |
| D581,080 | S | 11/2008 | Mier-Langner |
| D581,554 | S | 11/2008 | To |
| D581,583 | S | 11/2008 | Peng |
| 7,452,115 | B2 | 11/2008 | Alcelik |
| 7,456,499 | B2 | 11/2008 | Loh et al. |
| D583,975 | S | 12/2008 | Kushinskaya et al. |
| 7,458,820 | B2 | 12/2008 | Ohta |
| 7,467,888 | B2 | 12/2008 | Fiene |
| D585,588 | S | 1/2009 | Alexander |
| D585,589 | S | 1/2009 | Alexander |
| 7,481,552 | B2 | 1/2009 | Mayfield, III et al. |
| D586,498 | S | 2/2009 | Wu |
| D587,389 | S | 2/2009 | Benensohn |
| 7,494,248 | B2 | 2/2009 | Li |
| 7,497,581 | B2 | 3/2009 | Beeson et al. |
| 7,513,675 | B2 | 4/2009 | Mier-Langner |
| D591,894 | S | 5/2009 | Flank |
| D592,799 | S | 5/2009 | Scott |
| 7,532,324 | B2 | 5/2009 | Liu et al. |
| 7,537,464 | B2 | 5/2009 | Brandenburg |
| 7,539,028 | B2 | 5/2009 | Baurle et al. |
| D593,512 | S | 6/2009 | Lin |
| 7,540,761 | B2 | 6/2009 | Weber |
| 7,549,786 | B2 | 6/2009 | Higley |
| D597,246 | S | 7/2009 | Meyer, IV |
| D597,247 | S | 7/2009 | Meyer, IV |
| 7,559,784 | B2 | 7/2009 | Hsiao |
| 7,564,180 | B2 | 7/2009 | Brandes |
| D597,704 | S | 8/2009 | Peng |
| D599,040 | S | 8/2009 | Alexander |
| 7,575,332 | B2 | 8/2009 | Cok |
| 7,575,338 | B1 | 8/2009 | Verfuerth |
| 7,580,192 | B1 | 8/2009 | Chu |
| D601,276 | S | 9/2009 | Grajcar |
| 7,591,572 | B1 | 9/2009 | Levine |
| 7,594,738 | B1 | 9/2009 | Lin |
| D602,868 | S | 10/2009 | Vogt |
| 7,604,365 | B2 | 10/2009 | Chang |
| 7,607,802 | B2 | 10/2009 | Kang |
| 7,621,770 | B1 | 11/2009 | Finizio |
| 7,626,345 | B2 | 12/2009 | Young |
| 7,628,506 | B2 | 12/2009 | Verfuerth |
| 7,637,635 | B2 | 12/2009 | Xiao |
| D608,043 | S | 1/2010 | Ko |
| D610,543 | S | 2/2010 | Coushaine |
| D610,723 | S | 2/2010 | Grajcar |
| D610,729 | S | 2/2010 | Kushinskaya et al. |
| 7,665,862 | B2 | 2/2010 | Villard |
| 7,674,018 | B2 | 3/2010 | Holder et al. |
| 7,679,281 | B2 | 3/2010 | Kim et al. |
| 7,686,481 | B1 | 3/2010 | Condon et al. |
| 7,690,810 | B2 | 4/2010 | Saitoh et al. |
| 7,703,951 | B2 | 4/2010 | Piepgras |
| 7,722,227 | B2 | 5/2010 | Zhang |
| 7,727,009 | B2 | 6/2010 | Goto |
| 7,731,395 | B2 | 6/2010 | Parkyn et al. |
| 7,731,396 | B2 | 6/2010 | Fay |
| 7,736,029 | B2 | 6/2010 | Chen et al. |
| 7,737,634 | B2 | 6/2010 | Leng et al. |
| 7,740,380 | B2 | 6/2010 | Thrailkill |
| 7,744,259 | B2 | 6/2010 | Walczak |
| 7,744,266 | B2 | 6/2010 | Higley |
| 7,748,870 | B2 | 7/2010 | Chang |
| 7,759,881 | B1 | 7/2010 | Melanson |
| 7,766,508 | B2 | 8/2010 | Villard et al. |
| 7,766,518 | B2 | 8/2010 | Piepgras |
| 7,784,966 | B2 | 8/2010 | Verfuerth |
| 7,785,124 | B2 | 8/2010 | Lin |
| D625,870 | S | 10/2010 | Feigenbaum |
| D626,094 | S | 10/2010 | Alexander |
| 7,806,562 | B2 | 10/2010 | Behr |
| 7,810,951 | B1 | 10/2010 | Lee et al. |
| 7,810,955 | B2 | 10/2010 | Stimac et al. |
| 7,810,995 | B2 | 10/2010 | Fadler et al. |
| 7,813,111 | B2 | 10/2010 | Anderson |
| 7,819,549 | B2 | 10/2010 | Narendran et al. |
| D627,507 | S | 11/2010 | Lai |
| D627,727 | S | 11/2010 | Alexander |
| D628,156 | S | 11/2010 | Alexander |
| 7,828,576 | B2 | 11/2010 | Lin |
| 7,837,348 | B2 | 11/2010 | Narendran et al. |
| 7,841,753 | B2 | 11/2010 | Liu |
| D629,365 | S | 12/2010 | Garcia De Vicuna |
| 7,845,393 | B2 | 12/2010 | Kao |
| 7,857,482 | B2 | 12/2010 | Reo et al. |
| 7,857,498 | B2 | 12/2010 | Smith |
| 7,866,850 | B2 | 1/2011 | Alexander |
| 7,874,700 | B2 | 1/2011 | Patrick |
| D633,244 | S | 2/2011 | Kramer et al. |
| D633,248 | S | 2/2011 | Alexander |
| 7,889,421 | B2 | 2/2011 | Narendran |
| 7,896,517 | B2 | 3/2011 | Mandy |
| 7,901,108 | B2 | 3/2011 | Kabuki et al. |
| 7,914,162 | B1 | 3/2011 | Huang |
| 7,914,198 | B2 | 3/2011 | Mier-Langner |
| 7,918,581 | B2 | 4/2011 | Van De Ven |
| 7,918,589 | B2 | 4/2011 | Mayfield, III et al. |
| 7,922,364 | B2 | 4/2011 | Tessnow |
| 7,923,907 | B2 | 4/2011 | Tessnow |
| 7,942,559 | B2 | 5/2011 | Holder et al. |
| 7,952,114 | B2 | 5/2011 | Gingrich, III |
| 7,965,494 | B1 | 6/2011 | Morris |
| 7,972,038 | B2 | 7/2011 | Albright |
| 7,972,054 | B2 | 7/2011 | Alexander |
| 7,976,194 | B2 | 7/2011 | Wilcox et al. |
| 7,985,005 | B2 | 7/2011 | Alexander |
| 7,988,336 | B1 | 8/2011 | Harbers |
| 7,993,031 | B2 | 8/2011 | Grajcar |
| 8,002,438 | B2 | 8/2011 | Ko |
| 8,007,131 | B2 | 8/2011 | Liu et al. |
| D645,007 | S | 9/2011 | Alexander |
| D645,594 | S | 9/2011 | Grawe |
| 8,021,008 | B2 | 9/2011 | Ramer |
| 8,029,157 | B2 | 10/2011 | Li et al. |
| 8,033,680 | B2 | 10/2011 | Sharrah |
| 8,052,310 | B2 | 11/2011 | Gingrinch, III |
| 8,066,403 | B2 | 11/2011 | Sanfilippo et al. |
| D650,504 | S | 12/2011 | Kim et al. |
| D650,935 | S | 12/2011 | Beghelli |
| 8,080,819 | B2 | 12/2011 | Mueller et al. |
| 8,083,364 | B2 | 12/2011 | Allen |
| 8,096,668 | B2 | 1/2012 | Abu-Ageel |
| 8,100,560 | B2 | 1/2012 | Ahland, III et al. |
| 8,100,564 | B2 | 1/2012 | Ono |
| 8,102,167 | B2 | 1/2012 | Irissou et al. |
| 8,102,683 | B2 | 1/2012 | Gaknoki et al. |
| D654,607 | S | 2/2012 | Kim et al. |
| 8,118,450 | B2 | 2/2012 | Villard |
| 8,118,454 | B2 | 2/2012 | Rains, Jr. et al. |
| 8,123,376 | B2 | 2/2012 | Van De Ven et al. |
| 8,125,776 | B2 | 2/2012 | Alexander |
| D655,432 | S | 3/2012 | Beghelli |
| D655,840 | S | 3/2012 | Heaton et al. |
| D655,842 | S | 3/2012 | Sabernig |
| 8,129,669 | B2 | 3/2012 | Chen et al. |
| 8,136,958 | B2 | 3/2012 | Verfuerth |
| 8,138,690 | B2 | 3/2012 | Chemel et al. |
| 8,142,047 | B2 | 3/2012 | Acampora et al. |
| 8,143,803 | B2 | 3/2012 | Beij et al. |
| 8,152,336 | B2 | 4/2012 | Alexander |
| 8,154,864 | B1 | 4/2012 | Nearman |
| 8,162,498 | B2 | 4/2012 | Ramer et al. |
| D659,871 | S | 5/2012 | Lee et al. |
| D660,229 | S | 5/2012 | Tseng |
| 8,172,425 | B2 | 5/2012 | Wen et al. |
| 8,172,436 | B2 | 5/2012 | Coleman |
| 8,177,395 | B2 | 5/2012 | Alexander |
| 8,182,122 | B2 | 5/2012 | Chiu |
| 8,191,613 | B2 | 6/2012 | Yuan |
| 8,193,738 | B2 | 6/2012 | Chu et al. |

(56) References Cited

U.S. PATENT DOCUMENTS

| | | | |
|---|---|---|---|
| 8,201,965 | B2 | 6/2012 | Yamada |
| 8,205,998 | B2 | 6/2012 | Ramer et al. |
| 8,210,722 | B2 | 7/2012 | Holder et al. |
| 8,212,469 | B2 | 7/2012 | Rains, Jr. et al. |
| 8,215,798 | B2 | 7/2012 | Rains, Jr. et al. |
| 8,232,745 | B2 | 7/2012 | Chemel et al. |
| D665,340 | S | 8/2012 | Obata |
| 8,242,766 | B2 | 8/2012 | Gaknoki et al. |
| 8,292,482 | B2 | 10/2012 | Harbers |
| 8,297,788 | B2 | 10/2012 | Bishop |
| 8,297,792 | B1 | 10/2012 | Wang |
| 8,297,808 | B2 | 10/2012 | Yuan |
| 8,319,437 | B2 | 11/2012 | Carlin |
| 8,324,838 | B2 | 12/2012 | Shah et al. |
| 8,330,378 | B2 | 12/2012 | Maehara et al. |
| 8,337,043 | B2 | 12/2012 | Verfuerth |
| 8,344,602 | B2 | 1/2013 | Lai |
| 8,360,609 | B2 | 1/2013 | Lee et al. |
| 8,360,621 | B2 | 1/2013 | Avila et al. |
| 8,385,071 | B2 | 2/2013 | Lin |
| 8,403,541 | B1 | 3/2013 | Rashidi |
| 8,410,716 | B2 | 4/2013 | Yao et al. |
| 8,414,178 | B2 | 4/2013 | Alexander |
| 8,434,898 | B2 | 5/2013 | Sanfilippo et al. |
| 8,436,556 | B2 | 5/2013 | Eisele et al. |
| 8,454,193 | B2 | 6/2013 | Simon et al. |
| 8,459,841 | B2 | 6/2013 | Huang |
| 8,462,523 | B2 | 6/2013 | Gaknoki et al. |
| 8,469,542 | B2 | 6/2013 | Zampini, II et al. |
| 8,503,083 | B2 | 8/2013 | Seo |
| 8,529,102 | B2 | 9/2013 | Pickard et al. |
| 8,531,134 | B2 | 9/2013 | Chemel et al. |
| 8,536,802 | B2 | 9/2013 | Chemel et al. |
| 8,536,805 | B2 | 9/2013 | Shah et al. |
| 8,543,249 | B2 | 9/2013 | Chemel et al. |
| D690,859 | S | 10/2013 | Mollaghaffari |
| 8,545,045 | B2 | 10/2013 | Tress |
| 8,545,049 | B2 | 10/2013 | Davis et al. |
| 8,547,034 | B2 | 10/2013 | Melanson et al. |
| 8,552,664 | B2 | 10/2013 | Chemel et al. |
| 8,556,469 | B2 | 10/2013 | Pickard |
| 8,558,518 | B2 | 10/2013 | Irissou et al. |
| 8,562,180 | B2 | 10/2013 | Alexander |
| 8,569,972 | B2 | 10/2013 | Melanson |
| 8,573,807 | B2 | 11/2013 | Borkar et al. |
| 8,573,816 | B2 | 11/2013 | Negley et al. |
| 8,575,858 | B2 | 11/2013 | Policy et al. |
| 8,579,467 | B1 | 11/2013 | Szeto |
| 8,581,504 | B2 | 11/2013 | Kost et al. |
| 8,581,521 | B2 | 11/2013 | Welten et al. |
| 8,585,245 | B2 | 11/2013 | Black et al. |
| 8,587,211 | B2 | 11/2013 | Melanson |
| 8,593,074 | B2 | 11/2013 | Hatley et al. |
| 8,593,129 | B2 | 11/2013 | Gaknoki et al. |
| 8,593,814 | B2 | 11/2013 | Ji |
| D694,925 | S | 12/2013 | Fukasawa |
| 8,598,809 | B2 | 12/2013 | Negley et al. |
| 8,602,591 | B2 | 12/2013 | Lee |
| 8,610,364 | B2 | 12/2013 | Melanson et al. |
| 8,610,365 | B2 | 12/2013 | King et al. |
| 8,611,106 | B2 | 12/2013 | Fang |
| 8,616,724 | B2 | 12/2013 | Pickard |
| 8,624,505 | B2 | 1/2014 | Huang |
| D699,179 | S | 2/2014 | Alexander |
| 8,643,038 | B2 | 2/2014 | Collins |
| 8,646,944 | B2 | 2/2014 | Villard |
| 8,646,949 | B2 | 2/2014 | Brunt, Jr. et al. |
| 8,652,357 | B2 | 2/2014 | Ryu |
| 8,653,750 | B2 | 2/2014 | Deurenberg et al. |
| D700,728 | S | 3/2014 | Fukasawa |
| 8,684,556 | B2 | 4/2014 | Negley et al. |
| 8,684,569 | B2 | 4/2014 | Pickard et al. |
| 8,690,383 | B2 | 4/2014 | Zampini, II et al. |
| 8,698,421 | B2 | 4/2014 | Ludorf |
| D704,369 | S | 5/2014 | Lindsley et al. |
| 8,723,427 | B2 | 5/2014 | Collins et al. |
| 8,740,444 | B2 | 6/2014 | Reynolds et al. |
| 8,742,684 | B2 | 6/2014 | Melanson |
| 8,749,131 | B2 | 6/2014 | Rains, Jr. et al. |
| 8,749,173 | B1 | 6/2014 | Melanson et al. |
| 8,757,840 | B2 | 6/2014 | Pickard et al. |
| 8,760,073 | B2 | 6/2014 | Ko |
| 8,760,080 | B2 | 6/2014 | Yu |
| 8,764,225 | B2 | 7/2014 | Narendran et al. |
| 8,777,455 | B2 | 7/2014 | Pickard et al. |
| 8,783,938 | B2 | 7/2014 | Alexander |
| 8,786,201 | B2 | 7/2014 | Hamamoto et al. |
| 8,786,210 | B2 | 7/2014 | Delucia |
| 8,786,211 | B2 | 7/2014 | Gilliom |
| 8,786,212 | B2 | 7/2014 | Terazawa |
| 8,786,213 | B2 | 7/2014 | Yang et al. |
| 8,791,642 | B2 | 7/2014 | Van De Ven |
| 8,794,792 | B1 | 8/2014 | Moghal |
| 8,796,948 | B2 | 8/2014 | Weaver |
| 8,810,227 | B2 | 8/2014 | Flaibani et al. |
| 8,814,385 | B2 | 8/2014 | Onaka et al. |
| 8,816,593 | B2 | 8/2014 | Lys et al. |
| 8,820,964 | B2 | 9/2014 | Gould |
| 8,836,226 | B2 | 9/2014 | Mercier et al. |
| 8,840,278 | B2 | 9/2014 | Pickard |
| 8,847,515 | B2 | 9/2014 | King et al. |
| 8,853,958 | B2 | 10/2014 | Athalye et al. |
| 8,858,028 | B2 | 10/2014 | Kim |
| 8,876,322 | B2 | 11/2014 | Alexander |
| 8,888,315 | B2 | 11/2014 | Edwards et al. |
| 8,888,506 | B2 | 11/2014 | Nishimura |
| 8,901,838 | B2 | 12/2014 | Akiyama et al. |
| 8,944,647 | B2 | 2/2015 | Bueeler |
| D724,773 | S | 3/2015 | Ryu |
| 8,970,101 | B2 | 3/2015 | Sutardja |
| 9,010,967 | B2 | 4/2015 | Jensen |
| 9,052,100 | B2 | 6/2015 | Blackstone |
| 9,307,588 | B2 | 4/2016 | Li |
| 2001/0006463 | A1 | 7/2001 | Fischer |
| 2001/0053628 | A1 | 12/2001 | Hayakawa |
| 2002/0046826 | A1 | 4/2002 | Kao |
| 2002/0067613 | A1 | 6/2002 | Grove |
| 2002/0106925 | A1 | 8/2002 | Yamagishi |
| 2002/0117692 | A1 | 8/2002 | Lin |
| 2003/0058658 | A1 | 3/2003 | Lee |
| 2003/0072156 | A1 | 4/2003 | Pohlert |
| 2003/0128543 | A1 | 7/2003 | Rekow |
| 2003/0174517 | A1 | 9/2003 | Kiraly et al. |
| 2003/0185005 | A1 | 10/2003 | Sommers |
| 2003/0209963 | A1 | 11/2003 | Altgilbers |
| 2004/0005800 | A1 | 1/2004 | Hou |
| 2004/0090781 | A1 | 5/2004 | Yeoh |
| 2004/0090784 | A1 | 5/2004 | Ward |
| 2004/0212991 | A1 | 10/2004 | Galli |
| 2004/0218372 | A1 | 11/2004 | Hamasaki |
| 2005/0032402 | A1 | 2/2005 | Takanashi |
| 2005/0047170 | A1 | 3/2005 | Hilburger |
| 2005/0083698 | A1 | 4/2005 | Zampini |
| 2005/0122713 | A1 | 6/2005 | Hutchins |
| 2005/0130336 | A1 | 6/2005 | Collins, III |
| 2005/0146884 | A1 | 7/2005 | Scheithauer |
| 2005/0174780 | A1 | 8/2005 | Park |
| 2005/0205878 | A1 | 9/2005 | Kan |
| 2005/0242362 | A1 | 11/2005 | Shimizu |
| 2005/0269060 | A1 | 12/2005 | Ku |
| 2005/0270775 | A1 | 12/2005 | Harbers |
| 2005/0286265 | A1 | 12/2005 | Zampini et al. |
| 2006/0001381 | A1 | 1/2006 | Robinson |
| 2006/0039156 | A1 | 2/2006 | Chen |
| 2006/0062019 | A1 | 3/2006 | Young |
| 2006/0076672 | A1 | 4/2006 | Petroski |
| 2006/0141851 | A1 | 6/2006 | Matsui |
| 2006/0146422 | A1 | 7/2006 | Koike |
| 2006/0146531 | A1 | 7/2006 | Reo et al. |
| 2006/0152140 | A1 | 7/2006 | Brandes |
| 2006/0221272 | A1 | 10/2006 | Negley et al. |
| 2006/0262544 | A1 | 11/2006 | Piepgras |
| 2006/0262545 | A1 | 11/2006 | Piepgras |
| 2007/0025103 | A1 | 2/2007 | Chan |

(56) References Cited

U.S. PATENT DOCUMENTS

2007/0064428 A1 3/2007 Beauchamp
2007/0096057 A1 5/2007 Hampden-Smith
2007/0109795 A1 5/2007 Gabrius
2007/0139923 A1 6/2007 Negley et al.
2007/0153521 A1 7/2007 Konuma
2007/0158668 A1 7/2007 Tarsa et al.
2007/0170447 A1 7/2007 Negley et al.
2007/0223219 A1 9/2007 Medendorp, Jr. et al.
2007/0238327 A1 10/2007 Hsu
2007/0242461 A1 10/2007 Reisenauer
2007/0253201 A1 11/2007 Blincoe
2007/0253202 A1 11/2007 Wu
2007/0253209 A1 11/2007 Loh et al.
2007/0268698 A1 11/2007 Chen et al.
2007/0269915 A1 11/2007 Leong et al.
2007/0275576 A1 11/2007 Yang
2007/0285028 A1 12/2007 Tsinker et al.
2007/0295969 A1 12/2007 Chew et al.
2007/0297177 A1 12/2007 Wang
2008/0012036 A1 1/2008 Loh et al.
2008/0013316 A1 1/2008 Chiang
2008/0043470 A1 2/2008 Wimberly
2008/0076272 A1 3/2008 Hsu
2008/0080190 A1 4/2008 Walczak
2008/0084700 A1 4/2008 Van De Ven
2008/0106907 A1 5/2008 Trott
2008/0112121 A1 5/2008 Cheng
2008/0117500 A1 5/2008 Narendran et al.
2008/0121921 A1 5/2008 Loh et al.
2008/0130275 A1 6/2008 Higley
2008/0142194 A1 6/2008 Zhou
2008/0157112 A1 7/2008 He
2008/0158881 A1* 7/2008 Liu ..... F21V 7/0091 362/245
2008/0158887 A1 7/2008 Zhu
2008/0165530 A1 7/2008 Hendrikus
2008/0173884 A1 7/2008 Chitnis et al.
2008/0179611 A1 7/2008 Chitnis et al.
2008/0192478 A1 8/2008 Chen
2008/0198112 A1 8/2008 Roberts
2008/0219002 A1 9/2008 Sommers et al.
2008/0219303 A1 9/2008 Chen et al.
2008/0224598 A1 9/2008 Baretz
2008/0224631 A1 9/2008 Melanson
2008/0274641 A1 11/2008 Weber
2008/0308825 A1 12/2008 Chakraborty et al.
2009/0021936 A1 1/2009 Stimac et al.
2009/0026913 A1 1/2009 Mrakovich
2009/0034283 A1 2/2009 Albright
2009/0046464 A1 2/2009 Liu
2009/0050907 A1 2/2009 Yuan et al.
2009/0050908 A1 2/2009 Yuan et al.
2009/0052158 A1 2/2009 Bierhuizen
2009/0080185 A1 3/2009 McMillan
2009/0086474 A1 4/2009 Chou
2009/0091935 A1 4/2009 Tsai
2009/0103299 A1 4/2009 Boyer et al.
2009/0129084 A1 5/2009 Tsao
2009/0141500 A1 6/2009 Peng
2009/0154166 A1 6/2009 Zhang
2009/0161360 A1* 6/2009 Li ..... F21V 5/048 362/235
2009/0167203 A1 7/2009 Dahlman et al.
2009/0180276 A1* 7/2009 Benitez ..... G02B 6/0036 362/97.4
2009/0184616 A1 7/2009 Van De Ven et al.
2009/0195168 A1 8/2009 Greenfeld
2009/0225551 A1 9/2009 Chang et al.
2009/0236997 A1 9/2009 Liu
2009/0294114 A1 12/2009 Yang
2009/0296388 A1 12/2009 Wu et al.
2009/0310354 A1 12/2009 Zampini, II et al.
2009/0317988 A1 12/2009 Lin
2010/0015821 A1 1/2010 Hsu
2010/0019697 A1 1/2010 Korsunsky
2010/0026158 A1 2/2010 Wu
2010/0027258 A1 2/2010 Maxik
2010/0060202 A1 3/2010 Melanson et al.
2010/0072505 A1 3/2010 Gingrich, III
2010/0073783 A1 3/2010 Sun
2010/0073884 A1 3/2010 Peloza
2010/0091487 A1 4/2010 Shin
2010/0091497 A1 4/2010 Chen
2010/0102696 A1 4/2010 Sun
2010/0110684 A1 5/2010 Abdelsamed et al.
2010/0110728 A1 5/2010 Dubrow et al.
2010/0128484 A1 5/2010 Peng
2010/0132918 A1 6/2010 Lin
2010/0141173 A1 6/2010 Negrete
2010/0142189 A1 6/2010 Hong
2010/0149818 A1 6/2010 Ruffin
2010/0157605 A1 6/2010 Chang
2010/0174345 A1 7/2010 Ashdown
2010/0195323 A1 8/2010 Schaefer et al.
2010/0230709 A1 9/2010 Kanno
2010/0238630 A1 9/2010 Xu
2010/0243219 A1 9/2010 Yang
2010/0246179 A1 9/2010 Long
2010/0260945 A1 10/2010 Kites
2010/0284181 A1 11/2010 O'Brien et al.
2010/0296289 A1 11/2010 Villard et al.
2010/0301360 A1 12/2010 Van De Ven
2010/0301774 A1 12/2010 Chemel et al.
2010/0308742 A1 12/2010 Melanson
2010/0319953 A1 12/2010 Yochum
2011/0013397 A1 1/2011 Catone et al.
2011/0043129 A1 2/2011 Koolen
2011/0044046 A1 2/2011 Abu-Ageel
2011/0049749 A1 3/2011 Bailey
2011/0050100 A1 3/2011 Bailey
2011/0050101 A1 3/2011 Bailey
2011/0050124 A1 3/2011 Bailey
2011/0051407 A1 3/2011 St. Ives et al.
2011/0051414 A1 3/2011 Bailey
2011/0090684 A1 4/2011 Logan et al.
2011/0097921 A1 4/2011 Hsu
2011/0103070 A1 5/2011 Zhang et al.
2011/0115381 A1 5/2011 Carlin
2011/0122643 A1 5/2011 Spork
2011/0134634 A1 6/2011 Gingrich, III
2011/0136374 A1 6/2011 Mostoller
2011/0140620 A1 6/2011 Lin et al.
2011/0180841 A1 7/2011 Chang
2011/0193490 A1 8/2011 Kumar
2011/0210360 A1 9/2011 Negley
2011/0222270 A1 9/2011 Porciatti
2011/0222277 A1 9/2011 Negley
2011/0253358 A1 10/2011 Huang
2011/0255287 A1 10/2011 Li
2011/0273079 A1 11/2011 Pickard
2011/0279015 A1 11/2011 Negley
2011/0285308 A1 11/2011 Crystal
2011/0285314 A1 11/2011 Carney et al.
2011/0292483 A1 12/2011 Pakhchyan et al.
2011/0306219 A1 12/2011 Swanger
2011/0309773 A1 12/2011 Beers
2011/0316441 A1 12/2011 Huynh
2011/0316446 A1 12/2011 Kang et al.
2012/0002417 A1 1/2012 Li
2012/0014115 A1 1/2012 Park et al.
2012/0018754 A1 1/2012 Lowes
2012/0019127 A1 1/2012 Hirosaki
2012/0021623 A1 1/2012 Gorman
2012/0025729 A1 2/2012 Melanson et al.
2012/0038280 A1 2/2012 Zoorob et al.
2012/0038291 A1 2/2012 Hasnain
2012/0051048 A1 3/2012 Smit
2012/0051056 A1 3/2012 Derks
2012/0051068 A1 3/2012 Pelton
2012/0092860 A1 4/2012 Blackstone
2012/0106152 A1 5/2012 Zheng
2012/0112661 A1 5/2012 Van De Ven
2012/0119658 A1 5/2012 McDaniel
2012/0140468 A1 6/2012 Chang

(56) References Cited

U.S. PATENT DOCUMENTS

| | | | |
|---|---|---|---|
| 2012/0140474 | A1 | 6/2012 | Jurik et al. |
| 2012/0146519 | A1 | 6/2012 | Briggs |
| 2012/0169242 | A1 | 7/2012 | Olson |
| 2012/0175653 | A1 | 7/2012 | Weber |
| 2012/0187830 | A1 | 7/2012 | Shum |
| 2012/0223657 | A1 | 9/2012 | Van De Ven |
| 2012/0224177 | A1 | 9/2012 | Harbers et al. |
| 2012/0236553 | A1 | 9/2012 | Cash |
| 2012/0250309 | A1 | 10/2012 | Handsaker |
| 2012/0268894 | A1 | 10/2012 | Alexander |
| 2012/0286304 | A1 | 11/2012 | Letoquin |
| 2012/0286319 | A1 | 11/2012 | Lee |
| 2012/0287642 | A1 | 11/2012 | Zeng |
| 2012/0292660 | A1 | 11/2012 | Kanno |
| 2012/0307487 | A1 | 12/2012 | Eckel |
| 2012/0307494 | A1 | 12/2012 | Zlotnikov et al. |
| 2012/0313124 | A1 | 12/2012 | Clatterbuck |
| 2013/0002167 | A1 | 1/2013 | Van De Ven |
| 2013/0003370 | A1 | 1/2013 | Watanabe |
| 2013/0003388 | A1 | 1/2013 | Jensen |
| 2013/0026942 | A1 | 1/2013 | Ryan |
| 2013/0042510 | A1 | 2/2013 | Nall et al. |
| 2013/0049602 | A1 | 2/2013 | Raj |
| 2013/0049603 | A1 | 2/2013 | Bradford |
| 2013/0049627 | A1 | 2/2013 | Roberts |
| 2013/0069561 | A1 | 3/2013 | Melanson et al. |
| 2013/0070441 | A1 | 3/2013 | Moon |
| 2013/0070442 | A1 | 3/2013 | Negley |
| 2013/0082612 | A1 | 4/2013 | Kim |
| 2013/0083510 | A1 | 4/2013 | Park |
| 2013/0094225 | A1 | 4/2013 | Leichner |
| 2013/0095673 | A1 | 4/2013 | Brandon |
| 2013/0140490 | A1 | 6/2013 | Fujinaga |
| 2013/0162140 | A1 | 6/2013 | Shamoto et al. |
| 2013/0170220 | A1* | 7/2013 | Bueeler ..... F21K 9/00 362/296.01 |
| 2013/0170221 | A1 | 7/2013 | Isogai et al. |
| 2013/0176728 | A1 | 7/2013 | Bizzotto et al. |
| 2013/0193869 | A1 | 8/2013 | Hong et al. |
| 2013/0221489 | A1 | 8/2013 | Cao et al. |
| 2013/0229114 | A1 | 9/2013 | Eisele et al. |
| 2013/0229804 | A1 | 9/2013 | Holder et al. |
| 2013/0235555 | A1 | 9/2013 | Tanaka |
| 2013/0235579 | A1 | 9/2013 | Smith |
| 2013/0235580 | A1 | 9/2013 | Smith |
| 2013/0241392 | A1 | 9/2013 | Pickard et al. |
| 2013/0241440 | A1 | 9/2013 | Gaknoki et al. |
| 2013/0249434 | A1 | 9/2013 | Medendorp |
| 2013/0250573 | A1 | 9/2013 | Taskar et al. |
| 2013/0250581 | A1 | 9/2013 | Tang et al. |
| 2013/0258636 | A1 | 10/2013 | Rettke |
| 2013/0265777 | A1 | 10/2013 | Zollers et al. |
| 2013/0300303 | A1 | 11/2013 | Liu |
| 2013/0301252 | A1 | 11/2013 | Hussell et al. |
| 2013/0322072 | A1 | 12/2013 | Pu et al. |
| 2014/0015419 | A1 | 1/2014 | Shah et al. |
| 2014/0016318 | A1 | 1/2014 | Pokrajac |
| 2014/0036510 | A1 | 2/2014 | Preston et al. |
| 2014/0043813 | A1 | 2/2014 | Dub' et al. |
| 2014/0048743 | A1 | 2/2014 | Le-Mercier |
| 2014/0049241 | A1 | 2/2014 | Gaknoki et al. |
| 2014/0049962 | A1 | 2/2014 | Holder et al. |
| 2014/0055038 | A1 | 2/2014 | Cappitelli et al. |
| 2014/0055054 | A1 | 2/2014 | Borkar et al. |
| 2014/0062330 | A1 | 3/2014 | Neundorfer |
| 2014/0063779 | A1 | 3/2014 | Bradford |
| 2014/0071685 | A1 | 3/2014 | Black et al. |
| 2014/0071696 | A1 | 3/2014 | Park, II et al. |
| 2014/0078715 | A1 | 3/2014 | Pickard et al. |
| 2014/0078722 | A1 | 3/2014 | Caldwell et al. |
| 2014/0078746 | A1 | 3/2014 | Caldwell et al. |
| 2014/0103796 | A1 | 4/2014 | Jansen |
| 2014/0126205 | A1 | 5/2014 | Davis et al. |
| 2014/0126224 | A1 | 5/2014 | Brunt, Jr. et al. |
| 2014/0134880 | A1 | 5/2014 | Yeh |
| 2014/0140052 | A1 | 5/2014 | Villard |
| 2014/0159077 | A1 | 6/2014 | Kuenzler |
| 2014/0159600 | A1 | 6/2014 | Sutardja |
| 2014/0167601 | A1 | 6/2014 | Harry |
| 2014/0167646 | A1 | 6/2014 | Zukauskas et al. |
| 2014/0176016 | A1 | 6/2014 | Li |
| 2014/0198531 | A1 | 7/2014 | Iwasaki |
| 2014/0217433 | A1 | 8/2014 | Tudorica |
| 2014/0217907 | A1 | 8/2014 | Harris |
| 2014/0218909 | A1 | 8/2014 | Tetsuo et al. |
| 2014/0225511 | A1 | 8/2014 | Pickard et al. |
| 2014/0225532 | A1 | 8/2014 | Groeneveld |
| 2014/0233193 | A1 | 8/2014 | Alexander |
| 2014/0268631 | A1 | 9/2014 | Pickard |
| 2014/0268724 | A1 | 9/2014 | Yanping |
| 2014/0268737 | A1 | 9/2014 | Athalye et al. |
| 2014/0286016 | A1 | 9/2014 | Montagne |
| 2014/0286018 | A1 | 9/2014 | Zhang et al. |
| 2014/0361701 | A1 | 12/2014 | Siessegger et al. |
| 2014/0367633 | A1 | 12/2014 | Bibl |
| 2015/0002034 | A1 | 1/2015 | Van De Ven |
| 2015/0029717 | A1 | 1/2015 | Shen et al. |
| 2015/0036339 | A1 | 2/2015 | Ashdown et al. |
| 2015/0043218 | A1 | 2/2015 | Hu |
| 2015/0060922 | A1 | 3/2015 | Wilcox |
| 2015/0236225 | A1 | 8/2015 | David |
| 2015/0295144 | A1 | 10/2015 | Weiler |
| 2016/0174319 | A1 | 6/2016 | Li |

FOREIGN PATENT DOCUMENTS

| | | | |
|---|---|---|---|
| CN | 201739849 | A | 2/2011 |
| CN | 202040752 | A | 11/2011 |
| CN | 102269351 | A | 12/2011 |
| GB | 2457016 | A | 8/2009 |
| JP | 61-070306 | U | 5/1986 |
| JP | 2003-092022 | A | 3/2003 |
| JP | 2004-179048 | A | 6/2004 |
| JP | 2004-265626 | A | 9/2004 |
| JP | 2005-017554 | A | 1/2005 |
| JP | 2005-071818 | A | 3/2005 |
| JP | 2005-235778 | A | 9/2005 |
| JP | 2005-267964 | A | 9/2005 |
| JP | 2006-236796 | A | 9/2006 |
| JP | 2006-253274 | A | 9/2006 |
| JP | 2006-310138 | A | 11/2006 |
| JP | O1307268 | B | 8/2007 |
| JP | O1307434 | B | 8/2007 |
| JP | 2007-273205 | A | 10/2007 |
| JP | 2007-273209 | A | 10/2007 |
| JP | 2011-508406 | A | 3/2011 |
| JP | 2011-204495 | A | 10/2011 |
| JP | 2011-204658 | A | 10/2011 |
| KR | 1020070039683 | A | 4/2007 |
| KR | 1020090013704 | A | 2/2009 |
| KR | 100974942 | B1 | 8/2010 |
| KR | 1020120050280 | A | 5/2012 |
| TW | 2004-25542 | A | 11/2004 |
| TW | 290967 | M | 5/2006 |
| TW | 296481 | M | 8/2006 |
| TW | 1273858 | B | 2/2007 |
| TW | 1318461 | B | 12/2009 |
| WO | OM/057383 | B | 9/2001 |
| WO | 02/12788 | A1 | 2/2002 |
| WO | 02/15281 | A2 | 2/2002 |
| WO | 2004/071143 | A1 | 8/2004 |
| WO | 2005/093862 | A2 | 10/2005 |
| WO | 2006/066531 | A1 | 6/2006 |
| WO | 2006066531 | A1 | 6/2006 |
| WO | 2007/128070 | A1 | 11/2007 |
| WO | 2008/108832 | A1 | 9/2008 |
| WO | 2009/044330 | A1 | 4/2009 |
| WO | 2009108799 | A1 | 9/2009 |
| WO | 2009/120555 | A1 | 10/2009 |
| WO | 2010/016002 | A1 | 2/2010 |
| WO | 2010059647 | A1 | 5/2010 |
| WO | 2011019945 | A1 | 2/2011 |
| WO | 2013059298 | A1 | 4/2013 |
| WO | 2013192014 | A2 | 12/2013 |

(56) References Cited

FOREIGN PATENT DOCUMENTS

| | | | |
|---|---|---|---|
| WO | 2013192014 | A3 | 12/2013 |
| WO | 2014099681 | A2 | 6/2014 |
| WO | 2014099681 | A3 | 12/2014 |

OTHER PUBLICATIONS

Knight, Colette, "XICATO—Investigations on the use of LED modules for optimized color appearance in retail applications," downloaded on May 28, 2014 from http://www.xicato.com/sites/default/files/documents/Summary_Investigations_on_the_use_of_LED_modules_for_optimized_color_appearance_in_retail_applications.pdf, 5pp.
"Zumtobel—IYON Tunable White,", downloaded on Oct. 19, 2015 from http://www.zumtobel.com/tunablewhile/en/index.html#topic_04, 1p.
"Zumtobel—IYON LED Spotlight Catalog," downloaded on Oct. 19, 2015 from http://www.zumtobel.com/PDB/Ressource/teaser/en/com/Iyon.pdf, 40pp.
"Lumenpulse—Lumenbeam Large Pendant Dynamic White," downloaded on May 28, 2014 from http://www.lumenpulse.com/en/product/72/lumenbeam-large-pendant-dynamic-white, 1p.
"Lumileds Application Brief AB08—Optical Testing for SuperFlux, SnapLED and Luxeon Emitters," downloaded on Sep. 24, 2014 from www.lumileds.com, 15pp.
"CandlePowerForums—SOLD: Luxeon III side-emitter white LED," downloaded on May 28, 2014 from http://www.candlepowerforums.com/vb/showthread.php?140276-SOLD-Luxeon-III-side-emitter-white-LED, 4pp.
"Lumileds Luxeon Z,", downloaded on May 2, 2015 from www.lumileds.com, 2pp.
"Alanod MIRO Catalog," downloaded on Jan. 30, 2015 from www.alanod.com, 8pp.
"Nanoco Group—Cadmium Free Quantum Dots," downloaded on May 30, 2014 from www.nanocotechnologies.com/what-we-do/products/cadmium-free-quantum-dots, 3pp.
"Nanosys—Quantum Dots," downloaded on May 30, 2014 from www.nanosysinc.com/what-we-do/quanturn-dots/, 3pp.
"Ocean NanoTech—Products," downloaded on May 30, 2014 from www.oceannanotech.com/Products.php, 1p.
"NNCrystal—blog post—May 17, 2010," downloaded from http://led-lights-led.blogspot.com/2010/05/nncrystal-us-corporation-to-supply.html, 4pp.
"A Warmer, Cozier White Light: NXP Transforms LED Color Quality," dated Jan. 9, 2013, downloaded from http://www.nxp.com/news/press-releases/2013/01/a-warmer-cozier-white-light-nxp-transforms-led-color-quality.html, 2pp.
"Lighting Global Technical Notes, Optical Control Techniques for Off-grid Lighting Products," Jul. 2011 and May 2012, 6pp.
"Pacific Light Technologies—Quantum Dots in Solid State Lighting," downloaded on Oct. 23, 2015 from www. pacificlighttech.com/quantum-dots-in-ssl/, 2pp.
"Philips Lighting—Dim Tone,", downloaded on May 27, 2014 from www.usa.lighting.philips.com/lightcommunity/trends/ed/dimtone/, 1p.
"Philips—Dimmable to warm light for the perfect ambience," downloaded on May 27, 2014 from www.usa.lighting.philips.com, 2pp.
"Philips—Turn up Ambience and Tone Down Energy Use with Philips BR30 DimTone," downloaded on May 27, 2014 from www.usa.lighting.philips.com, 11pp.
Wikipedia, "Planckian locus," downloaded on May 30, 2014 from www.wikipedia.org, 5pp.
Wikipedia, "Quantum dot,", downloaded on May 30, 2014 from http://en.wikipedia.org/wiki/Quantum_dot, 15pp.
"Phosphortech—Flexible Phosphor Sheet—RadiantFlex Datasheet," Aug. 2014, downloaded from www.phosphortech.com, 10pp.
Wikipedia, "Reflectivity,", downloaded on Jan. 22, 2015 from www.wikipedia.org, 3pp.
"Refraction by lenses," downloaded on Feb. 17, 2015 from www.physicsclassroom.com, 5pp.
"RTLED—White Paper: Binning and LED," downloaded on Oct. 13, 2014 from www.rtled.com, 3pp.
Near, Al, "Seeing Beyond CRI," LED Testing & Application, Nov. 2011, downloaded from www.ies.org/lda/hottopics/led/4.pdf, 2pp.
"Selux—Olivio luminaire," press release dated Mar. 26, 2014, downloaded from http://www.selux.com/be/en/news/press/press-detail/article/evolutionary-progress-the-olivio-family-of-system-luminaires-now-with-premium-quality-white-and.html, 3pp.
"LEDIL—Strada-F Series," downloaded on May 5, 2015 from www.ledil.com, 7pp.
"Sylvania—Ultra SE(tm) LED Lamp Family," downloaded on May 27, 2014 from www. sylvania.com, 3pp.
"Sylvania Ultra SE(tm) LED Light Bulbs with Color Dimming Sunset Effects," downloaded on May 27, 2014 from https://www.youtube.com/watch?v=oZEc-VfJ8EU, 2pp.
Wikipedia, "Transmittance," downloaded on Jan. 22, 2015 from www.wikipedia.org, 4pp.
"United Lumen—A Volumetric Displaced Phosphor Light Engine which elegantly and efficiently distributes light in a pattern similar to an incandescent bulb," downloaded on Jul. 9, 2014 from www.unitedlumen.com, 1p.
"United Lumen—Solid State Volumetric Technology," downloaded on Jul. 9, 2014 from www.unitedlumen.com, 1p.
"United Lumen—High Brightness V-LED Technology," downloaded on May 15, 2014 from www.unitedlumen.com, 1p.
"USAI Lighting Catalog," downloaded on May 27, 2014 from http://www.usaillumination.com/pdf/Warm_Glow_Dimming.pdf, 50pp.
"Winona—Parata 700 Series Cove," downloaded on May 28, 2014 from www.acuitybrands.com, 2pp.
"Winona Parata Catalog," downloaded on May 28, 2014 from www.acuitybrands.com, 24pp.
"Khatod—Symmetric & Asymmetric Strip Lens," downloaded on May 5, 2015 from www.khatod.com, 3pp.
"LEDIL—Strada-F Series," downloaded on May 5, 2015 from www.ledil.corn, 7pp.
Acuity Brands, "Acuity Brands Introduces Luminaire for Tunable White Technology," downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Acuity Brands Lighting Inc. Product Catalog, downloaded from www.acuitybrands.com, dated Apr. 2013, 90pp.
Acuity Brands, "A Guided Tour of Area Light Sources—Past, Present and Future," downloaded from www.acuitybrands.com, version dated Jun. 20, 2013, 72pp.
Alanod GmbH, "WhiteOptics," downloaded from www.alanod.com, dated Apr. 2014, 12pp.
Altman Lighting, "Spectra Cube," downloaded from http://altmanstagelighting.com/altman-led-green-lighting/led-spectra-cube/Altman-Spectra-Cube-Data-Sheet-v3.pdf on May 28, 2014, 1p.
Bega Lighting, "In-ground luminaire RGBW IP 67 Product data sheet," downloaded from http://www.bega.com/download/datenblaetter/en/7926.pdf on May 28, 2014, 1p.
CORM 2011 Conference, Gaithersburg, MD, "Calculation of CCT and Duv and Practical Conversion Formulae," dated May 3-5, 2011, National Institute of Standards and Technology, 28pp.
Lumitronix, "Carclo lens for side emitting 360 degrees," downloaded from http://www.leds.de/en/High-Power-LEDs/Lenses-and-optics/Carclo-lens-for-side-emitting-360.html on May 28, 2014, 2pp.
"Introduction to Catmull-Rom Splines," downloaded on Aug. 7, 2015 from www.mvps.org/directx/articles/catmull/, 2pp.
Wikipedia, "CIE 1931 color space," version dated Apr. 23, 2014, downloaded from www.wikipedia.org, 12pp.
Dsram Sylvania, "ColorCalculator User Guide", downloaded on Jun. 3, 2014 from www.sylvania.com, 44pp.

(56) References Cited

OTHER PUBLICATIONS

Osram Sylvania, "ColorCalculator User Guide", downloaded on Oct. 19, 2015 from www.sylvania.com, 50pp.
Kenneth Kelly, "Color Designations for Lights," U.S. Department of Commerce, National Bureau of Standards, Research Paper RP1565, Journal of Research of the National Bureau of Standards, vol. 31, Nov. 1943, pp. 271-278.
Philips Color Kinetics, "LED Cove Lighting," downloaded on May 28, 2014 from http://www.colorkinetics.com/ls/guides-brochures/pck-led-cove-lighting.pdf, 32pp.
Philips Color Kinetics, "IntelliWhite LED Lighting Systems," downloaded on May 28, 2014 from http://www.colorkinetics.com/ls/intelliwhite/, 2pp.
Philips Color Kinetics, "Color-Changing LED Lighting Systems," downloaded on May 27, 2014 from http://www.colorkinetics.com/ls/rgb/, 2pp.
Wikipedia, "Color temperature," version dated May 21, 2014, downloaded on Jun. 3, 2014 from www.wikipedia.org, 17pp.
Cree, "LED Color Mixing: Basics and Background," downloaded on Sep. 24, 2014 from www.cree.com, 24pp.
Cree, "Cree(r) LMH2 LED Modules," Product Family Data Sheet, downloaded on May 27, 2014 from http://www.cree.com/~/media/Files/Cree/LED%20Components%20and%20Modules/Modules/Data%20Sheets/LEDModules_LMH2.pdf, 18pp.
"Dialight ES Series RGB LED Luminaire," downloaded on May 28, 2014 from http://www.dialight.com/Assets/Brochures_And_Catalogs/Illumination/MDEXESTEMORGB_A.pdf, 2pp.
Naomi Miller, "Color Spaces and Planckian Loci: Understanding all those Crazy Color Metrics," U.S. Department of Energy, Pacific Northwest National Laboratory, Portland, Oregon, downloaded on May 30, 2014, 49pp.
Kahen, Keith, "High-Efficiency Colloidal Quantum Dot Phosphors," University at Buffalo, SUNY, DOE SSL R&D Workshop, Long Beach, California, Jan. 29-31, 2013, 12pp.
Bush, Steve, "Chip gives dim-to-warm LED lighting without MCU," dated Apr. 1, 2014, downloaded from http://www.electronicsweekly.com/news/components/led-lighting/chip-gives-dim-warm-led-righting-without-mcu-2014-04/, 6pp.
"Ecosense to reveal new TROV LED Linear Platform at 2015 Lightfair International in New York City," May 4, 2015, blog downloaded from www.ecosense.com, 3pp.
"Ecosense to reveal new TROV LED Linear Platform at 2015 Lightfair International in New York City," May 4, 2015, press release downloaded from www.ecosense.com, 2pp.
Freyssinier, Jean P. et al., "Class A Color Designation for Light Sources Used in General Illumination," J. Light & Vis. Env., vol. 37, Nos. 2-3, Nov. 7, 2013, pp. 10-14.
Freyssinier, Jean P. et al., "White Lighting: A Provisional Model for Predicting Perceived Tint in 'White' Illumination," Color Res. & App'n, vol. 39, No. 5, Oct. 2014, pp. 466-479.
Freyssinier, Jean P. et al., "The Class A Color Designation for Light Sources," Rensselaer Polytechnic Institute, 2013 DOE Solid-State Lighting R&D Workshop, Hilton Long Beach, California, Jan. 29-31, 2013, 26pp.
Freyssinier, Jean P. et al., "Class A Lighting," Rensselaer Polytechnic Institute, Strategies in Light 2012, 27 pp.
Freyssinier, Jean P. et al., "White Lighting," Color Res. & App'n, (volume unknown), Sep. 3, 2011, downloaded from http://www.lrc.rpi.edu/programs/solidstate/assist/pdf/SIL-2012_FreyssinierRea_WhiteLighting.pdf, 12pp.
Rea et al., "White lighting for residential applications," Lighting Res. Technol., Mar. 27, 2012, downloaded from www.sagepublications.com at http://lrt.sagepub.com/content/early/2012/03/27/1477153512442936, 15pp.
Oh, Jeong et al., "Full down-conversion of amber-emitting phosphor-converted light-emitting diodes with powder phosphors and a long-wave pass filter," Optics Express, vol. 18, No. 11, May 24, 2010, pp. 11063-11072.
"Microcellular Reflective Sheet MCPET," downloaded on Feb. 3, 2015 from www.furukawa.co.jp/foami, 6pp.
"Aculux—Black Body Dimming and Tunable White Responsive Technologies," downloaded on May 28, 2014 from http://www.junolightinggroup.com/literature/LIT-AX-LED-BBD-TW.pdf, 28pp.
"KKDC Catalog 2.0," downloaded on May 28, 2014 from http://www.kkdc.co.uk/media/kkdc-catalogue.pdf, 134pp.
"KKDC UK—Linear LED Lighting," downloaded from www.kkdc.co.uk/application/interior.php on Oct. 22, 2015, 5pp.
Overton, Gail, "LEDS: White LED comprises blue LED and inexpensive dye," LaserFocusWorld, Feb. 12, 2013, downloaded from http://www.laserfocusworld.com/articles/print/volume-49/issue-02/world-news/leds—white-led-comprises-blue-led-and-inexpensive-dye.html, 5pp.
"LEDIL TIR Lens Guide," downloaded from www.ledil.com on Jan. 22, 2015, 8pp.
"LED Linear—linear lighting solutions, product overview," downloaded on May 28, 2014 from http://www.led-linear.com/en/product-overview/system-catalogue/, 3pp.
"LEDnovation—BR30 Warm Dimming," downloaded on May 28, 2014 from www.lednovation.com/products/BR30_LED.asp, 2pp.
Wikipedia, "Lenticular lens," downloaded on Feb. 18, 2015 from www.wikipedia.org, 5pp.
"Lenticular Sheets," downloaded on Feb. 24, 2015 from www.lenticular-sheets.lpceurope.eu/, 2pp.
Unzner, Norbert, "Light Analysis in lighting technology," B&S Electronische Geralte GmbH, 2001, 14pp.
"Lightolier—Solid-State Lighting," downloaded on May 28, 2014 from http://www.lightolier.com/prospots/leds_solidstate.jsp, 1p.
Wikipedia, "Line of purples," downloaded on Oct. 20, 2015 from www.wikipedia.org, 2pp.
"Lumenbeam Catalog," downloaded on May 27, 2014 from 11_160_en_lumenpulse_lumenbeam_rgb_lbl_rgb_brochure.zip, 63pp.
"Lumenetix—Araya Technology," downloaded on May 28, 2014 from www.lumenetix.com/araya-technology, 3pp.
"Lumenpulse—Lumenbeam Large Color Changing,", downloaded on May 27, 2014 from www.lumenpulse.com/en/product/11/lumenbeam-large-color-changing, 4pp.
"Lumenpulse—Lumencove Family," downloaded on May 28, 2014 from http://www.lumenpulse.com/en/products#!3/0/0/0/0/0, 2pp.
Petluri et al., U.S. Appl. No. 14/526,504, filed Oct. 28, 2014, entitled "Lighting Systems Having Multiple Light Sources," 92pp.
Petluri et al., U.S. Appl. No. 14/636,204, filed Mar. 3, 2015, entitled "Lighting Systems Including Lens Modules for Selectable Light Distribution," 119pp.
Pickard et al., U.S. Appl. No. 14/617,849, filed Feb. 9, 2015, entitled "Lighting Systems Generating Controlled and Wavelength-Converted Light Emissions," 83pp.
Fletcher et al., U.S. Appl. No. 29/533,667, filed Jul. 20, 2015, entitled "LED Luminaire Having a Mounting System," 10pp.
Pickard et al., U.S. Appl. No. 14/636,205, filed Mar. 3, 2015, entitled "Low-Profile Lighting System Having Pivotable Lighting Enclosure," 56pp.
Fletcher et al., U.S. Appl. No. 14/702,765, filed May 4, 2015, entitled "Lighting System Having a Sealing System," 92pp.
Fletcher et al., U.S. Appl. No. 29/519,149, filed Mar. 3, 2015, entitled "LED Luminaire," 8pp.
Fletcher et al., U.S. Appl. No. 29/519,153, filed Mar. 3, 2015, entitled "LED Luminaire," 8pp.
Fletcher et al., U.S. Appl. No. 14/816,827, filed Aug. 3, 2015, entitled "Lighting System Having a Mounting Device," 126pp.
Rodgers et al., U.S. Appl. No. 62/202,936, filed Aug. 10, 2015, entitled "Optical Devices and Systems Having a Converging Lens With Grooves," 133pp.
Fletcher et al., U.S. Appl. No. 29/532,383, filed Jul. 6, 2015, entitled "LED Luminaire Having a Mounting System," 10pp.
Fletcher et al., U.S. Appl. No. 29/533,635, filed Jul. 20, 2015, entitled "LED Luminaire Having a Mounting System," 10pp.
Fletcher et al., U.S. Appl. No. 29/533,666, filed Jul. 20, 2015, entitled "LED Luminaire Having a Mounting System," 10pp.
PCT/US2007/023110, Journee Lighting Inc., International Preliminary Report on Patentability Dated Sep. 8, 2009.

(56) References Cited

OTHER PUBLICATIONS

PCT/US2009/035321, Journee Lighting Inc., International Preliminary Report on Patentability Dated Aug. 31, 2010.
PCT/US2009/064858, Journee Lighting Inc., International Preliminary Report on Patentability Dated May 24, 2011.
PCT/US2010/045361, Journee Lighting Inc., International Preliminary Report on Patentability Dated Feb. 14, 2012.
PCT/US2012/060588, Ecosense Lighting Inc., Filed on Oct. 17, 2012.
PCT/US2012/060588, Ecosense Lighting Inc., International Search Report and Opinion Dated Mar. 29, 2013.
PCT/US2012/060588, Ecosense Lighting Inc., International Preliminary Report on Patentability Dated Apr. 22, 2014.
PCT/US2013/045708, Journee Lighting Inc., International Search Report and Opinion Dated Nov. 27, 2013.
PCT/US2013/045708, Journee Lighting Inc., International Preliminary Report on Patentability Dated May 12, 2015.
PCT/US2013/075172, Ecosense Lighting Inc., Filed on Dec. 13, 2013.
PCT/US2013/075172, Ecosense Lighting Inc., International Search Report and Opinion Dated Sep. 26, 2014.
PCT/US2013/075172, Ecosense Lighting Inc., International Preliminary Report on Patentability Dated Jun. 23, 2015.
PCT/US2016/020521, Ecosense Lighting Inc., Filed on Mar. 2, 2016.
PCT/US2016/020521, Ecosense Lighting Inc., International Search Report and Opinion Dated May 3, 2016.
PCT/US2016/016972, Ecosense Lighting Inc., Filed on Feb. 8, 2016.
PCT/US2016/016972, Ecosense Lighting Inc., International Search Report and Opinion Dated Apr. 11, 2016.
PCT/US2016/030613, Ecosense Lighting Inc., Filed on May 3, 2016.
PCT/US2016/020523, Ecosense Lighting Inc., Filed on Mar. 2, 2016.
PCT/US2016/020523, Ecosense Lighting Inc., International Search Report and Opinion Dated May 6, 2016.
PCT/US2016/015470, Ecosense Lighting Inc., Filed on Jan. 28, 2016, Entitled "Zoned Optical Cup."
Petluri et al., U.S. Appl. No. 62/288,368, filed Jan. 28, 2016, entitled "Multizone Mixing Cup".
PCT/US2016/015473, Ecosense Lighting Inc., Filed on Jan. 28, 2016, Entitled "Illuminating With a Multizone Mixing Cup.".
PCT/US2016/015473, Ecosense Lighting Inc., International Search Report and Opinion Mailed on Apr. 22, 2016.
Petluri et al., U.S. Appl. No. 15/170,806, filed Jun. 1, 2016, entitled "Illuminating With a Multizone Mixing Cup."
PCT/US2016/015318, Ecosense Lighting Inc., Filed on Jan. 28 2016, Entitled "Compositions for LED Light Conversions.".
PCT/US2016/015318, Ecosense Lighting Inc., International Search Report and Opinion, Mailed on Apr. 11, 2016.
PCT/US2016/015348, Ecosense Lighting Inc., Filed on Jan. 28, 2016, Entitled "Systems for Providing Tunable White Light With High Color Rendering."
PCT/US2016/015348, Ecosense Lighting Inc., International Search Report and Opinion Mailed on Apr. 11, 2016.
PCT/US2016/015368, Ecosense Lighting Inc., Filed on Jan. 28, 2016, Entitled "Systems for Providing Tunable White Light With High Color Rendering."
PCT/US2016/015368, Ecosense Lighting Inc., International Search Report and Opinion Mailed on Apr. 19, 2016.
Petluri et al., U.S. Appl. No. 15/173,538 filed Jun. 3, 2016, entitled "System for Providing Tunable White Light With High Color Rendering."
Petluri et al., U.S. Appl. No. 15/173,554 filed Jun. 3, 2016, entitled "System for Providing Tunable White Light With High Color Rendering."
PCT/US2016/015385, Ecosense Lighting Inc., Filed on Jan. 28, 2016, Entitled "Methods for Generating Tunable White Light With High Color Rendering."
PCT/US2016/015402, Ecosense Lighting Inc., Filed on Jan. 28, 2016, Entitled "Methods for Generating Tunable White Light With High Color Rendering."
PCT/US2016/015435, Ecosense Lighting Inc., Filed on Jan. 28, 2016, Entitled "Methods for Generating Melatonin-Response-Tuned White Light With High Color Rendering."
PCT/US2016/015437, Ecosense Lighting Inc., Filed on Jan. 28, 2016, Entitled "Methods for Generating Melatonin-Response-Tuned White Light With High Color Rendering."
PCT/US2016/015441, Ecosense Lighting Inc., Filed on Jan. 28, 2016, Entitled "Methods for Generating Melatonin-Response-Tuned White Light With High Color Rendering."
Petluri et al., U.S. Appl. No. 15/176,083 filed Jun. 7, 2016, entitled "Compositions for LED Light Conversions."
PCT/US2016/030613, Ecosense Lighting Inc , International Search Report and Opinion Dated Aug. 5, 2016.
PCT/US2016/046245, Ecosense Lighting Inc., Filed on Aug. 10, 2016.
PCT/US2016/015470, Ecosense Lighting Inc., International Search Report and Opinion Dated Jul. 8, 2016.
PCT/US2016/015385, Ecosense Lighting Inc., International Search Report and Opinion Dated Apr. 8, 2016.
PCT/US2016/015402, Ecosense Lighting Inc., International Search Report and Opinion Dated Apr. 22, 2016.
PCT/US2016/015435, Ecosense Lighting Inc., International Search Report and Opinion Dated Mar. 31, 2016.
PCT/US2016/015437, Ecosense Lighting Inc., International Search Report and Opinion Dated Mar. 31, 2016.
PCT/US2016/015441, Ecosense Lighting Inc , International Search Report and Opinion Dated Mar. 31, 2016.

* cited by examiner

LIGHTING SYSTEMS INCLUDING ASYMMETRIC LENS MODULES FOR SELECTABLE LIGHT DISTRIBUTION

BACKGROUND OF THE INVENTION

1. Field of the Invention

The present invention relates to the field of lighting systems that include semiconductor light-emitting devices and lenses.

2. Background of the Invention

Numerous lighting systems that include semiconductor light-emitting devices and lenses have been developed. As examples, some of such lighting systems may include lenses for controlling directions of propagation of light emitted by the semiconductor light-emitting devices. Despite the existence of these lighting systems, further improvements are still needed in lighting systems that include semiconductor light-emitting devices and lenses.

SUMMARY

In an example of an implementation, a lighting system is provided that includes: a lighting module including a semiconductor light-emitting device ("SLED"); a first lens module; a second lens module; and a third lens module. In this example of the lighting system, the SLED is configured for emitting light emissions along a central light emission axis; and the first, second and third lens modules respectively have first, second and third lens axes. Further in this example of an implementation, the lighting system is configured: for detachably installing the first lens module or the second lens module in the lighting module between the semiconductor light-emitting device and the third lens module; and for aligning the first or second lens axis with the central light emission axis and the third lens axis. The first lens module in this example of the lighting system includes a first converging lens being configured for causing convergence of some of the light emissions of the semiconductor light-emitting device to form converged light emissions along the central light emission axis having a first half-width-half-maximum (HWHM), the first converging lens having a first light output surface being spaced apart along the first lens axis from a first light input surface, the first converging lens further having a first total internal reflection side surface being spaced apart around the first lens axis and having a first frusto-conical shape extending between the first light input and output surfaces of the first converging lens. The second lens module in this example of the lighting system includes a second converging lens being configured for causing convergence of some of the light emissions of the semiconductor light-emitting device to form converged light emissions along the central light emission axis having a second HWHM being different than the first HWHM, the second converging lens having a second light output surface being spaced apart along the second lens axis from a second light input surface, the second converging lens further having a second total internal reflection side surface being spaced apart around the second lens axis and having a second frusto-conical shape extending between the second light input and output surfaces of the second converging lens. The third lens module in this example of the lighting system includes a first diverging lens having a third lens axis, the first diverging lens being configured for causing divergence of some of the converged light emissions away from the third lens axis. In this example of the lighting system, the third lens module includes: a lens body having a light output surface spaced apart along a light transmission axis from a light input surface, the lens body having a longitudinal axis and a lateral axis, the longitudinal and lateral axes being transverse to the light transmission axis; the light output surface having an asymmetric curvilinear contour being formed by a convex region overlapping in directions along the lateral axis with a concave region, the asymmetric curvilinear contour uniformly extending in directions along the longitudinal axis.

In some examples of the lighting system, the light input surface of the third lens module may include an array of diverging lenses being configured for causing divergence of light away from the light transmission axis in directions along the longitudinal axis of the lens body.

In additional examples of the lighting system, the light input surface of the third lens module may have the array of diverging lenses as including a lens screen having lenticular or microprismatic features.

In further examples of the lighting system, the light input surface of the third lens module may have the lens screen as including an array of lenticular toroidal lenses.

In additional examples of the lighting system, the light input surface of the third lens module may have the array of lenticular toroidal lenses as including a plurality of convex regions being interposed between a plurality of concave regions, each of the pluralities of the convex regions and of the concave regions extending in directions along the lateral axis.

In other examples of the lighting system, the light output surface of the third lens module may include a first end being spaced apart along the lateral axis from a second end; and the asymmetric curvilinear contour may extend from the first end to the second end.

In some examples of the lighting system, the convex region of the asymmetric curvilinear contour of the third lens module may extend from the first end of the light output surface towards the light transmission axis.

In further examples of the lighting system, the concave region of the asymmetric curvilinear contour of the third lens module may extend from the second end of the light output surface towards the light transmission axis.

In additional examples of the lighting system, the light output surface of the third lens module may have a ridge extending in directions along the longitudinal axis and being located at a greatest distance, in directions along the light transmission axis, of the light output surface away from the light input surface.

In other examples of the lighting system, the ridge of the third lens module may be at a location, in directions along the lateral axis, being between the light transmission axis and the first end of the light output surface.

In some examples of the lighting system, a portion of the light output surface of the third lens module may extend for a distance in directions along the lateral axis from the first end to the light transmission axis, and the ridge may be on the portion of the light output surface at a location being at within a range of between about 30% and about 70% along the distance extending from the first end to the light transmission axis.

In further examples of the lighting system, a portion of the light output surface of the third lens module may extend for a distance in directions along the lateral axis from the first end to the light transmission axis, and the ridge may be on the portion of the light output surface at a location being at within a range of between about 40% and about 60% along the distance extending from the first end to the light transmission axis.

In additional examples of the lighting system, the convex region of the asymmetric curvilinear contour of the third lens module may have an angle of elevation at the first end of the light output surface from the lateral axis to the ridge, and the angle of elevation may be within a range of between about 30 degrees and about 40 degrees.

In other examples of the lighting system, the convex region of the asymmetric curvilinear contour of the third lens module may have an angle of elevation at the first end of the light output surface from the lateral axis to the ridge, and the angle of elevation may be within a range of between about 33 degrees and about 37 degrees.

In some examples of the lighting system, the convex region of the asymmetric curvilinear contour of the third lens module may have an angle of elevation at the first end of the light output surface from the lateral axis to the ridge, and the angle of elevation may be about 35 degrees.

In further examples of the lighting system, the asymmetric curvilinear contour of the light output surface of the third lens module may have an inflection point between the convex region and the concave region.

In other examples of the lighting system, the light output surface of the third lens module may extend for a distance in directions along the lateral axis from the first end to the second end, and the inflection point may be on the light output surface at a location being at within a range of between about 40% and about 60% along the distance extending from the first end to the second end.

In some examples, the lighting system may be configured for emitting light having a full width half maximum beam width being within a range of between about 7 degrees and about 30 degrees.

In further examples, the lighting system may be configured for emitting light having a full width half maximum beam width being within a range of between about 10 degrees and about 20 degrees.

In additional examples, the lighting system may be configured for emitting light as being distributed on a planar surface.

In other examples, the lighting system may be configured for causing a luminance of light reflected by the planar surface to have a ratio of maximum luminance divided by minimum luminance being about 4 or less.

In some examples, the lighting system may be configured for causing a luminance of light reflected by the planar surface to have a ratio of maximum luminance divided by minimum luminance being within a range of between about 4.0 and about 1.8.

In further examples, the lighting system may be configured for causing a luminance of light reflected by the planar surface to have a ratio of average luminance divided by minimum luminance being about 2 or less.

In additional examples, the lighting system may be configured for causing a luminance of light reflected by the planar surface to have a ratio of average luminance divided by minimum luminance being within a range of between about 2.1 and about 1.2.

In some examples, the lighting system may further include an additional lens module including an additional diverging lens having an additional lens axis, the additional diverging lens being configured for causing divergence of some of the converged light emissions away from the additional lens axis by an additional HWHM being different than the third HWHM to form additional diverged light emissions that diverge away from the central light emission axis, the additional diverging lens having an additional light output surface being spaced apart along the additional lens axis from an additional light input surface, the additional light input surface including an additional lens screen having lenticular or microprismatic features; and the lighting system may be configured for detachably installing the first lens module or the second lens module in the lighting module between the semiconductor light-emitting device and the additional lens module; and the lighting system may be configured for aligning the first or second lens axis with the central light emission axis and the additional lens axis.

In further examples, the lighting system may be configured for interchangeably installing either the first lens module or the second lens module in the lighting module between the semiconductor light-emitting device and either the third lens module or the additional lens module.

In additional examples of the lighting system, the lighting module may include another semiconductor light-emitting device being configured for emitting light emissions along the central light emission axis.

In other examples of the lighting system, the lighting module may include a plurality of additional semiconductor light-emitting devices, and the semiconductor light-emitting device and the plurality of the additional semiconductor light-emitting devices may be collectively arranged around and configured for emitting light emissions along the central light emission axis.

In some examples of the lighting system, the first converging lens may be configured for causing convergence of some of the light emissions of the semiconductor light-emitting device to form the converged light emissions as having the first HWHM being about 3.5 degrees, and the first light input surface of the first converging lens may include a central cavity being shaped as a portion of a spheroid, and the first light output surface of the first converging lens may include a bowl-shaped cavity surrounding a central mound shaped as a portion of a spheroid.

In further examples of the lighting system, the first converging lens may be configured for causing convergence of some of the light emissions of the semiconductor light-emitting device to form the converged light emissions as having the first HWHM being about 7.5 degrees, and the first light input surface of the first converging lens may include a central cavity being shaped as a portion of a spheroid, and the first light output surface of the first converging lens may include a bowl-shaped cavity surrounding a central mound shaped as a portion of a spheroid.

In additional examples of the lighting system, the first converging lens may be configured for causing convergence of some of the light emissions of the semiconductor light-emitting device to form the converged light emissions as having the first HWHM being about 12.5 degrees, and the first light input surface of the first converging lens may include a central disk-shaped cavity, and the first light output surface of the first converging lens may include a bowl-shaped cavity surrounding a central mound shaped as a portion of a spheroid.

In other examples of the lighting system, the first converging lens may be configured for causing convergence of some of the light emissions of the semiconductor light-emitting device to form the converged light emissions as having the first HWHM being about 20 degrees, and the first light input surface of the first converging lens may include a central compound parabolic concentrator, and the first light output surface of the first converging lens may include a bowl-shaped cavity surrounding a central flat region.

In some examples of the lighting system, the first diverging lens may be configured for causing divergence of some of the converged light emissions away from the third lens axis by a third HWHM being about 4 degrees.

In further examples of the lighting system, the first diverging lens may be configured for causing divergence of some of the converged light emissions away from the third lens axis by a third HWHM being about 10 degrees.

In additional examples of the lighting system, the first diverging lens may be configured for causing divergence of some of the converged light emissions away from the third lens axis by a third HWHM being about 15 degrees.

In other examples of the lighting system, the first diverging lens may be configured for causing divergence of some of the converged light emissions away from the third lens axis by a third HWHM being about 25 degrees.

In some examples of the lighting system, the first diverging lens may be configured for causing divergence of some of the converged light emissions away from the third lens axis by a third HWHM being about 30 degrees.

In further examples of the lighting system, the first diverging lens may have the first lens screen as including an array of lenticular toroidal lenses.

In other examples of the lighting system, the first converging lens may have a first diameter transverse to the first lens axis at the first light input surface, and the first converging lens may have a second diameter transverse to the first lens axis at the first light output surface, and the first diameter may be smaller than the second diameter.

In some examples, the lighting system may further include a housing being configured for positioning the lighting module for emission of the light emissions from the semiconductor light-emitting device along the central light emission axis.

In further examples, the lighting system may further include a carrier being configured for positioning the first or second lens module in the housing with the first or second lens axis being aligned with the central light emission axis.

In other examples, the lighting system may further include a primary visible light reflector configured for being positioned between the housing and the carrier, and the primary visible light reflector may be configured for redirecting some of the light emissions of the semiconductor light-emitting device along the central light emission axis.

In some examples, the lighting system may include: a second lighting module; and fourth, fifth, and sixth lens modules. The second lighting module may include a second semiconductor light-emitting device configured for emitting further light emissions along a second central light emission axis. The fourth lens module may include a third converging lens, the third converging lens being configured for causing convergence of some of the light emissions of the second semiconductor light-emitting device to form further converged light emissions along the second central light emission axis having a fourth HWHM, the third converging lens having a fourth light output surface being spaced apart along a fourth lens axis from a fourth light input surface, the third converging lens further having a third total internal reflection side surface being spaced apart around the fourth lens axis and having a third frusto-conical shape extending between the fourth light input and output surfaces of the third converging lens. The fifth lens module may include a fourth converging lens, the fourth converging lens being configured for causing convergence of some of the light emissions of the second semiconductor light-emitting device to form further converged light emissions along the second central light emission axis having a fifth HWHM being different than the fourth HWHM, the fourth converging lens having a fifth light output surface being spaced apart along a fifth lens axis from a fifth light input surface, the fourth converging lens further having a fourth total internal reflection side surface being spaced apart around the fifth lens axis and having a fourth frusto-conical shape extending between the fifth light input and output surfaces of the fourth converging lens. The sixth lens module may include: a lens body having a light output surface spaced apart along a light transmission axis from a light input surface, the lens body having a longitudinal axis and a lateral axis, the longitudinal and lateral axes being transverse to the light transmission axis; the light output surface having an asymmetric curvilinear contour being formed by a convex region overlapping in directions along the lateral axis with a concave region, the asymmetric curvilinear contour uniformly extending in directions along the longitudinal axis. The lighting system may be configured for detachably installing the fourth lens module or the fifth lens module in the second lighting module between the second semiconductor light-emitting device and the sixth lens module; and the lighting system may be configured for aligning the fourth or fifth lens axis with the second central light emission axis and the sixth lens axis.

In some examples of the lighting system, the light input surface of the sixth lighting module may include an array of diverging lenses being configured for causing divergence of light away from the light transmission axis in directions along the longitudinal axis of the lens body.

In further examples of the lighting system, the second lighting module may include another semiconductor light-emitting device being configured for emitting light emissions along the second central light emission axis.

In additional examples of the lighting system, the second lighting module may include a plurality of additional semiconductor light-emitting devices, and the second semiconductor light-emitting device and the plurality of the additional semiconductor light-emitting devices may be collectively arranged around and configured for emitting light emissions along the second central light emission axis.

In other examples of the lighting system, the third converging lens may be configured for causing convergence of some of the light emissions of the second semiconductor light-emitting device to form the further converged light emissions as having the fourth HWHM being about 3.5 degrees, and the fourth light input surface of the third converging lens may include a second central cavity being shaped as a portion of a spheroid, and the fourth light output surface of the third converging lens may include a second bowl-shaped cavity surrounding a second central mound shaped as a portion of a spheroid.

In some examples of the lighting system, the third converging lens may be configured for causing convergence of some of the light emissions of the second semiconductor light-emitting device to form the further converged light emissions as having the fourth HWHM being about 7.5 degrees, and the fourth light input surface of the third converging lens may include a second central cavity being shaped as a portion of a spheroid, and the fourth light output surface of the third converging lens may include a second bowl-shaped cavity surrounding a second central mound shaped as a portion of a spheroid.

In further examples of the lighting system, the third converging lens may be configured for causing convergence of some of the light emissions of the second semiconductor light-emitting device to form the further converged light emissions as having the fourth HWHM being about 12.5 degrees, and the fourth light input surface of the third converging lens may include a second central disk-shaped cavity, and the fourth light output surface of the third converging lens may include a second bowl-shaped cavity surrounding a second central mound shaped as a portion of a spheroid.

In additional examples of the lighting system, the third converging lens may be configured for causing convergence of some of the light emissions of the second semiconductor light-emitting device to form the further converged light emissions as having the fourth HWHM being about 20 degrees, and the fourth light input surface of the third converging lens may include a second central compound parabolic concentrator, and the fourth light output surface of the third converging lens may include a second bowl-shaped cavity surrounding a second central flat region.

In other examples of the lighting system, the third converging lens may have a third diameter transverse to the fourth lens axis at the fourth light input surface, and the third converging lens may have a fourth diameter transverse to the fourth lens axis at the fourth light output surface, and the fourth diameter may be smaller than the fifth diameter.

In some examples of the lighting system, the second diverging lens may have the second screen as including an array of lenticular toroidal lenses.

In further examples, the lighting system may be configured for positioning the semiconductor light-emitting device as being spaced apart on a longitudinal axis away from the second semiconductor light-emitting device for causing the central light emission axis to be spaced apart from the second central light emission axis.

In additional examples, the lighting system may be configured for positioning the semiconductor light-emitting device as being spaced apart on the longitudinal axis away from the second semiconductor light-emitting device for causing the central light emission axis to be substantially parallel with the second central light emission axis.

In other examples, the lighting system may further include a housing, the housing may be configured for positioning the lighting module for emission of the light emissions from the semiconductor light-emitting device along the central light emission axis, and the housing may be configured for positioning the second lighting module for emission of the further light emissions from the second semiconductor light-emitting device along the second central light emission axis.

In some examples, the lighting system may further include a carrier, the carrier may be configured for positioning the first or second lens module in the housing with the first or second lens axis being aligned with the central light emission axis, and the carrier may be configured for positioning the fourth or fifth lens module in the housing with the fourth or fifth lens axis being aligned with the second central light emission axis.

In further examples, the lighting system may further include a primary visible light reflector configured for being positioned between the housing and the carrier, the primary visible light reflector may be configured for redirecting some of the light emissions of the semiconductor light-emitting device along the central light emission axis, and the primary visible light reflector may be configured for redirecting some of the further light emissions of the second semiconductor light-emitting device along the second central light emission axis.

In some examples, the lighting system may be configured for interchangeably installing either: the first lens module in the lighting module and the fourth lens module in the second lighting module; or the second lens module in the lighting module and the fifth lens module in the second lighting module.

In further examples of the lighting system, the first lens module may be integral with the fourth lens module, and the second lens module may be integral with the fifth lens module.

In additional examples, the lighting system may further include a seventh lens module that may include a third diverging lens having a seventh lens axis, the third diverging lens being configured for causing divergence of some of the converged light emissions away from the seventh lens axis by a seventh HWHM, being different than the third HWHM, to form additional diverged light emissions, the third diverging lens having a seventh light output surface being spaced apart along the seventh lens axis from a seventh light input surface, the seventh light input surface including a third lens screen having lenticular or microprismatic features; and the lighting system may be configured for detachably installing the first lens module or the second lens module in the lighting module between the semiconductor light-emitting device and the seventh lens module; and the lighting system may be configured for aligning the first or second lens axis with the central light emission axis and the seventh lens axis.

In other examples, the lighting system may include an eighth lens module that may include a fourth diverging lens having an eighth lens axis, the fourth diverging lens being configured for causing divergence of some of the further converged light emissions away from the eighth lens axis by an eighth HWHM, being different than the sixth HWHM, to form additional diverged light emissions, the fourth diverging lens having an eighth light output surface being spaced apart along the eighth lens axis from an eighth light input surface, the eighth light input surface including a fourth lens screen having lenticular or microprismatic features; and the lighting system may be configured for detachably installing the fourth lens module or the fifth lens module in the second lighting module between the second semiconductor light-emitting device and the eighth lens module; and the lighting system may be configured for aligning the fourth or fifth lens axis with the second central light emission axis and the eighth lens axis.

In some examples, the lighting system may be configured for interchangeably installing either: the third lens module in the lighting module and the sixth lens module in the second lighting module; or the seventh lens module in the lighting module and the eighth lens module in the second lighting module.

In further examples of the lighting system, the third lens module may be integral with the sixth lens module, and the seventh lens module may be integral with the eighth lens module.

In other examples of the lighting system, the third HWHM may be the same as the sixth HWHM, and the seventh HWHM may be the same as the eighth HWHM.

In some examples, the lighting system may be configured for interchangeably installing either: the first lens module in the lighting module and the fourth lens module in the second lighting module; or the second lens module in the lighting module and the fifth lens module in the second lighting module.

In further examples of the lighting system, the first lens module may be integral with the fourth lens module, and the second lens module may be integral with the fifth lens module.

In other examples of the lighting system, the first diverging lens may be integral with the second diverging lens, and the lighting system may be configured for positioning the semiconductor light-emitting device as being spaced apart on a longitudinal axis away from the second semiconductor light-emitting device, and the first and second diverging lenses may be integrally configured for causing divergence of some of the converged light emissions in directions that are spaced apart from directions along the longitudinal axis.

In some examples of the lighting system, each of the first and second diverging lenses may be configured for causing divergence of some of the converged light emissions in directions that are spaced apart from directions along the longitudinal axis by an HWHM being about 4 degrees.

In further examples of the lighting system, each of the first and second diverging lenses may be configured for causing divergence of some of the converged light emissions in directions that are spaced apart from directions along the longitudinal axis by an HWHM being about 10 degrees.

In other examples of the lighting system, each of the first and second diverging lenses may be configured for causing divergence of some of the converged light emissions in directions that are spaced apart from directions along the longitudinal axis by an HWHM being about 15 degrees.

In some examples of the lighting system, each of the first and second diverging lenses may be configured for causing divergence of some of the converged light emissions in directions that are spaced apart from directions along the longitudinal axis by an HWHM being about 25 degrees.

In further examples of the lighting system, each of the first and second diverging lenses may be configured for causing divergence of some of the converged light emissions in directions that are spaced apart from directions along the longitudinal axis by an HWHM being about 30 degrees.

In additional examples of the lighting system, the first, second, third and fourth converging lenses may be configured for forming the converged light emissions as respectively having the first, second, fourth, and fifth HWHM being within a range of between about 2 degrees and about 5 degrees; and the first and second diverging lenses may be configured for causing divergence of some of the converged light emissions away from the central light emission axes in directions that are spaced apart from directions along the longitudinal axis by an HWHM being within a range of between about 2 degrees and about 6 degrees.

In further examples of the lighting system, the diverged light emissions may have a cumulative HWHM away from the central light emission axes in directions that are spaced apart from directions along the longitudinal axis being within a range of between about 4 degrees and about 11 degrees.

In additional examples of the lighting system, the first, second, third and fourth converging lenses may be configured for forming the converged light emissions as respectively having the first, second, fourth, and fifth HWHM being within a range of between about 15 degrees and about 25 degrees; and the first and second diverging lenses may be configured for causing divergence of some of the converged light emissions away from the central light emission axes in directions that are spaced apart from directions along the longitudinal axis by an HWHM being within a range of between about 25 degrees and about 35 degrees.

In other examples of the lighting system, the diverged light emissions may have a cumulative HWHM away from the central light emission axes in directions that are spaced apart from directions along the longitudinal axis being within a range of between about 40 degrees and about 60 degrees.

In some examples of the lighting system, the first, second, third and fourth converging lenses may be configured for forming the converged light emissions as respectively having the first, second, fourth, and fifth HWHM being within a range of between about 15 degrees and about 25 degrees; and the first and second diverging lenses may be configured for causing divergence of some of the converged light emissions away from the central light emission axes in directions that are spaced apart from directions along the longitudinal axis by an HWHM being within a range of between about 2 degrees and about 6 degrees.

In further examples of the lighting system, the diverged light emissions may have a cumulative HWHM away from the central light emission axes in directions that are spaced apart from directions along the longitudinal axis being within a range of between about 17 degrees and about 31 degrees.

In additional examples of the lighting system, the first, second, third and fourth converging lenses may be configured for forming the converged light emissions as respectively having the first, second, fourth, and fifth HWHM being within a range of between about 2 degrees and about 5 degrees; and the first and second diverging lenses may be configured for causing divergence of some of the converged light emissions away from the central light emission axes in directions that are spaced apart from directions along the longitudinal axis by an HWHM being within a range of between about 25 degrees and about 35 degrees.

In other examples of the lighting system, the diverged light emissions may have a cumulative HWHM away from the central light emission axes in directions that are spaced apart from directions along the longitudinal axis being within a range of between about 27 degrees and about 40 degrees.

In additional examples of the lighting system, the first diverging lens may be integral with the second diverging lens, and the lighting system may be configured for positioning the semiconductor light-emitting device as being spaced apart on a longitudinal axis away from the second semiconductor light-emitting device, and the first and second diverging lenses may be integrally configured for causing divergence of some of the converged light emissions in directions that are spaced apart from directions transverse to the longitudinal axis.

In other examples of the lighting system, each of the first and second diverging lenses may be configured for causing divergence of some of the converged light emissions in directions that are spaced apart from directions transverse to the longitudinal axis by an HWHM being about 4 degrees.

In some examples of the lighting system, each of the first and second diverging lenses may be configured for causing divergence of some of the converged light emissions in directions that are spaced apart from directions transverse to the longitudinal axis by an HWHM being about 10 degrees.

In further examples of the lighting system, each of the first and second diverging lenses may be configured for causing divergence of some of the converged light emissions in directions that are spaced apart from directions transverse to the longitudinal axis by an HWHM being about 15 degrees.

In additional examples of the lighting system, each of the first and second diverging lenses may be configured for causing divergence of some of the converged light emissions in directions that are spaced apart from directions transverse to the longitudinal axis by an HWHM being about 25 degrees.

In other examples of the lighting system, each of the first and second diverging lenses may be configured for causing divergence of some of the converged light emissions in directions that are spaced apart from directions transverse to the longitudinal axis by an HWHM being about 30 degrees.

In some examples of the lighting system, the third converging lens may be configured for forming the converged light emissions as having the fourth HWHM being within a range of between about 2 degrees and about 25 degrees, and the fourth converging lens may be configured for forming the further converged light emissions as having the fifth HWHM being within a range of between about 2 degrees and about 25 degrees, and each of the first and second diverging lenses may be configured for causing divergence of some of the converged light emissions in directions that are spaced apart from directions transverse to the longitudinal axis by an HWHM being within a range of between about 4 degrees and about 30 degrees.

In further examples of the lighting system, the diverged light emissions may have a cumulative HWHM away from the central light emission axes in directions that are spaced apart from directions transverse to the longitudinal axis being within a range of between about 6 degrees and about 55 degrees.

In some examples, the lighting system may further include a ninth lens module that may include a fifth diverging lens, the fifth diverging lens having a ninth light output surface being spaced apart along a ninth lens axis from a ninth light input surface, the fifth diverging lens having a fifth total internal reflection side surface being spaced apart around the ninth lens axis and having a fifth frusto-conical shape extending between the ninth light input and output surfaces of the fifth diverging lens; and the ninth light input surface of the fifth diverging lens may include a third central cavity being shaped as a portion of a spheroid; and the ninth light output surface of the fifth diverging lens may include a first raised region being shaped as a sliced torus having a fourth central cavity; and the lighting system may be configured for detachably installing the ninth lens module in the lighting module between the semiconductor light-emitting device and the third lens module; and the lighting system may be configured for aligning the ninth lens axis with the central light emission axis and the third lens axis.

In further examples of the lighting system, the first raised region of the fifth diverging lens that may be shaped as a sliced torus may be configured for causing some of the converged light emissions to pass through the third light output surface at a plurality of spaced-apart points.

In additional examples, the lighting system may further include a tenth lens module that may include a sixth diverging lens, the sixth diverging lens having a tenth light output surface being spaced apart along a tenth lens axis from a tenth light input surface, the sixth diverging lens having a sixth total internal reflection side surface being spaced apart around the tenth lens axis and having a sixth frusto-conical shape extending between the tenth light input and output surfaces of the sixth diverging lens; and the tenth light input surface of the sixth diverging lens may include a fifth central cavity being shaped as a portion of a spheroid; and the tenth light output surface of the sixth diverging lens may include a second raised region being shaped as a sliced torus having a sixth central cavity; and the lighting system may be configured for detachably installing the tenth lens module in the second lighting module between the second semiconductor light-emitting device and the sixth lens module; and the lighting system may be configured for aligning the tenth lens axis with the second central light emission axis and the sixth lens axis.

In other examples of the lighting system, the second raised region of the sixth diverging lens that may be shaped as a sliced torus may be configured for causing some of the further converged light emissions to pass through the sixth light output surface at a plurality of spaced-apart points.

In some examples, the lighting system may be configured for positioning the semiconductor light-emitting device as being spaced apart on a longitudinal axis away from the second semiconductor light-emitting device for causing the central light emission axis to be spaced apart from the second central light emission axis.

In further examples of the lighting system, the fifth diverging lens may be integral with the sixth diverging lens, and the fifth and sixth diverging lenses may be integrally configured for causing some of the converged light emissions to pass through the third and sixth light output surfaces at a plurality of spaced-apart points.

In additional examples of the lighting system, the first diverging lens, the second diverging lens, the fifth diverging lens, and the sixth diverging lens may be collectively configured for causing the third and sixth light output surfaces to emit a perceived line of light.

In other examples, the lighting system may further include another lens module having another diverging lens, the another diverging lens having one lens axis being spaced apart from another lens axis, the lighting system being configured for detachably installing the another diverging lens with the one lens axis being aligned with the central light emission axis and with the another lens axis being aligned with the second central light emission axis, the another diverging lens having another total internal reflection side surface extending between another light input surface and another light output surface, the another light output surface may include a contoured lens screen having lenticular or microprismatic features.

In some examples of the lighting system, the another diverging lens may have the contoured lens screen as including an array of lenticular toroidal lenses.

In further examples of the lighting system, the another light input surface may include one cavity aligned with the one lens axis and shaped as a portion of a spheroid, and the another light input surface may include another cavity aligned with the another lens axis and shaped as a portion of a spheroid.

In additional examples, the lighting system may be configured for positioning the semiconductor light-emitting device as being spaced apart on a longitudinal axis away from the second semiconductor light-emitting device for causing the central light emission axis to be spaced apart from the second central light emission axis.

In other examples of the lighting system, the contoured lens screen may have a central concave surface having a lens screen axis that extends in directions being similar to and spaced apart from the longitudinal axis.

In some examples of the lighting system, the lens screen axis may intersect the one lens axis and the another lens axis.

In further examples of the lighting system, the contoured lens screen may have one convex surface extending in directions along the lens screen axis, and one edge of the central concave region may extend adjacent to the one convex surface in directions along the lens screen axis.

In other examples of the lighting system, the contoured lens screen may have another convex surface extending in directions along the lens screen axis, and another edge of the central concave region may extend adjacent to the another convex surface in directions along the lens screen axis.

In some examples of the lighting system, the contoured lens screen may be configured for causing divergence of some of the converged light emissions away from the lens screen axis.

In further examples of the lighting system, the another lens module may be configured for causing some of the light emissions to pass through the contoured lens screen at a plurality of spaced-apart points.

In additional examples of the lighting system, the first diverging lens, the second diverging lens, and the another diverging lens may be collectively configured for causing the third and sixth light output surfaces to emit a perceived line of light.

In other examples, the lighting system may further include a housing, and the housing may be configured for positioning the lighting module for emission of the light emissions from the semiconductor light-emitting device along the central light emission axis, and the housing may be configured for positioning the second lighting module for emission of the further light emissions from the second semiconductor light-emitting device along the second central light emission axis.

In some examples, the lighting system may further include a carrier, and the carrier may be configured for positioning the another lens module in the housing with the one lens axis being aligned with the central light emission axis and with the another lens axis being aligned with the second central light emission axis.

In further examples, the lighting system may further include a primary visible light reflector configured for being positioned between the housing and the carrier, and the primary visible light reflector may be configured for redirecting some of the light emissions of the semiconductor light-emitting device along the central light emission axis, and the primary visible light reflector may be configured for redirecting some of the further light emissions of the second semiconductor light-emitting device along the second central light emission axis.

In another example of an implementation, a lighting system is provided that includes: a lighting module; a first lens module; a second lens module; and a third lens module. In this example of the lighting system, the lighting module may include a semiconductor light-emitting device configured for emitting light emissions along a first central light emission axis, and may include a second semiconductor light-emitting device configured for emitting light emissions along a second central light emission axis being spaced apart from the first central light emission axis. In this example of the lighting system, the first lens module may include a first diverging lens being configured for causing divergence of some of the light emissions away from the first central light emission axis, the first diverging lens having a first light output surface being spaced apart along a first lens axis from a first light input surface, the first diverging lens having a first total internal reflection side surface being spaced apart around the first lens axis and having a first frusto-conical shape extending between the first light input and output surfaces, and the first light input surface may include a first central cavity being shaped as a portion of a spheroid, and the first light output surface may include a first raised region being shaped as a sliced torus having a second central cavity. Also in this example of the lighting system, the second lens module may include a second diverging lens being configured for causing divergence of some of the light emissions away from the second central light emission axis, the second diverging lens having a second light output surface being spaced apart along a second lens axis from a second light input surface, the second diverging lens having a second total internal reflection side surface being spaced apart around the second lens axis and having a second frusto-conical shape extending between the second light input and output surfaces, and the second light input surface may include a third central cavity being shaped as a portion of a spheroid, and the second light output surface may include a second raised region being shaped as a sliced torus having a fourth central cavity. In this example of the lighting system, the third lens module may include a third diverging lens being configured for causing further divergence of some of the light emissions away from the first and second central light emission axes, the third diverging lens having a third light output surface being spaced apart from a third light input surface, and the third light input surface may include a first lens screen having lenticular or microprismatic features. In this example, the lighting system may be configured for aligning the first and second lens modules between the third lens module and the lighting module, with first lens axis being aligned with the first central light emission axis and with the second lens axis being aligned with the second central light emission axis.

In some examples of the lighting system, the raised regions of the first and second diverging lenses may be configured for causing some of the light emissions to pass through the third light output surface at a plurality of spaced-apart points.

In further examples of the lighting system, the first diverging lens may be integral with the second diverging lens.

In additional examples of the lighting system, the first, second and third diverging lenses may be collectively configured for causing the third light output surface to emit a perceived line of light.

In other examples of the lighting system the first diverging lens may have the contoured lens screen as including an array of lenticular toroidal lenses.

In some examples, the lighting system may be configured for positioning the semiconductor light-emitting device as being spaced apart on a longitudinal axis away from the second semiconductor light-emitting device for causing the central light emission axis to be spaced apart from the second central light emission axis.

In further examples, the lighting system may further include a housing, and the housing may be configured for positioning the lighting module for emission of the light emissions from the semiconductor light-emitting device along the central light emission axis, and the housing may be configured for positioning the second lighting module for emission of the further light emissions from the second semiconductor light-emitting device along the second central light emission axis.

In additional examples, the lighting system may further include a carrier, and the carrier may be configured for positioning the first lens module in the housing with the one lens axis being aligned with the central light emission axis, and may be configured for positioning the second lens module in the housing with the another lens axis being aligned with the second central light emission axis.

In other examples, the lighting system may further include a primary visible light reflector configured for being positioned between the housing and the carrier, and the primary visible light reflector may be configured for redirecting some of the light emissions of the semiconductor light-emitting device along the central light emission axis, and the primary visible light reflector may be configured for redirecting some of the further light emissions of the second semiconductor light-emitting device along the second central light emission axis.

In a further example of an implementation, a lighting system is provided that includes: a lighting module; a first lens module; and a second lens module. In this example of the lighting system, the lighting module may include a semiconductor light-emitting device configured for emitting light emissions along a first central light emission axis, and may include a second semiconductor light-emitting device configured for emitting light emissions along a second central light emission axis being spaced apart from the first central light emission axis. In this example of the lighting system, the first lens module may have a first diverging lens being configured for causing divergence of some of the light emissions away from the first and second central light emission axes, the first diverging lens having one lens axis being aligned with the central light emission axis and another lens axis being aligned with the second central light emission axis, the first diverging lens having a total internal reflection side surface extending between a first light input surface and a first light output surface, and the first light output surface may include a contoured lens screen having lenticular or microprismatic features. In this example of the lighting system, the second lens module may include a second diverging lens being configured for causing further divergence of some of the light emissions away from the first and second central light emission axes, the second diverging lens having a second light output surface being spaced apart from a second light input surface, the second light input surface may include a first lens screen having lenticular or microprismatic features. In this example, the lighting system may be configured for aligning the first lens module between the second lens module and the lighting module, with first lens axis being aligned with the first central light emission axis and with the second lens axis being aligned with the second central light emission axis.

In some examples of the lighting system, the first diverging lens may have the contoured lens screen as including an array of lenticular toroidal lenses.

In further examples of the lighting system, the first light input surface may include one cavity aligned with the one lens axis and shaped as a portion of a spheroid, and the first light input surface may include another cavity aligned with the another lens axis and shaped as a portion of a spheroid.

In additional examples, the lighting system may be configured for positioning the semiconductor light-emitting device as being spaced apart on a longitudinal axis away from the second semiconductor light-emitting device for causing the central light emission axis to be spaced apart from the second central light emission axis.

In other examples of the lighting system, the contoured lens screen may have a central concave surface having a lens screen axis that extends in directions being similar to and spaced apart from the longitudinal axis.

In some examples of the lighting system, the lens screen axis may intersect the one lens axis and the another lens axis.

In further examples of the lighting system, the contoured lens screen may have one convex surface extending in directions along the lens screen axis, and one edge of the central concave region may extend adjacent to the one convex surface in directions along the lens screen axis.

In additional examples of the lighting system, the contoured lens screen may have another convex surface extending in directions along the lens screen axis, and another edge of the central concave region may extend adjacent to the another convex surface in directions along the lens screen axis.

In other examples of the lighting system, the contoured lens screen may be configured for causing further divergence of some of the light emissions away from the lens screen axis.

In some examples of the lighting system, the another lens module may be configured for causing some of the light emissions to pass through the contoured lens screen at a plurality of spaced-apart points.

In further examples of the lighting system, the first diverging lens and the second diverging lens may be collectively configured for causing the second light output surface to emit a perceived line of light.

In additional examples, the lighting system may further include a housing, and the housing may be configured for positioning the lighting module for emission of the light emissions from the semiconductor light-emitting device along the central light emission axis, and the housing may be configured for positioning the second lighting module for emission of the further light emissions from the second semiconductor light-emitting device along the second central light emission axis.

In other examples, the lighting system may further include a carrier, and the carrier may be configured for positioning the first lens module in the housing with the one lens axis being aligned with the central light emission axis and with the another lens axis being aligned with the second central light emission axis.

In some examples, the lighting system may further include a primary visible light reflector configured for being positioned between the housing and the carrier, and the primary visible light reflector may be configured for redirecting some of the light emissions of the semiconductor light-emitting device along the central light emission axis, and the primary visible light reflector may be configured for redirecting some of the further light emissions of the second semiconductor light-emitting device along the second central light emission axis.

In another example of an implementation, a lens device is provided that includes: a lens body having a light output surface spaced apart along a light transmission axis from a light input surface, the lens body having a longitudinal axis and a lateral axis, the longitudinal and lateral axes being transverse to the light transmission axis. The light output surface of the lens device has an asymmetric curvilinear contour being formed by a convex region overlapping in directions along the lateral axis with a concave region, the asymmetric curvilinear contour uniformly extending in directions along the longitudinal axis. In the lens device, the light input surface may include an array of diverging lenses being configured for causing divergence of light away from the light transmission axis in directions along the longitudinal axis of the lens body.

In some examples of the lens device, the light input surface may have the array of diverging lenses as including a lens screen having lenticular or microprismatic features.

In additional examples of the lens device, the light input surface of the third lens module may have the array of diverging lenses as including a lens screen having lenticular or microprismatic features.

In further examples of the lens device, the light input surface of the third lens module may have the lens screen as including an array of lenticular toroidal lenses.

In additional examples of the lens device, the light input surface of the third lens module may have the array of lenticular toroidal lenses as including a plurality of convex regions being interposed between a plurality of concave regions, each of the pluralities of the convex regions and of the concave regions extending in directions along the lateral axis.

In other examples of the lens device, the light output surface of the third lens module may include a first end being spaced apart along the lateral axis from a second end; and the asymmetric curvilinear contour may extend from the first end to the second end.

In some examples of the lens device, the convex region of the asymmetric curvilinear contour of the third lens module may extend from the first end of the light output surface towards the light transmission axis.

In further examples of the lens device, the concave region of the asymmetric curvilinear contour of the third lens module may extend from the second end of the light output surface towards the light transmission axis.

In additional examples of the lens device, the light output surface of the third lens module may have a ridge extending in directions along the longitudinal axis and being located at a greatest distance, in directions along the light transmission axis, of the light output surface away from the light input surface.

In other examples of the lens device, the ridge of the third lens module may be at a location, in directions along the lateral axis, being between the light transmission axis and the first end of the light output surface.

In some examples of the lens device, a portion of the light output surface of the third lens module may extend for a distance in directions along the lateral axis from the first end to the light transmission axis, and the ridge may be on the portion of the light output surface at a location being at within a range of between about 30% and about 70% along the distance extending from the first end to the light transmission axis.

In further examples of the lens device, a portion of the light output surface of the third lens module may extend for a distance in directions along the lateral axis from the first end to the light transmission axis, and the ridge may be on the portion of the light output surface at a location being at within a range of between about 40% and about 60% along the distance extending from the first end to the light transmission axis.

In additional examples of the lens device, the convex region of the asymmetric curvilinear contour of the third lens module may have an angle of elevation at the first end of the light output surface from the lateral axis to the ridge, and the angle of elevation may be within a range of between about 30 degrees and about 40 degrees.

In other examples of the lens device, the convex region of the asymmetric curvilinear contour of the third lens module may have an angle of elevation at the first end of the light output surface from the lateral axis to the ridge, and the angle of elevation may be within a range of between about 33 degrees and about 37 degrees.

In some examples of the lens device, the convex region of the asymmetric curvilinear contour of the third lens module may have an angle of elevation at the first end of the light output surface from the lateral axis to the ridge, and the angle of elevation may be about 35 degrees.

In further examples of the lens device, the asymmetric curvilinear contour of the light output surface of the third lens module may have an inflection point between the convex region and the concave region.

In other examples of the lens device, the light output surface of the third lens module may extend for a distance in directions along the lateral axis from the first end to the second end, and the inflection point may be on the light output surface at a location being at within a range of between about 40% and about 60% along the distance extending from the first end to the second end.

In some examples, the lens device may be configured for emitting light having a full width half maximum beam width being within a range of between about 7 degrees and about 30 degrees.

In further examples, the lens device may be configured for emitting light having a full width half maximum beam width being within a range of between about 10 degrees and about 20 degrees.

In additional examples, the lens device may be configured for emitting light as being distributed on a planar surface.

In other examples, the lens device may be configured for causing a luminance of light reflected by the planar surface to have a ratio of maximum luminance divided by minimum luminance being about 4 or less.

In some examples, the lens device may be configured for causing a luminance of light reflected by the planar surface to have a ratio of maximum luminance divided by minimum luminance being within a range of between about 4.0 and about 1.8.

In further examples, the lens device may be configured for causing a luminance of light reflected by the planar surface to have a ratio of average luminance divided by minimum luminance being about 2 or less.

In additional examples, the lens device may be configured for causing a luminance of light reflected by the planar surface to have a ratio of average luminance divided by minimum luminance being within a range of between about 2.1 and about 1.2.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
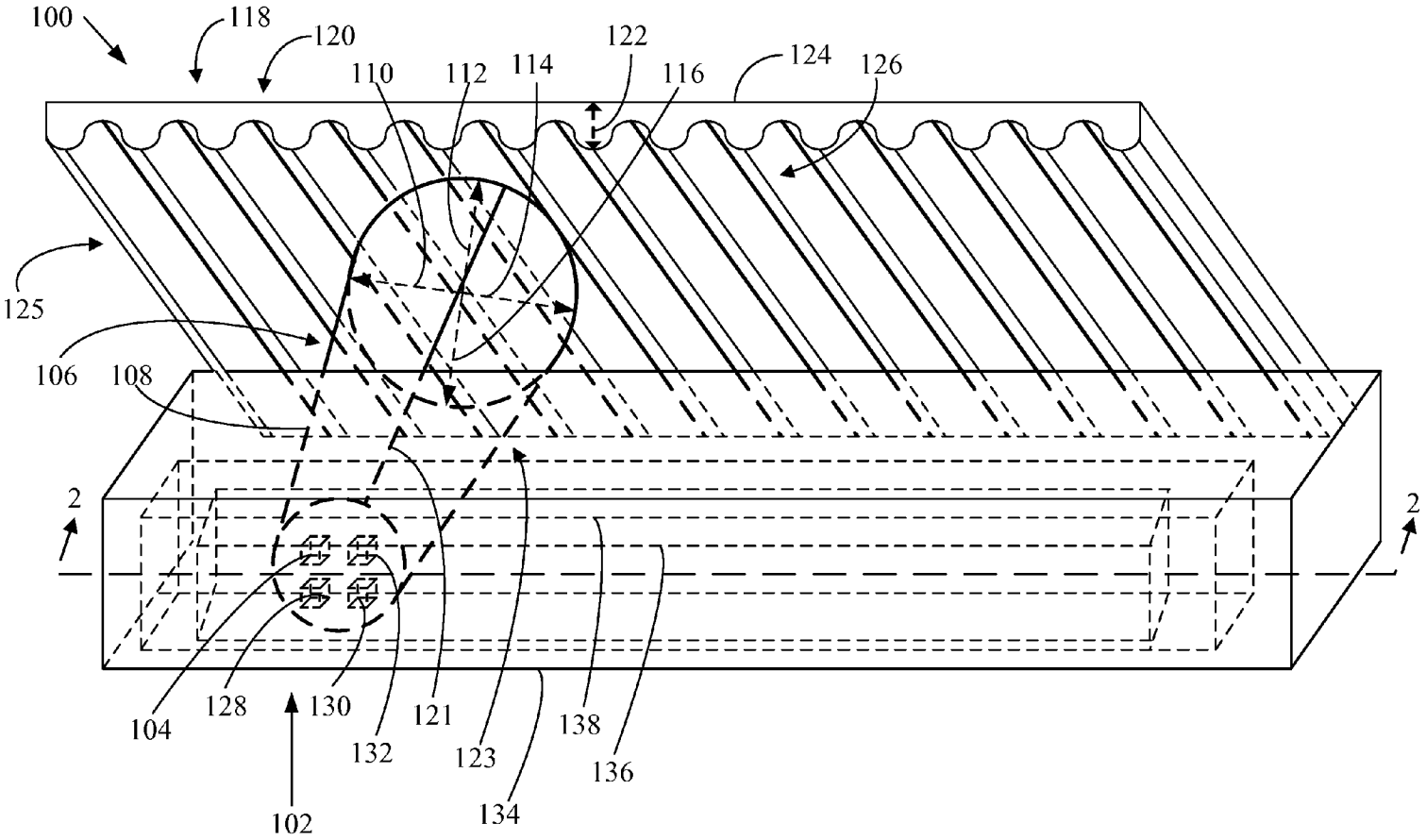
FIG. 1 is a perspective bottom view showing a portion of an example [100] of an implementation of a lighting system.

Various lighting systems that utilize semiconductor light-emitting devices have been designed. Many such lighting systems exist that include lenses for controlling directions of propagation of light emissions from the semiconductor light-emitting devices. However, existing lighting systems often have demonstrably failed to provide interchangeable lens modules enabling a lighting system to be easily and repeatedly reconfigured by removal and substitution of lens modules. Further, existing lighting systems often have demonstrably failed to provide lens modules enabling a lighting system to emit a perceived line of light.

In some examples, lighting systems accordingly are provided herein, that may include: a lighting module including a semiconductor light-emitting device ("SLED"); a first lens module; a second lens module; and a third lens module. The SLED may be configured for emitting light emissions along a central light emission axis; and the first, second and third lens modules may respectively have first, second and third lens axes. The lighting system may be configured: for detachably installing the first lens module or the second lens module in the lighting module between the semiconductor light-emitting device and the third lens module; and for aligning the first or second lens axis with the central light emission axis and the third lens axis. The first and second lens modules may respectively include first and second converging lenses being configured for causing convergence of some of the light emissions of the semiconductor light-emitting device to form converged light emissions along the central light emission axis having a half-width-half-maximum (HWHM). The first and second converging lenses may respectively have first and second light output surfaces being spaced apart along the first and second lens axes from first and second light input surfaces. The first and second converging lenses may further respectively have first and second total internal reflection side surfaces being spaced apart around the first and second lens axes and having first and second frusto-conical shapes extending between the first and second light input and output surfaces. The third lens module may include a first diverging lens, having a third lens axis and being configured for causing divergence of some of the converged light emissions away from the third lens axis by another HWHM to form diverged light emissions. The first diverging lens may have a third light output surface being spaced apart along the third lens axis from a third light input surface; and the third light input surface may include a first lens screen having lenticular or microprismatic features. In further examples, the lighting system may include a second lighting module including a second SLED configured for emitting further light emissions along a second central light emission axis, and may include fourth, fifth and sixth lens modules respectively corresponding with the first, second and third lens modules. As additional examples, the lighting system may be configured for interchangeably installing either: the first lens module in the lighting module and the fourth lens module in the second lighting module; or the second lens module in the lighting module and the fifth lens module in the second lighting module. Further, for example, the first lens module may be integral with the fourth lens module; the second lens module may be integral with the fifth lens module; and the third lens module may be integral with the sixth lens module.

In further examples, lighting systems are accordingly provided herein, that may include: a lighting module; a first lens module; a second lens module; and a third lens module. In these examples of the lighting system, the lighting module may include a semiconductor light-emitting device configured for emitting light emissions along a first central light emission axis, and may include a second semiconductor light-emitting device configured for emitting light emissions along a second central light emission axis being spaced apart from the first central light emission axis. In these examples of the lighting system, the first lens module may include a first diverging lens being configured for causing divergence of some of the light emissions away from the first central light emission axis, the first diverging lens having a first light output surface being spaced apart along a first lens axis from a first light input surface, the first diverging lens having a first total internal reflection side surface being spaced apart around the first lens axis and having a first frusto-conical shape extending between the first light input and output surfaces, and the first light input surface may include a first central cavity being shaped as a portion of a spheroid, and the first light output surface may include a first raised region being shaped as a sliced torus having a second central cavity. Also in these examples of the lighting system, the second lens module may include a second diverging lens being configured for causing divergence of some of the light emissions away from the second central light emission axis, the second diverging lens having a second light output surface being spaced apart along a second lens axis from a second light input surface, the second diverging lens having a second total internal reflection side surface being spaced apart around the second lens axis and having a second frusto-conical shape extending between the second light input and output surfaces, and the second light input surface may include a third central cavity being shaped as a portion of a spheroid, and the second light output surface may include a second raised region being shaped as a sliced torus having a fourth central cavity. In these examples of the lighting system, the third lens module may include a third diverging lens being configured for causing further divergence of some of the light emissions away from the first and second central light emission axes, the third diverging lens having a third light output surface being spaced apart from a third light input surface, and the third light input surface may include a first lens screen having lenticular or microprismatic features. In these examples, the lighting system may be configured for aligning the first and second lens modules between the third lens module and the lighting module, with first lens axis being aligned with the first central light emission axis and with the second lens axis being aligned with the second central light emission axis. In additional examples, the first lens module may have a first diverging lens being configured for causing divergence of some of the light emissions away from the first and second central light emission axes, the first diverging lens having one lens axis being aligned with the central light emission axis and another lens axis being aligned with the second central light emission axis, the first diverging lens having a total internal reflection side surface extending between a first light input surface and a first light output surface, and the first light output surface may include a contoured lens screen having lenticular or microprismatic features.

The following definitions of terms, being stated as applying "throughout this specification", are hereby deemed to be incorporated throughout this specification, including but not limited to the Summary, Brief Description of the Figures, Detailed Description, and Claims.

Throughout this specification, the term "semiconductor" means: a substance, examples including a solid chemical element or compound, that can conduct electricity under some conditions but not others, making the substance a good medium for the control of electrical current.

Throughout this specification, the term "semiconductor light-emitting device" (also being abbreviated as "SLED") means: a light-emitting diode; an organic light-emitting diode; a laser diode; or any other light-emitting device having one or more layers containing inorganic and/or organic semiconductor(s). Throughout this specification, the term "light-emitting diode" (herein also referred to as an "LED") means: a two-lead semiconductor light source having an active pn-junction. As examples, an LED may include a series of semiconductor layers that may be epitaxially grown on a substrate such as, for example, a substrate that includes sapphire, silicon, silicon carbide, gallium nitride or gallium arsenide. Further, for example, one or more semiconductor p-n junctions may be formed in these epitaxial layers. When a sufficient voltage is applied across the p-n junction, for example, electrons in the n-type semiconductor layers and holes in the p-type semiconductor layers may flow toward the p-n junction. As the electrons and holes flow toward each other, some of the electrons may recombine with corresponding holes, and emit photons. The energy release is called electroluminescence, and the color of the light, which corresponds to the energy of the photons, is determined by the energy band gap of the semiconductor. As examples, a spectral power distribution of the light generated by an LED may generally depend on the particular semiconductor materials used and on the structure of the thin epitaxial layers that make up the "active region" of the device, being the area where the light is generated. As examples, an LED may have a light-emissive electroluminescent layer including an inorganic semiconductor, such as a Group III-V semiconductor, examples including: gallium nitride; silicon; silicon carbide; and zinc oxide. Throughout this specification, the term "organic light-emitting diode" (herein also referred to as an "OLED") means: an LED having a light-emissive electroluminescent layer including an organic semiconductor, such as small organic molecules or an organic polymer. It is understood throughout this specification that a semiconductor light-emitting device may include: a non-semiconductor-substrate or a semiconductor-substrate; and may include one or more electrically-conductive contact layers. Further, it is understood throughout this specification that an LED may include a substrate formed of materials such as, for example: silicon carbide; sapphire; gallium nitride; or silicon. It is additionally understood throughout this specification that a semiconductor light-emitting device may have a cathode contact on one side and an anode contact on an opposite side, or may alternatively have both contacts on the same side of the device.

Further background information regarding semiconductor light-emitting devices is provided in the following documents, the entireties of all of which hereby are incorporated by reference herein: U.S. Pat. Nos. 7,564,180; 7,456,499; 7,213,940; 7,095,056; 6,958,497; 6,853,010; 6,791,119; 6,600,175; 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862; and 4,918,497; and U.S. Patent Application Publication Nos. 2014/0225511; 2014/0078715; 2013/0241392; 2009/0184616; 2009/0080185; 2009/0050908; 2009/0050907; 2008/0308825; 2008/0198112; 2008/0179611; 2008/0173884; 2008/0121921; 2008/0012036; 2007/0253209; 2007/0223219; 2007/0170447; 2007/0158668; 2007/0139923; and 2006/0221272.

Throughout this specification, the term "spectral power distribution" means: the emission spectrum of the one or more wavelengths of light emitted by a semiconductor light-emitting device. Throughout this specification, the term "peak wavelength" means: the wavelength where the spectral power distribution of a semiconductor light-emitting device reaches its maximum value as detected by a photo-detector. As an example, an LED may be a source of nearly monochromatic light and may appear to emit light having a single color. Thus, the spectral power distribution of the light emitted by such an LED may be centered about its peak wavelength. As examples, the "width" of the spectral power distribution of an LED may be within a range of between about 10 nanometers and about 30 nanometers, where the width is measured at half the maximum illumination on each side of the emission spectrum. Throughout this specification, the term "full-width-half-maximum" ("FWHM") means: the full width of the spectral power distribution of a semiconductor light-emitting device measured at half the maximum illumination on each side of its emission spectrum. Throughout this specification, the term "half-width-half-maximum" ("HWHM") means: half of the full width of a FWHM. Throughout this specification, the term "dominant wavelength" means: the wavelength of monochromatic light that has the same apparent color as the light emitted by a semiconductor light-emitting device, as perceived by the human eye. As an example, since the human eye perceives yellow and green light better than red and blue light, and because the light emitted by a semiconductor light-emitting device may extend across a range of wavelengths, the color perceived (i.e., the dominant wavelength) may differ from the peak wavelength.

Throughout this specification, the term "luminous flux", also referred to as "luminous power", means: the measure in lumens of the perceived power of light, being adjusted to reflect the varying sensitivity of the human eye to different wavelengths of light. Throughout this specification, the term "radiant flux" means: the measure of the total power of electromagnetic radiation without being so adjusted. Throughout this specification, the term "central light emission axis" means a direction along which the light emissions of a semiconductor light-emitting device have a greatest radiant flux. It is understood throughout this specification that light emissions "along a central light emission axis" means light emissions that: include light emissions in the directions of the central light emission axis; and may further include light emissions in a plurality of other generally similar directions.

It is understood throughout this specification that light emissions "along the longitudinal axis" means light emissions that: include light emissions in the directions of the longitudinal axis; and may further include light emissions in a plurality of other generally similar directions. It is understood throughout this specification that light emissions "in directions transverse to the longitudinal axis" means light emissions that: include light emissions in the directions being orthogonal to the longitudinal axis; and may further include light emissions in a plurality of other generally similar directions. It is understood throughout this specification that light emissions "in directions spaced apart from directions along the longitudinal axis" means light emissions in directions being similar to and spaced apart from the directions along the longitudinal axis. It is understood throughout this specification that light emissions "in directions spaced apart from directions transverse to the longitudinal axis" means light emissions in directions being similar to and spaced apart from the directions being transverse to the longitudinal axis.

Throughout this specification, the term "luminescent" means: characterized by absorption of electromagnetic radiation (e.g., visible light, UV light or infrared light) causing the emission of light by, as examples: fluorescence; and phosphorescence.

Throughout this specification, the term "object" means a material article or device. Throughout this specification, the term "surface" means an exterior boundary of an object. Throughout this specification, the term "incident visible light" means visible light that propagates in one or more directions towards a surface. Throughout this specification, the term "reflective surface" means a surface of an object that causes incident visible light, upon reaching the surface, to then propagate in one or more different directions away from the surface without passing through the object. Throughout this specification, the term "planar reflective surface" means a generally flat reflective surface.

Throughout this specification, the term "reflectance" means a fraction of a radiant flux of incident visible light having a specified wavelength that is caused by a reflective surface of an object to propagate in one or more different directions away from the surface without passing through the object. Throughout this specification, the term "reflected light" means the incident visible light that is caused by a reflective surface to propagate in one or more different directions away from the surface without passing through the object. Throughout this specification, the term "Lambertian reflectance" means diffuse reflectance of visible light from a surface, in which the reflected light has uniform radiant flux in all of the propagation directions. Throughout this specification, the term "specular reflectance" means mirror-like reflection of visible light from a surface, in which light from a single incident direction is reflected into a single propagation direction. Throughout this specification, the term "spectrum of reflectance values" means a spectrum of values of fractions of radiant flux of incident visible light, the values corresponding to a spectrum of wavelength values of visible light, that are caused by a reflective surface to propagate in one or more different directions away from the surface without passing through the object. Throughout this specification, the term "transmittance" means a fraction of a radiant flux of incident visible light having a specified wavelength that is permitted by a reflective surface to pass through the object having the reflective surface. Throughout this specification, the term "transmitted light" means the incident visible light that is permitted by a reflective surface to pass through the object having the reflective surface. Throughout this specification, the term "spectrum of transmittance values" means a spectrum of values of fractions of radiant flux of incident visible light, the values corresponding to a spectrum of wavelength values of visible light, that are permitted by a reflective surface to pass through the object having the reflective surface. Throughout this specification, the term "absorbance" means a fraction of a radiant flux of incident visible light having a specified wavelength that is permitted by a reflective surface to pass through the reflective surface and is absorbed by the object having the reflective surface. Throughout this specification, the term "spectrum of absorbance values" means a spectrum of values of fractions of radiant flux of incident visible light, the values corresponding to a spectrum of wavelength values of visible light, that are permitted by a reflective surface to pass through the reflective surface and are absorbed by the object having the reflective surface. Throughout this specification, it is understood that a reflective surface, or an object, may have a spectrum of reflectance values, and a spectrum of transmittance values, and a spectrum of absorbance values. The spectra of reflectance values, absorbance values, and transmittance values of a reflective surface or of an object may be measured, for example, utilizing an ultraviolet-visible-near infrared (UV-VIS-NIR) spectrophotometer. Throughout this specification, the term "visible light reflector" means an object having a reflective surface. In examples, a visible light reflector may be selected as having a reflective surface characterized by light reflections that are more Lambertian than specular.

Throughout this specification, the term "lumiphor" means: a medium that includes one or more luminescent materials being positioned to absorb light that is emitted at a first spectral power distribution by a semiconductor light-emitting device, and to re-emit light at a second spectral power distribution in the visible or ultra violet spectrum being different than the first spectral power distribution, regardless of the delay between absorption and re-emission. Lumiphors may be categorized as being down-converting, i.e., a material that converts photons to a lower energy level (longer wavelength); or up-converting, i.e., a material that converts photons to a higher energy level (shorter wavelength). As examples, a luminescent material may include: a phosphor; a quantum dot; a quantum wire; a quantum well; a photonic nanocrystal; a semiconducting nanoparticle; a scintillator; a lumiphoric ink; a lumiphoric organic dye; a day glow tape; a phosphorescent material; or a fluorescent material. Throughout this specification, the term "quantum material" means any luminescent material that includes: a quantum dot; a quantum wire; or a quantum well. Some quantum materials may absorb and emit light at spectral power distributions having narrow wavelength ranges, for example, wavelength ranges having spectral widths being within ranges of between about 25 nanometers and about 50 nanometers. In examples, two or more different quantum materials may be included in a lumiphor, such that each of the quantum materials may have a spectral power distribution for light emissions that may not overlap with a spectral power distribution for light absorption of any of the one or more other quantum materials. In these examples, cross-absorption of light emissions among the quantum materials of the lumiphor may be minimized. As examples, a lumiphor may include one or more layers or bodies that may contain one or more luminescent materials that each may be: (1) coated or sprayed directly onto an semiconductor light-emitting device; (2) coated or sprayed onto surfaces of a lens or other elements of packaging for an semiconductor light-emitting device; (3) dispersed in a matrix medium; or (4) included within a clear encapsulant (e.g., an epoxy-based or silicone-based curable resin or glass or ceramic) that may be positioned on or over an semiconductor light-emitting device. A lumiphor may include one or multiple types of luminescent materials. Other materials may also be included with a lumiphor such as, for example, fillers, diffusants, colorants, or other materials that may as examples improve the performance of or reduce the overall cost of the lumiphor. In examples where multiple types of luminescent materials may be included in a lumiphor, such materials may, as examples, be mixed together in a single layer or deposited sequentially in successive layers.

Throughout this specification, the term "volumetric lumiphor" means a lumiphor being distributed in an object having a shape including defined exterior surfaces. In some examples, a volumetric lumiphor may be formed by dispersing a lumiphor in a volume of a matrix medium having suitable spectra of visible light transmittance values and visible light absorbance values. As examples, such spectra may be affected by a thickness of the volume of the matrix medium, and by a concentration of the lumiphor being distributed in the volume of the matrix medium. In examples, the matrix medium may have a composition that includes polymers or oligomers of: a polycarbonate; a silicone; an acrylic; a glass; a polystyrene; or a polyester such as polyethylene terephthalate. Throughout this specification, the term "remotely-located lumiphor" means a lumiphor being spaced apart at a distance from and positioned to receive light that is emitted by a semiconductor light-emitting device.

Throughout this specification, the term "light-scattering particles" means small particles formed of a non-luminescent, non-wavelength-converting material. In some examples, a volumetric lumiphor may include light-scattering particles being dispersed in the volume of the matrix medium for causing some of the light emissions having the first spectral power distribution to be scattered within the volumetric lumiphor. As an example, causing some of the light emissions to be so scattered within the matrix medium may cause the luminescent materials in the volumetric lumiphor to absorb more of the light emissions having the first spectral power distribution. In examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In examples, light-scattering particles may have particle sizes being within a range of about 0.01 micron (10 nanometers) and about 2.0 microns (2,000 nanometers).

In some examples, a visible light reflector may be formed by dispersing light-scattering particles having a first index of refraction in a volume of a matrix medium having a second index of refraction being suitably different from the first index of refraction for causing the volume of the matrix medium with the dispersed light-scattering particles to have suitable spectra of reflectance values, transmittance values, and absorbance values for functioning as a visible light reflector. As examples, such spectra may be affected by a thickness of the volume of the matrix medium, and by a concentration of the light-scattering particles being distributed in the volume of the matrix medium, and by physical characteristics of the light-scattering particles such as the particle sizes and shapes, and smoothness or roughness of exterior surfaces of the particles. In an example, the smaller the difference between the first and second indices of refraction, the more light-scattering particles may need to be dispersed in the volume of the matrix medium to achieve a given amount of light-scattering. As examples, the matrix medium for forming a visible light reflector may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In other examples, a visible light reflector may include a reflective polymeric or metallized surface formed on a visible light-transmissive polymeric or metallic object such as, for example, a volume of a matrix medium. Additional examples of visible light reflectors may include microcellular foamed polyethylene terephthalate sheets ("MCPET"). Suitable visible light reflectors may be commercially available under the trade names White Optics® and MIRO® from WhiteOptics LLC, 243-G Quigley Blvd., New Castle, Del. 19720 USA. Suitable MCPET visible light reflectors may be commercially available from the Furukawa Electric Co., Ltd., Foamed Products Division, Tokyo, Japan. Additional suitable visible light reflectors may be commercially available from CVI Laser Optics, 200 Dorado Place SE, Albuquerque, N. Mex. 87123 USA.

In some examples, a converging or diverging lens may be formed as a volume of a matrix medium having a suitable shape for functioning as a lens. In further examples, forming a diverging lens may include dispersing light-scattering particles having a first index of refraction in a volume of a matrix medium having a second index of refraction being suitably different from the first index of refraction for causing the volume of the matrix medium with the dispersed light-scattering particles to have suitable light-scattering value for functioning as a diverging lens. As examples, the matrix medium for forming a lens may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate.

In further examples, a volumetric lumiphor and a visible light reflector may be integrally formed. As examples, a volumetric lumiphor and a visible light reflector may be integrally formed in respective layers of a volume of a matrix medium, including a layer of the matrix medium having a dispersed lumiphor, and including another layer of the same or a different matrix medium having light-scattering particles being suitably dispersed for causing the another layer to have suitable spectra of reflectance values, transmittance values, and absorbance values for functioning as the visible light reflector. In other examples, an integrally-formed volumetric lumiphor and visible light reflector may incorporate any of the further examples of variations discussed above as to separately-formed volumetric lumiphors and visible light reflectors.

Throughout this specification, the term "phosphor" means: a material that exhibits luminescence when struck by photons. Examples of phosphors that may be utilized include: $CaAlSiN_3$:Eu, $SrAlSiN_3$:Eu, $CaAlSiN_3$:Eu, $Ba_3Si_6O_{12}N_2$:Eu, $Ba_2SiO_4$:Eu, $Sr_2SiO_4$:Eu, $Ca_2SiO_4$:Eu, $Ca_3Sc_2Si_3O_{12}$:Ce, $Ca_3Mg_2Si_3O_{12}$:Ce, $CaSc_2O_4$:Ce, $CaSi_2O_2N_2$:Eu, $SrSi_2O_2N_2$:Eu, $BaSi_2O_2N_2$:Eu, $Ca_5(PO_4)_3$Cl:Eu, $Ba_5(PO_4)_3$Cl:Eu, $Cs_2CaP_2O_7$, $Cs_2SrP_2O_7$, $SrGa_2S_4$:Eu, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Al_5O_{12}$:Ce, $Y_3Ga_5O_{12}$:Ce, $Gd_3Al_5O_{12}$:Ce, $Gd_3Ga_5O_{12}$:Ce, $Tb_3Al_5O_{12}$:Ce, $Tb_3Ga_5O_{12}$:Ce, $Lu_3Ga_5O_{12}$:Ce, (SrCa)$AlSiN_3$:Eu, LuAG:Ce, $(Y,Gd)_2Al_5)_{12}$:Ce, CaS:Eu, SrS:Eu, $SrGa_2S_4$:$E_4$, $Ca_2(Sc,Mg)_2SiO_{12}$:Ce, $Ca_2Sc_2Si_2)_{12}$:C2, $Ca_2Sc_2O_4$:Ce, $Ba_2Si_6O_{12}N_2$:Eu, (Sr,Ca)$AlSiN_2$:Eu, and $CaAlSiN_2$:Eu.

Throughout this specification, the term "quantum dot" means: a nanocrystal made of semiconductor materials that are small enough to exhibit quantum mechanical properties, such that its excitons are confined in all three spatial dimensions.

Throughout this specification, the term "quantum wire" means: an electrically conducting wire in which quantum effects influence the transport properties.

Throughout this specification, the term "quantum well" means: a thin layer that can confine (quasi-)particles (typically electrons or holes) in the dimension perpendicular to the layer surface, whereas the movement in the other dimensions is not restricted.

Throughout this specification, the term "photonic nanocrystal" means: a periodic optical nanostructure that affects the motion of photons, for one, two, or three dimensions, in much the same way that ionic lattices affect electrons in solids.

Throughout this specification, the term "semiconducting nanoparticle" means: a particle having a dimension within a range of between about 1 nanometer and about 100 nanometers, being formed of a semiconductor.

Throughout this specification, the term "scintillator" means: a material that fluoresces when struck by photons.

Throughout this specification, the term "lumiphoric ink" means: a liquid composition containing a luminescent material. For example, a lumiphoric ink composition may contain semiconductor nanoparticles. Examples of lumiphoric ink compositions that may be utilized are disclosed in Cao et al., U.S. Patent Application Publication No. 20130221489 published on Aug. 29, 2013, the entirety of which hereby is incorporated herein by reference.

Throughout this specification, the term "lumiphoric organic dye" means an organic dye having luminescent up-converting or down-converting activity. As an example, some perylene-based dyes may be suitable.

Throughout this specification, the term "day glow tape" means: a tape material containing a luminescent material.

Throughout this specification, the term "visible light" means light having one or more wavelengths being within a range of between about 380 nanometers and about 670 nanometers; and "visible light spectrum" means the range of wavelengths of between about 380 nanometers and about 670 nanometers.

Throughout this specification, the term "white light" means: light having a color point located at a delta(uv) of about equal to or less than 0.006 and having a CCT being within a range of between about 10000K and about 1800K (herein referred to as a "white color point."). Many different hues of light may be perceived as being "white." For example, some "white" light, such as light generated by a tungsten filament incandescent lighting device, may appear yellowish in color, while other "white" light, such as light generated by some fluorescent lighting devices, may appear more bluish in color. As examples, white light having a CCT of about 3000K may appear yellowish in color, while white light having a CCT of about equal to or greater than 8000K may appear more bluish in color and may be referred to as "cool" white light. Further, white light having a CCT of between about 2500K and about 4500K may appear reddish or yellowish in color and may be referred to as "warm" white light. "White light" includes light having a spectral power distribution of wavelengths including red, green and blue color points. In an example, a CCT of a lumiphor may be tuned by selecting one or more particular luminescent materials to be included in the lumiphor. For example, light emissions from a semiconductor light-emitting device that includes three separate emitters respectively having red, green and blue color points with an appropriate spectral power distribution may have a white color point. As another example, light perceived as being "white" may be produced by mixing light emissions from a semiconductor light-emitting device having a blue, greenish-blue or purplish-blue color point together with light emissions having a yellow color point being produced by passing some of the light emissions having the blue, greenish-blue or purplish-blue color point through a lumiphor to down-convert them into light emissions having the yellow color point. General background information on systems and processes for generating light perceived as being "white" is provided in "Class A Color Designation for Light Sources Used in General Illumination", Freyssinier and Rea, *J. Light & Vis. Env.*, Vol. 37, No. 2 & 3 (Nov. 7, 2013, Illuminating Engineering Institute of Japan), pp. 10-14; the entirety of which hereby is incorporated herein by reference.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects (including the first and second objects), and each of the plurality of objects is in direct contact with at least one other of the plurality of objects (e.g., the first and second objects are in a stack and are separated by one or more intervening layers). Throughout this specification, the term "in direct contact with" means: that the first object, which is "in direct contact" with a second object, is touching the second object and there are no intervening objects between at least portions of both the first and second objects.

Throughout this specification, the term "spectrophotometer" means: an apparatus that can measure a light beam's intensity as a function of its wavelength and calculate its total luminous flux.

Throughout this specification, the term "integrating sphere—spectrophotometer" means: a spectrophotometer operationally connected with an integrating sphere. An integrating sphere (also known as an Ulbricht sphere) is an optical component having a hollow spherical cavity with its interior covered with a diffuse white reflective coating, with small holes for entrance and exit ports. Its relevant property is a uniform scattering or diffusing effect. Light rays incident on any point on the inner surface are, by multiple scattering reflections, distributed equally to all other points. The effects of the original direction of light are minimized. An integrating sphere may be thought of as a diffuser which preserves power but destroys spatial information. Another type of integrating sphere that can be utilized is referred to as a focusing or Coblentz sphere. A Coblentz sphere has a mirror-like (specular) inner surface rather than a diffuse inner surface. Light scattered by the interior of an integrating sphere is evenly distributed over all angles. The total power (radiant flux) of a light source can then be measured without inaccuracy caused by the directional characteristics of the source. Background information on integrating sphere—spectrophotometer apparatus is provided in Liu et al., U.S. Pat. No. 7,532,324 issued on May 12, 2009, the entirety of which hereby is incorporated herein by reference. It is understood throughout this specification that color points may be measured, for example, by utilizing a spectrophotometer, such as an integrating sphere—spectrophotometer. The spectra of reflectance values, absorbance values, and transmittance values of a reflective surface or of an object may be measured, for example, utilizing an ultraviolet-visible-near infrared (UV-VIS-NIR) spectrophotometer.

Throughout this specification, the term "lenticular features" means: an array of semicircular convex lenses ("lenticles") on a surface, being arranged as a sinusoidal series of mutually parallel ridges between troughs, forming a series of "lenticular toroidal lenses." Background information on lenticular toroidal lenses and lenticular features is provided in Seo U.S. Pat. No. 8,503,083 issued on Aug. 6, 2013, the entirety of which hereby is incorporated herein by reference.

Throughout this specification, the term "microprismatic features" means an array of small, equally-spaced multi-faceted prisms being arranged in a regular array forming a "microprismatic lens" on a surface Background information on microprismatic lenses is provided in Pakhchyan U.S. Patent Application Publication No. 2011/0292483A1 published on Dec. 1, 2011, the entirety of which hereby is incorporated herein by reference.

It is understood throughout this specification that numbering of the names of elements as being "first", "second" etcetera, is solely for purposes of clarity in referring to such elements in connection with various examples of lighting systems. It is understood throughout this specification that an example [100] of a lighting system may include any combination of the features discussed in connection with the examples [100] of a lighting system.

Figure 2:
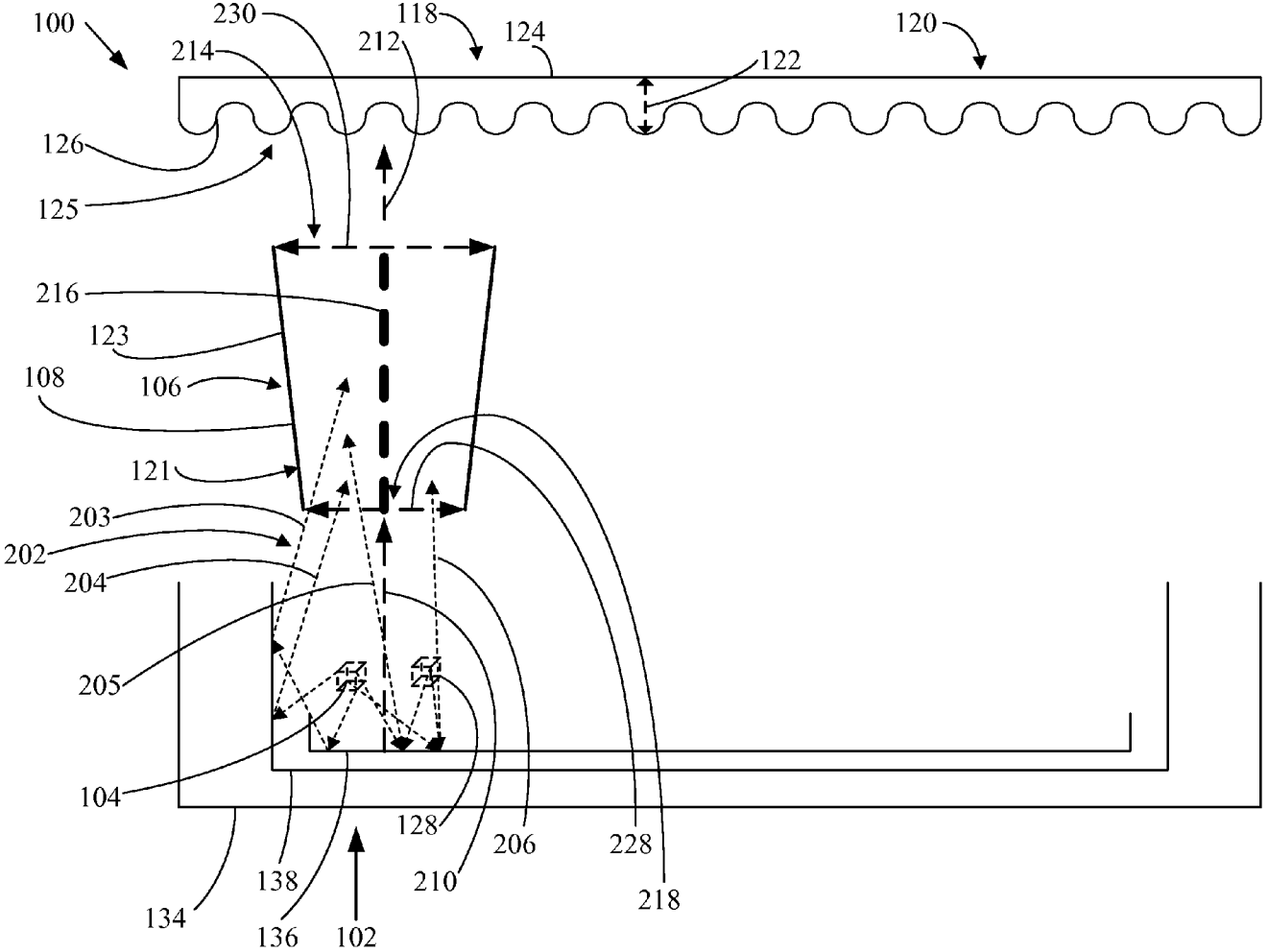
FIG. 2 is a cross-sectional side view taken along the line 2-2, showing the portion of the example [100] of the lighting system.

FIG. 1 is a perspective bottom view showing a portion of an example [100] of an implementation of a lighting system. FIG. 2 is a cross-sectional side view taken along the line 2-2, showing the portion of the example [100] of the lighting system. As shown in FIGS. 1 and 2, the example [100] of the implementation of the lighting system includes a lighting module [102] including a semiconductor light-emitting device [104] configured for emitting light emissions [202] in directions represented by the arrows [203], [204], [205], [206] along a central light emission axis [210]. Further, the example [100] of the lighting system includes a first lens module [106] that includes a first converging lens [108]. The first converging lens [108] of the example [100] of the lighting system is configured for causing convergence of some of the light emissions [202] of the semiconductor light-emitting device [104] to form converged light emissions [212] along the central light emission axis [210] having a first half-width-half-maximum (HWHM) around the central light emission axis [210] being represented by each of the arrows [110], [112], [114], [116], the first converging lens [108] having a first light output surface [214] being spaced apart along a first lens axis [216] from a first light input surface [218], the first converging lens [108] further having a first total internal reflection side surface [121] being spaced apart around the first lens axis [216] and having a first frusto-conical shape [123] extending between the first light input surface [218] and the first light output surface [214] of the first converging lens [108].

Figure 3:
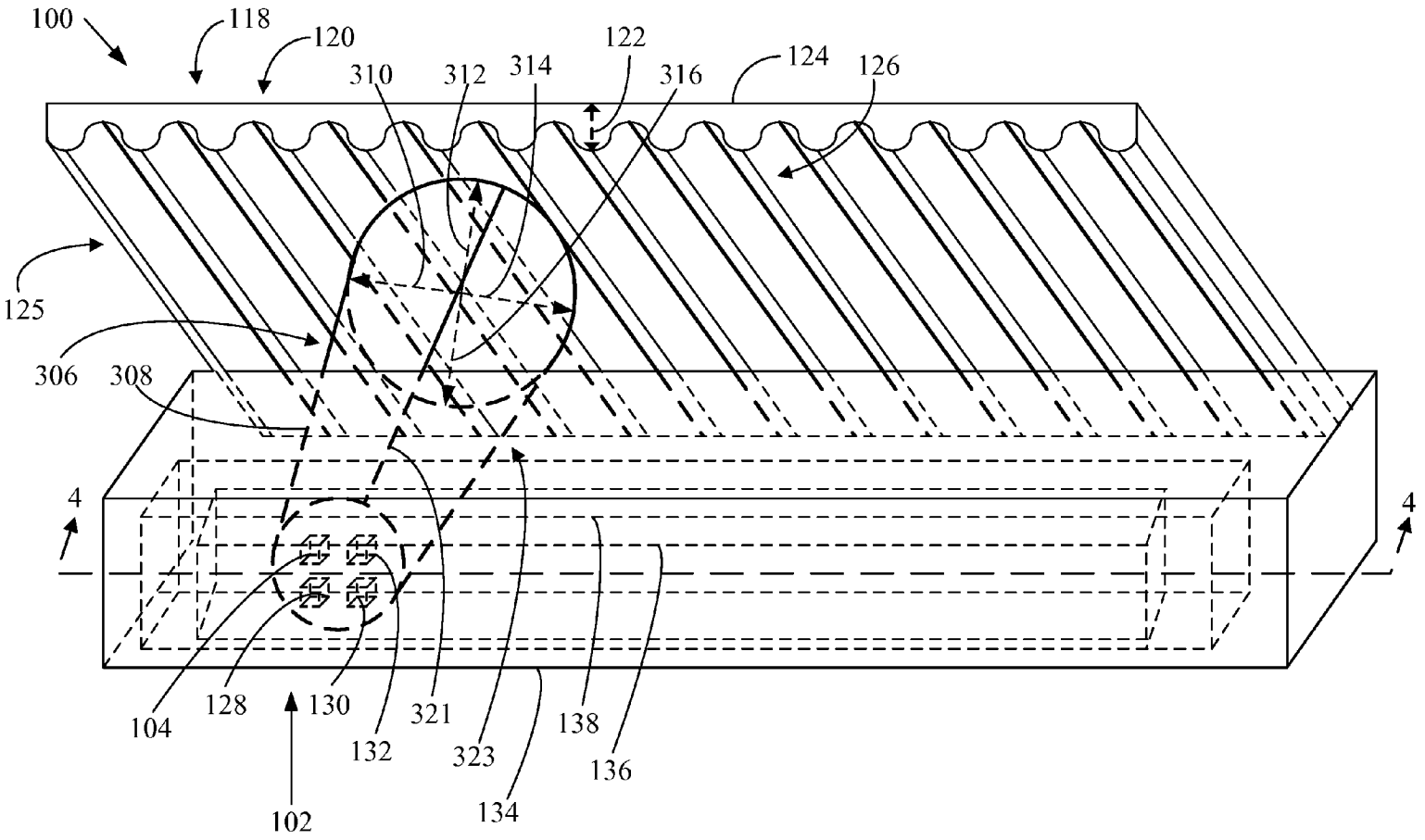
FIG. 3 is a perspective bottom view showing another portion of the example [100] of an implementation of a lighting system.
Figure 4:
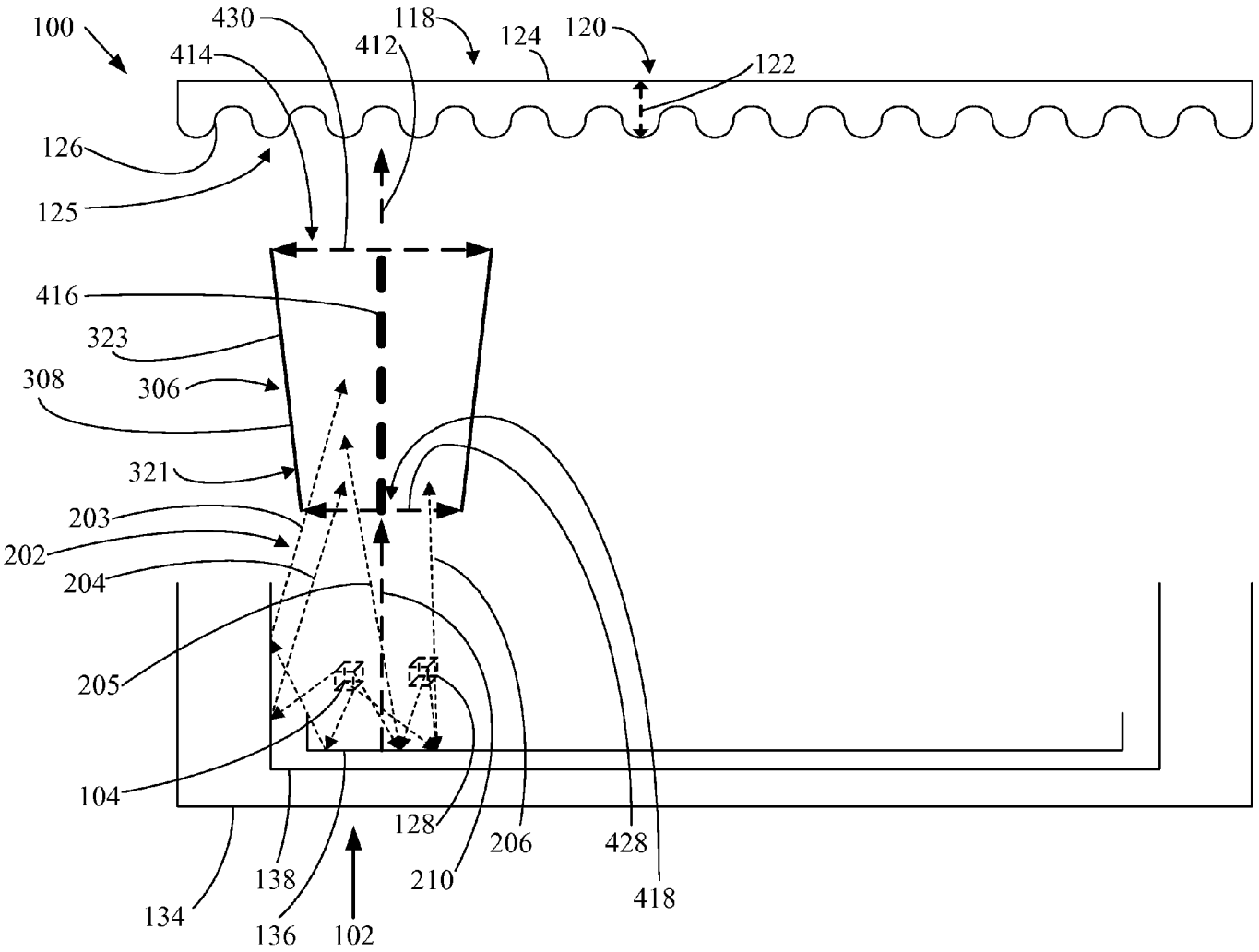
FIG. 4 is a cross-sectional side view taken along the line 4-4, showing the another portion of the example [100] of the lighting system.

FIG. 3 is a perspective bottom view showing another portion of the example [100] of an implementation of a lighting system. FIG. 4 is a cross-sectional side view taken along the line 4-4, showing the another portion of the example [100] of the lighting system. As shown in FIGS. 3 and 4, the example [100] of the implementation of the lighting system further includes a second lens module [306] that includes a second converging lens [308]. The second converging lens [308] of the example [100] of the lighting system is configured for causing convergence of some of the light emissions [202] of the semiconductor light-emitting device [104] to form further converged light emissions [412] along the central light emission axis [210] having a second HWHM around the central light emission axis [210] as represented by each of the arrows [310], [312], [314], [316] being different than the first HWHM represented by each of the arrows [110], [112], [114], [116], the second converging lens [308] having a second light output surface [414] being spaced apart along a second lens axis [416] from a second light input surface [418], the second converging lens [308] further having a second total internal reflection side surface [321] being spaced apart around the second lens axis [416] and having a second frusto-conical shape [323] extending between the second light input surface [418] and the second light output surface [414] of the second converging lens [308].

Figure 5:
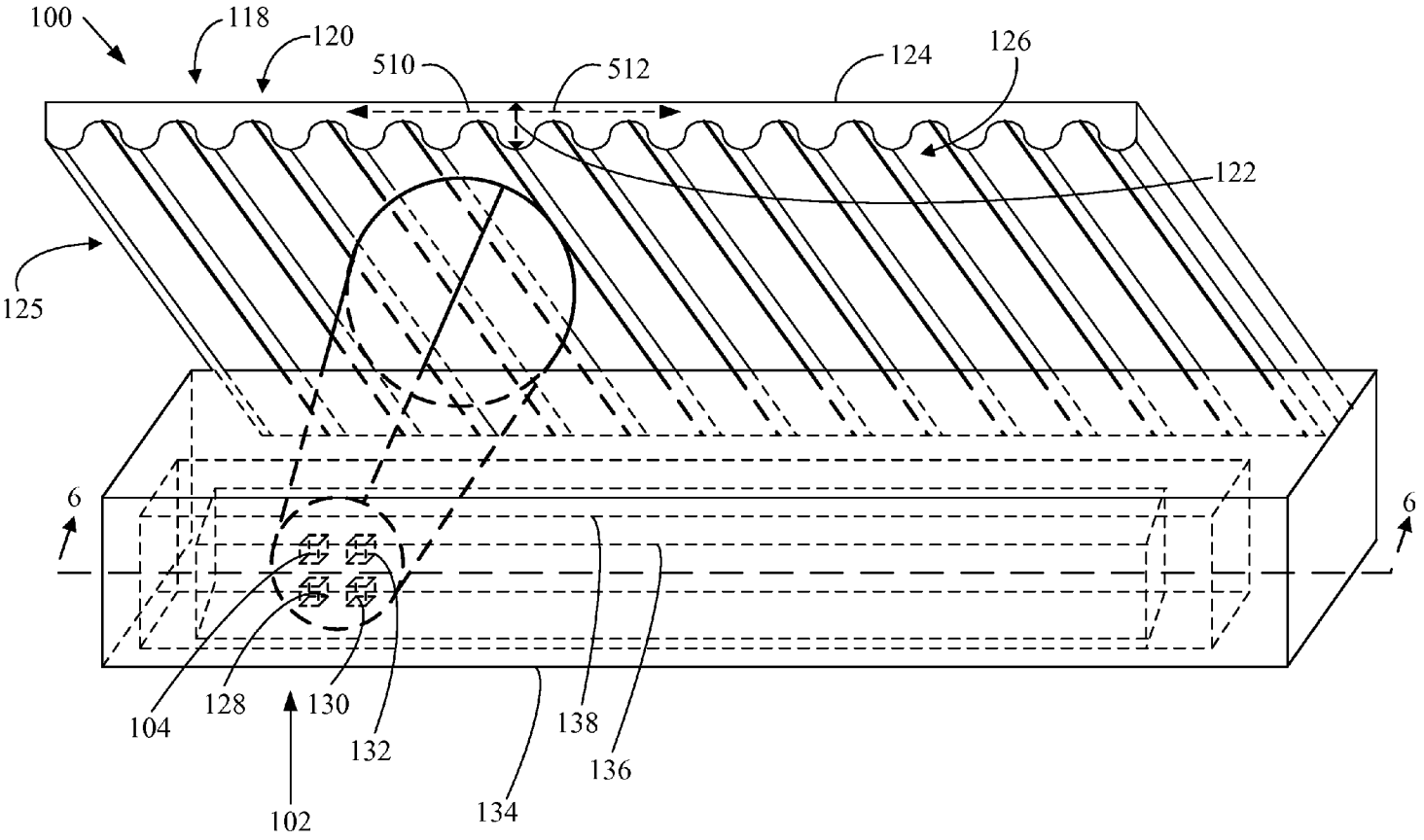
FIG. 5 is a perspective bottom view showing a further portion of the example [100] of an implementation of a lighting system.
Figure 6:
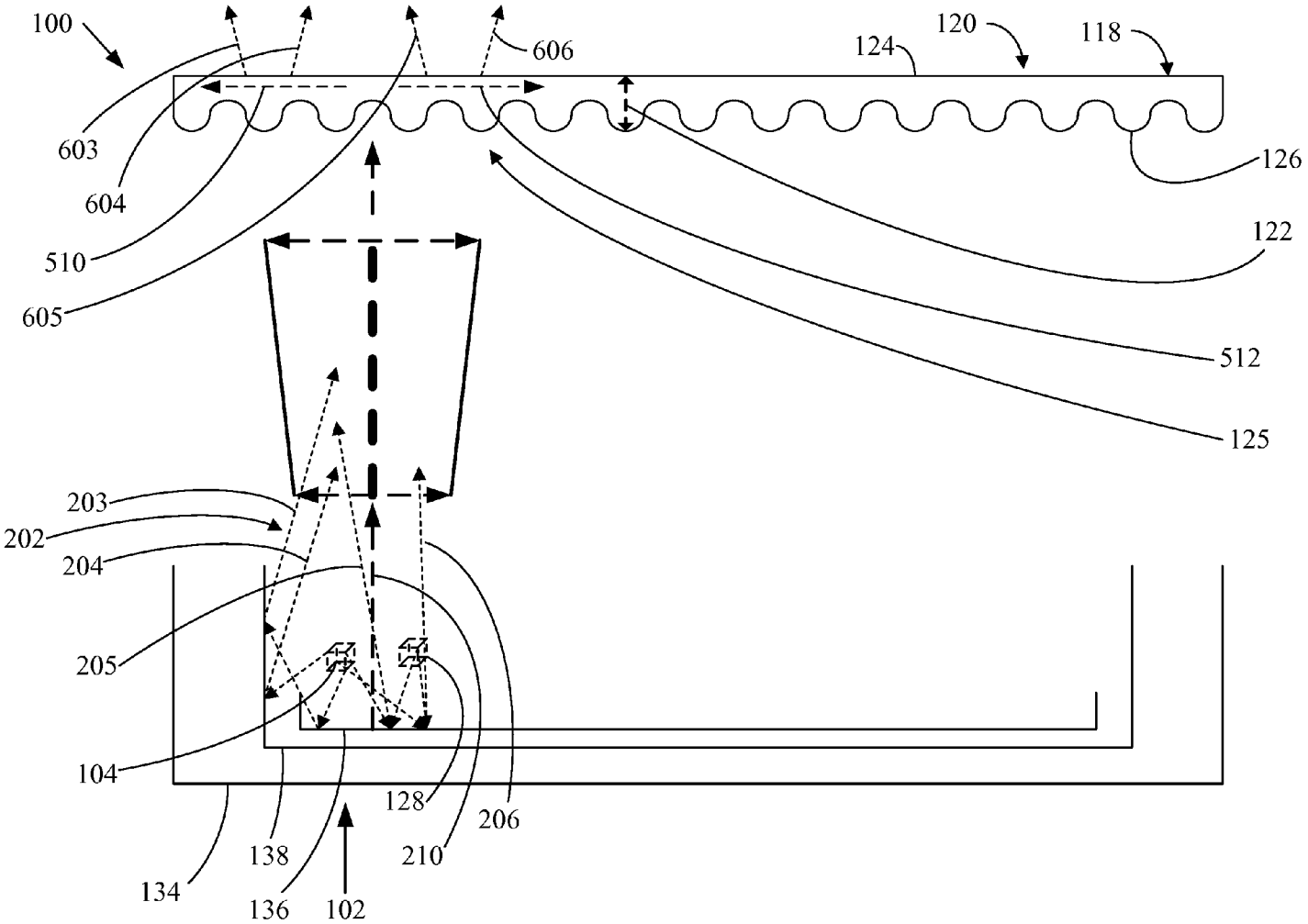
FIG. 6 is a cross-sectional side view taken along the line 6-6, showing the further portion of the example [100] of the lighting system.

FIG. 5 is a perspective bottom view showing a further portion of the example [100] of an implementation of a lighting system. FIG. 6 is a cross-sectional side view taken along the line 6-6, showing the further portion of the example [100] of the lighting system. As shown in FIGS. 1-6, the example [100] of the implementation of the lighting system further includes a third lens module [118] including a first diverging lens [120] having a third lens axis [122], the first diverging lens [120] being configured for causing divergence of some of the converged light emissions [212], [412] away from the third lens axis [122] by a third HWHM represented by each of the arrows [510], [512], to form diverged light emissions in directions represented by the arrows [603], [604], [605], [606] that diverge away from the central light emission axis [210]. As further shown in FIGS. 1-6, the first diverging lens [120] has a third light output surface [124] being spaced apart along the third lens axis [122] from a third light input surface [126], the third light input surface [126] including a first lens screen [125] having lenticular or microprismatic features. Referring to FIGS. 1-6, the example [100] of the lighting system is configured for detachably installing the first lens module [106] or the second lens module [306] in the lighting module [102] between the semiconductor light-emitting device [104] and the third lens module [118]; and the lighting system is configured for aligning the first lens axis [216] or the second lens axis [416] with the central light emission axis [210] and with the third lens axis [122].

Figure 7:
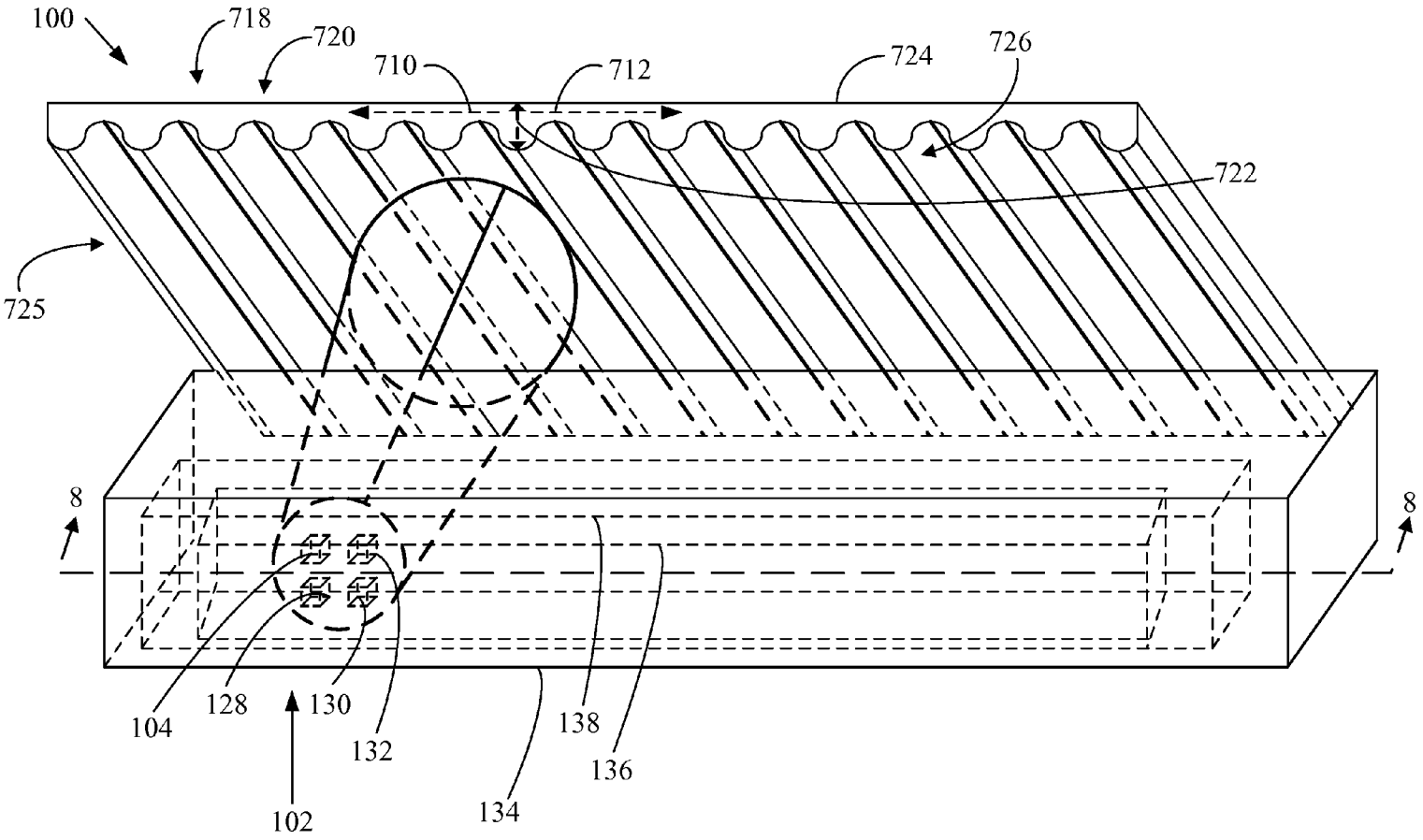
FIG. 7 is a perspective bottom view showing an example of an additional lens module that may be included in the example [100] of an implementation of a lighting system.
Figure 8:
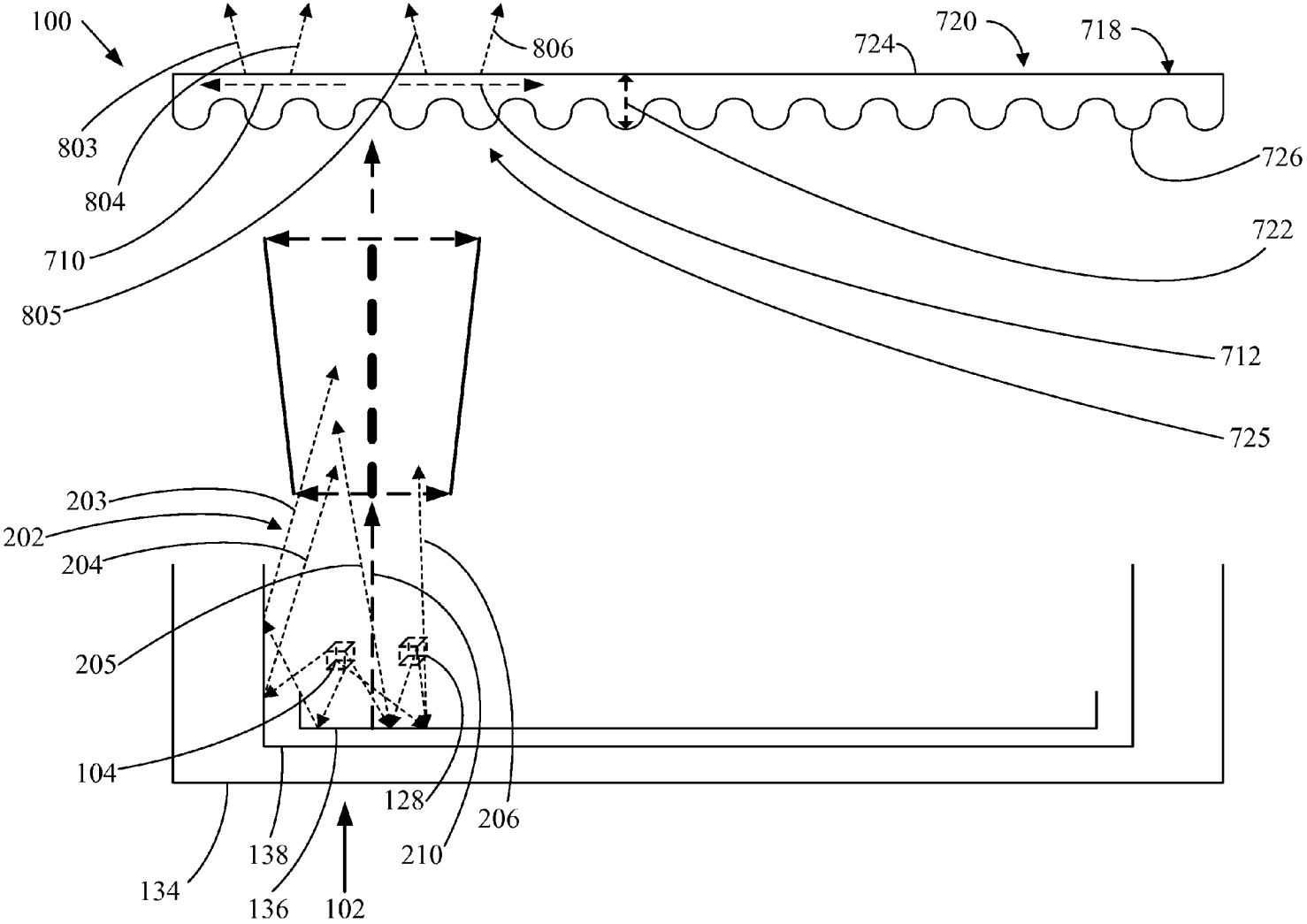
FIG. 8 is a cross-sectional side view taken along the line 8-8, showing the example of the additional lens module that may be included in the example [100] of the lighting system.

FIG. 7 is a perspective bottom view showing an example of an additional lens module that may be included in the example [100] of an implementation of a lighting system. FIG. 8 is a cross-sectional side view taken along the line 8-8, showing the example of the additional lens module that may be included in the example [100] of the lighting system. As shown in FIGS. 7-8, the example [100] of the implementation of the lighting system may include an additional lens module [718] including an additional diverging lens [720] having an additional lens axis [722], the additional diverging lens [720] being configured for causing divergence of some of the converged light emissions [212], [412] away from the additional lens axis [722] by an additional HWHM represented by each of the arrows [710], [712] being different than the third HWHM represented by each of the arrows [510], [512], to form additional diverged light emissions in directions represented by the arrows [803], [804], [805], [806] that diverge away from the central light emission axis [210]. As further shown in FIGS. 7-8, the additional diverging lens [720] may have an additional light output surface [724] being spaced apart along the additional lens axis [722] from an additional light input surface [726], and the additional light input surface [726] may include an additional lens screen [725] having lenticular or microprismatic features. In examples, the example [100] of the lighting system may be configured for detachably installing the first lens module [106] or the second lens module [306] in the lighting module [102] between the semiconductor light-emitting device [104] and the additional lens module [718]; and the example [100] of the lighting system may be configured for aligning the first lens axis [216] or the second lens axis [416] with the central light emission axis [210] and with the additional lens axis [722].

In further examples, the example [100] of the lighting system may be configured for interchangeably installing either the first lens module [106] or the second lens module [306] in the lighting module [102] between the semiconductor light-emitting device [104] and either the third lens module [118] or the additional lens module [718].

As another example of the example [100] of the lighting system, the lighting module [102] may include another semiconductor light-emitting device [128] being configured for emitting light emissions [202] along the central light emission axis [210]. In further examples of the example [100] of the lighting system, the lighting module [102] may include a plurality of additional semiconductor light-emitting devices [128], [130], [132], and the semiconductor light-emitting device [104] and the plurality of the additional semiconductor light-emitting devices [128], [130], [132] may be collectively arranged around and configured for emitting light emissions [202] along the central light emission axis [210]. In additional examples of the example [100] of the lighting system, one or more of the semiconductor light-emitting devices [104], [128], [130], [132] of the lighting module [102] may be configured as including a lumiphor (not shown) for changing a spectral power distribution of some of the light emissions [202].

In some examples of the example [100] of the lighting system, the first converging lens [108] may be configured for causing convergence of some of the light emissions [202] of the semiconductor light-emitting device [104] to form the converged light emissions [212] as having the first HWHM represented by each of the arrows [110], [112], [114], [116] being: about 3.5 degrees; or about 7.5 degrees; or about 12.5 degrees; or about 20 degrees. In further examples of the example [100] of the lighting system, the second converging lens [308] may be configured for causing convergence of some of the light emissions [202] of the semiconductor light-emitting device [104] to form the converged light emissions [412] as having the second HWHM represented by each of the arrows [310], [312], [314], [316] being: about 3.5 degrees; or about 7.5 degrees; or about 12.5 degrees; or about 20 degrees. In additional examples of the example [100] of the lighting system, the first diverging lens [120] may be configured for causing divergence of some of the converged light emissions [212], [412] away from the third lens axis [122] by a third HWHM represented by each of the arrows [510], [512] being: about 4 degrees; or about 10 degrees; or about 15 degrees; or about 25 degrees; or about 30 degrees. In other examples of the example [100] of the lighting system, the additional diverging lens [720] may be configured for causing divergence of some of the converged light emissions [212], [412] away from the additional lens axis [722] by another HWHM represented by each of the arrows [710], [712] being: about 4 degrees; or about 10 degrees; or about 15 degrees; or about 25 degrees; or about 30 degrees. In examples, an example [100] of the lighting system may include a diverging lens [120], [720] having a HWHM of: about 4 degrees including toroidal lenses each having a radius of about 0.815 millimeters ("mm") and a height of about 0.16 mm; or about 10 degrees including toroidal lenses each having a radius of about 0.825 millimeters ("mm") and a height of about 0.28 mm; or about 25 degrees including toroidal lenses each having a radius of about 0.845 millimeters ("mm") and a height of about 0.47 mm.

In examples of the example [100] of the lighting system, the first diverging lens [120] may have the first lens screen [125] as including an array of lenticular toroidal lenses. In further examples of the example [100] of the lighting system, the additional diverging lens [720] may have the additional lens screen [725] as including an array of lenticular toroidal lenses. In additional examples (not shown) of the example [100] of the lighting system, the either or both of the diverging lenses [120], [720] may respectively have the lens screen [125], [725] as including an array of microprismatic lenses.

In some examples of the example [100] of the lighting system, the first converging lens [108] may have a first diameter [228] transverse to the first lens axis [216] at the first light input surface [218], and the first converging lens [108] may have a second diameter [230] transverse to the first lens axis [216] at the first light output surface [214], and the first diameter [228] may be smaller than the second diameter [230]. In additional examples of the example [100] of the lighting system, the second converging lens [308] may have a first diameter [428] transverse to the second lens axis [416] at the second light input surface [418], and the second converging lens [308] may have a second diameter [430] transverse to the second lens axis [416] at the second light output surface [414], and the first diameter [428] may be smaller than the second diameter [430].

In other examples, the example [100] of the lighting system may include a housing [134] being configured for positioning the lighting module [102] for emission of the light emissions from the semiconductor light-emitting device [104] along the central light emission axis [210]. In further examples, the example [100] of the lighting system may include a carrier [136] being configured for positioning the first lens module [106] or the second lens module [306] in the housing [134] with the first lens axis [216] or the second lens axis [416] being aligned with the central light emission axis [210]. In additional examples, the example [100] of the lighting system may include a primary visible light reflector [138] configured for being positioned between the housing [134] and the carrier [136], and the primary visible light reflector [138] may be configured for redirecting some of the light emissions [202] of the semiconductor light-emitting device [104] in the directions represented by the arrows [203], [204], [205], [206] along the central light emission axis [210].

Figure 9:
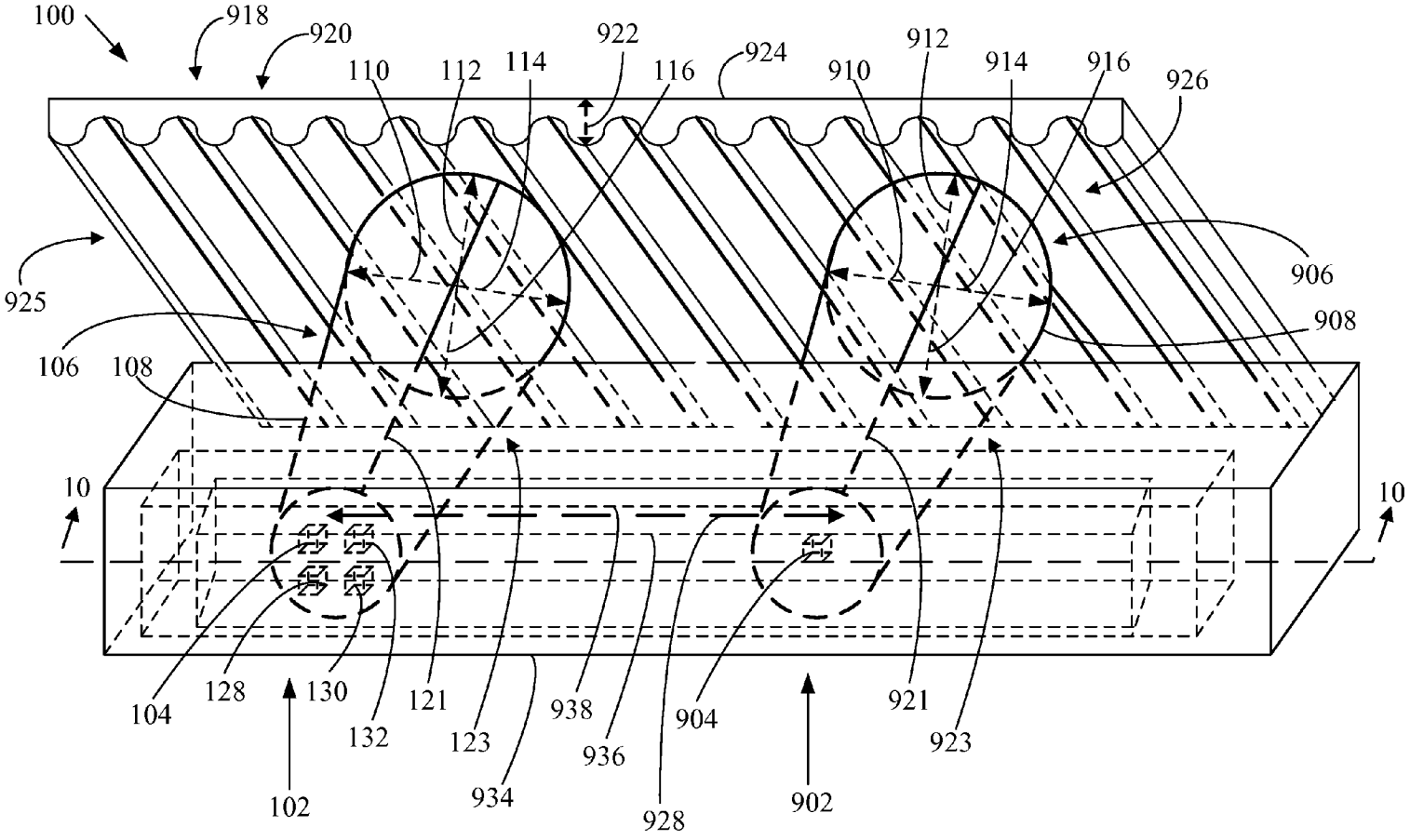
FIG. 9 is a perspective bottom view showing an example of a portion of a second lighting module that may be included in the example [100] of an implementation of a lighting system.
Figure 10:
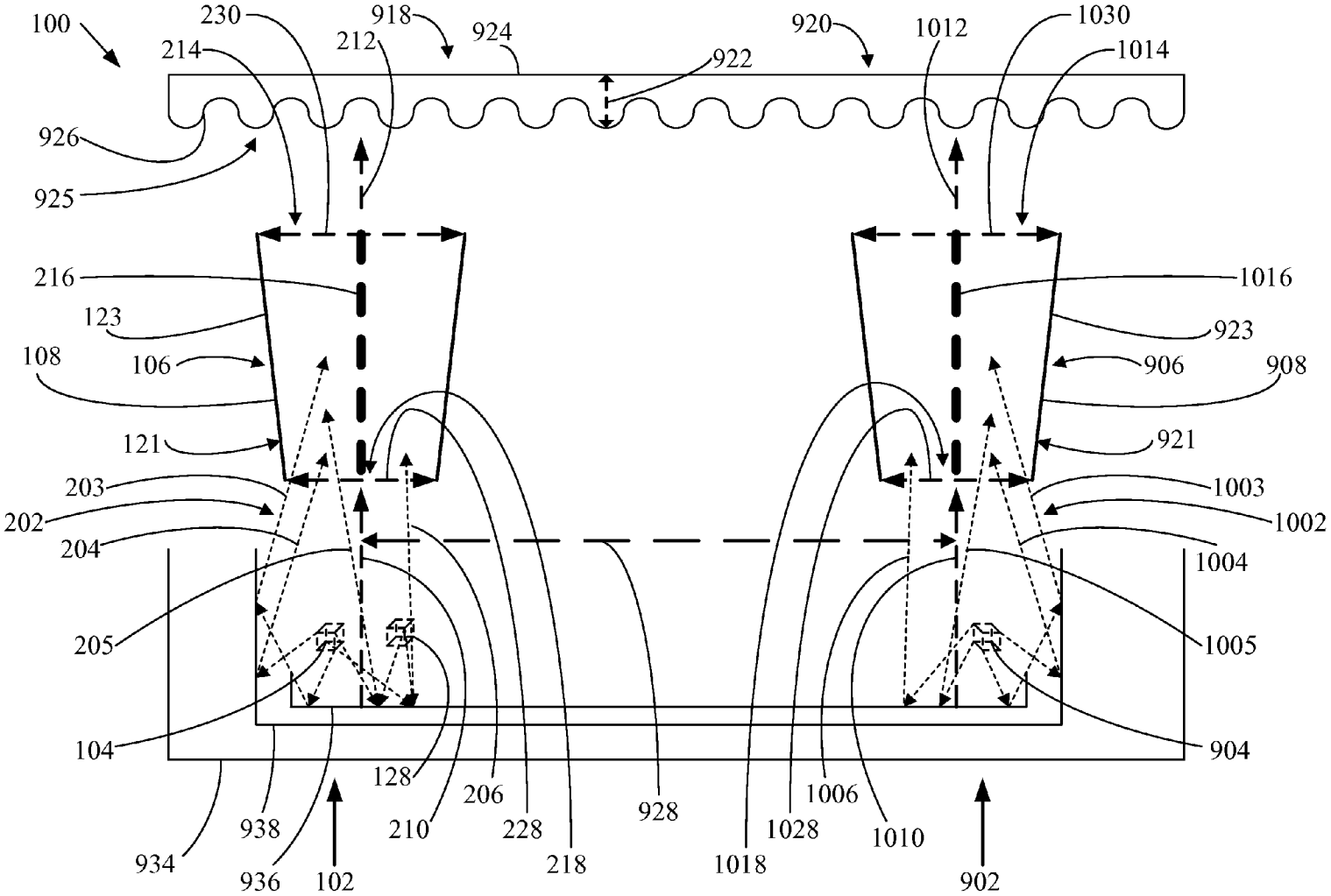
FIG. 10 is a cross-sectional side view taken along the line 10-10, showing the example of the portion of the second lighting module that may be included in the example [100] of the lighting system.

FIG. 9 is a perspective bottom view showing an example of a portion of a second lighting module that may be included in the example [100] of an implementation of a lighting system. FIG. 10 is a cross-sectional side view taken along the line 10-10, showing the example of the portion of the second lighting module that may be included in the example [100] of the lighting system. As shown in FIGS. 9-10, the example [100] of the implementation of the lighting system may include a second lighting module [902] including a second semiconductor light-emitting device [904] configured for emitting further light emissions [1002] in directions represented by the arrows [1003], [1004], [1005], [1006] along a second central light emission axis [1010]. Further, the example [100] of the lighting system may include a fourth lens module [906] that may include a third converging lens [908]. The third converging lens [908] of this example [100] of the lighting system may be configured for causing convergence of some of the further light emissions [1002] of the second semiconductor light-emitting device [904] to form additional converged light emissions [1012] along the second central light emission axis [1010] having a fourth HWHM represented by each of the arrows [910], [912], [914], [916], the third converging lens [908] having a fourth light output surface [1014] being spaced apart along a fourth lens axis [1016] from a fourth light input surface [1018], the third converging lens [908] further having a third total internal reflection side surface [921] being spaced apart around the fourth lens axis [1016] and having a third frusto-conical shape [923] extending between the fourth light input surface [1018] and the fourth light output surface [1014] of the third converging lens [908]. In further examples of the example [100] of the lighting system, the second lighting module [902] may include another or a plurality of additional semiconductor light-emitting devices (not shown), and the second semiconductor light-emitting device [904] and the another or the plurality of the additional semiconductor light-emitting devices may be collectively arranged around and configured for emitting the further light emissions [1002] along the second central light emission axis [1010]. In additional examples of the example [100] of the lighting system, the second semiconductor light-emitting device [904] and the another or the plurality of the additional semiconductor light-emitting devices of the second lighting module [902] may be configured as including a lumiphor (not shown) for changing a spectral power distribution of some of the further light emissions [1002].

Figure 11:
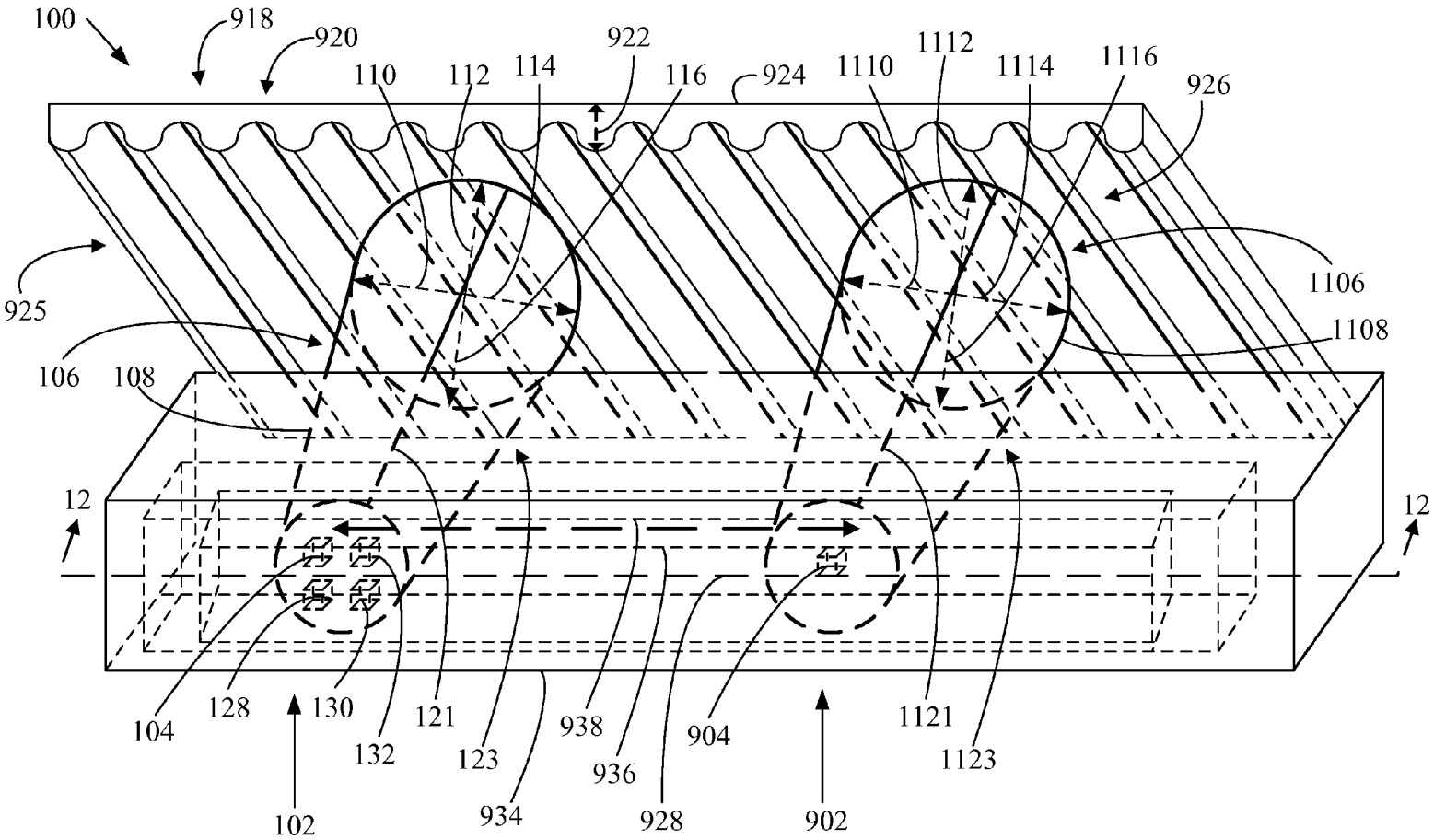
FIG. 11 is a perspective bottom view showing an example of another portion of the second lighting module that may be included in the example [100] of an implementation of a lighting system.
Figure 12:
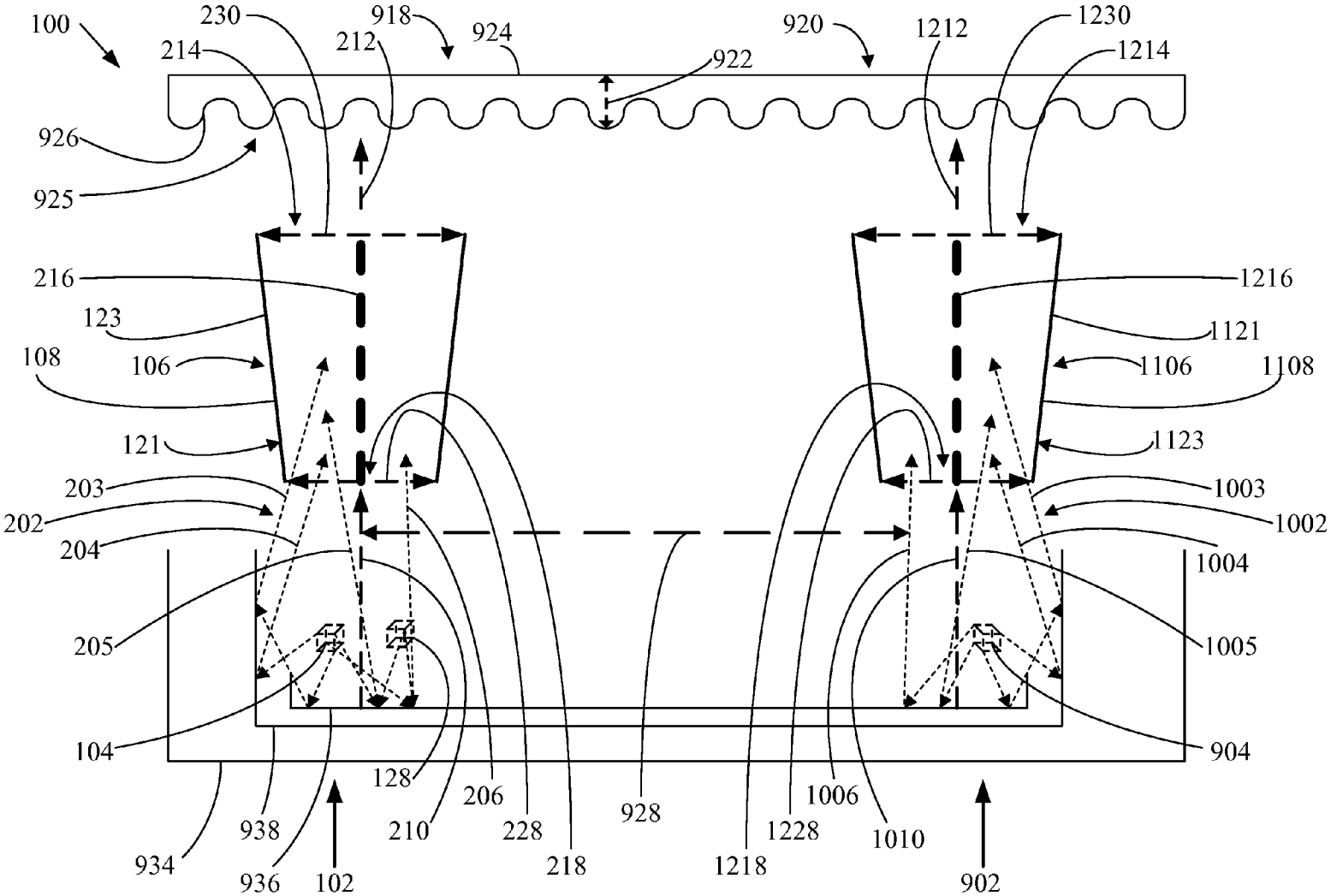
FIG. 12 is a cross-sectional side view taken along the line 12-12, showing the example of the another portion of the second lighting module that may be included in the example [100] of the lighting system.

FIG. 11 is a perspective bottom view showing an example of another portion of the second lighting module that may be included in the example [100] of an implementation of a lighting system. FIG. 12 is a cross-sectional side view taken along the line 12-12, showing the example of the another portion of the second lighting module that may be included in the example [100] of the lighting system. As shown in FIGS. 11-12, the example [100] of the implementation of the lighting system may include a fifth lens module [1106] that may include a fourth converging lens [1108]. The fourth converging lens [1108] may be configured for causing convergence of some of the further light emissions [1002] of the second semiconductor light-emitting device [904] to form other converged light emissions [1212] along the second central light emission axis [1010] having a fifth HWHM around the second central light emission axis [1010] as represented by each of the arrows [1110], [1112], [1114], [1116] being different than the fourth HWHM represented by each of the arrows [910], [912], [914], [916], the fourth converging lens [1108] having a fifth light output surface [1214] being spaced apart along a fifth lens axis [1216] from a fifth light input surface [1218], the fourth converging lens [1108] further having a fourth total internal reflection side surface [1121] being spaced apart around the fifth lens axis [1216] and having a fourth frusto-conical shape [1123] extending between the fifth light input surface [1218] and the fifth light output surface [1214] of the fourth converging lens [1108].

Figure 13:
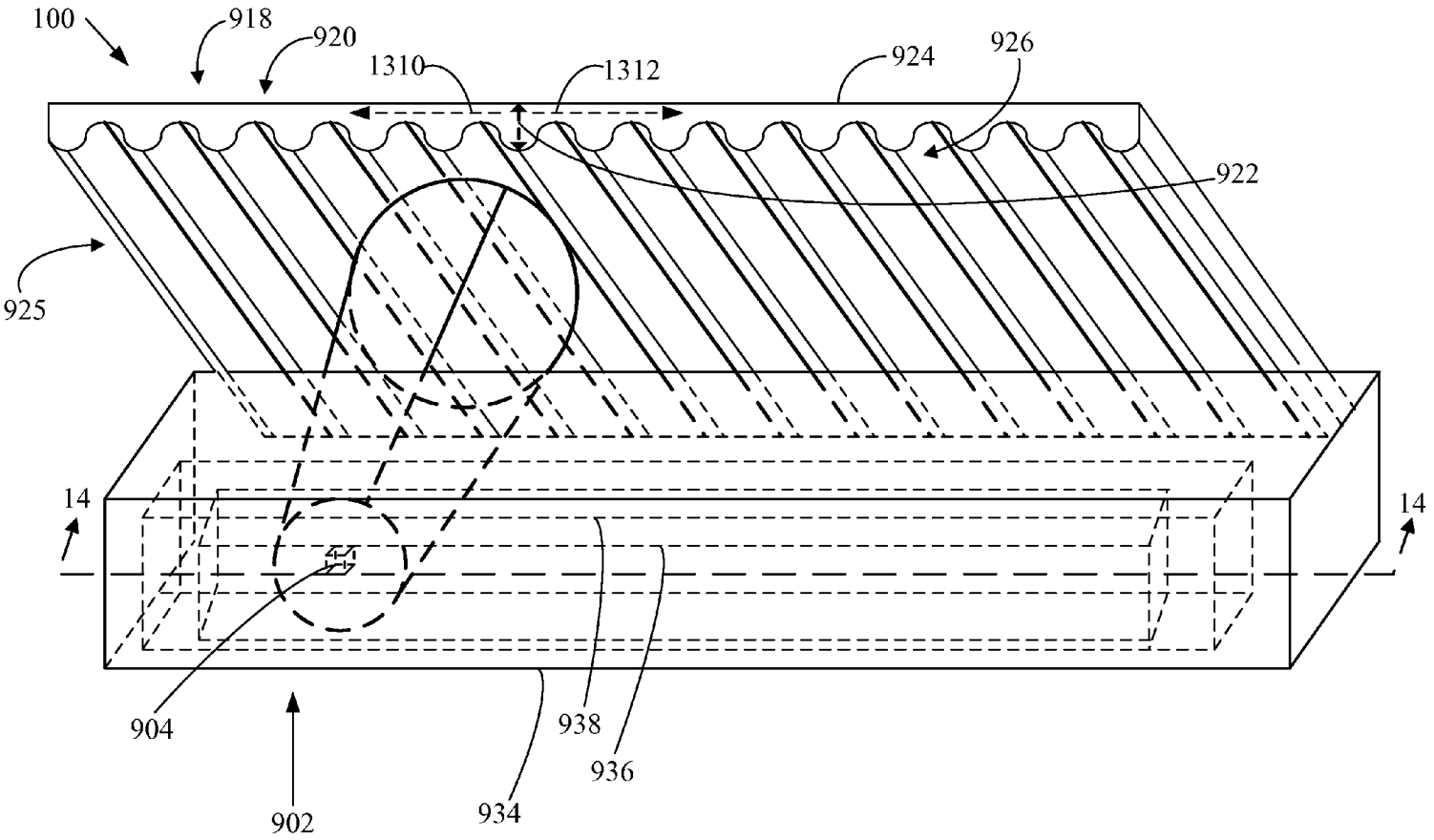
FIG. 13 is a perspective bottom view showing an example of a further portion of the second lighting module that may be included in the example [100] of an implementation of a lighting system.
Figure 14:
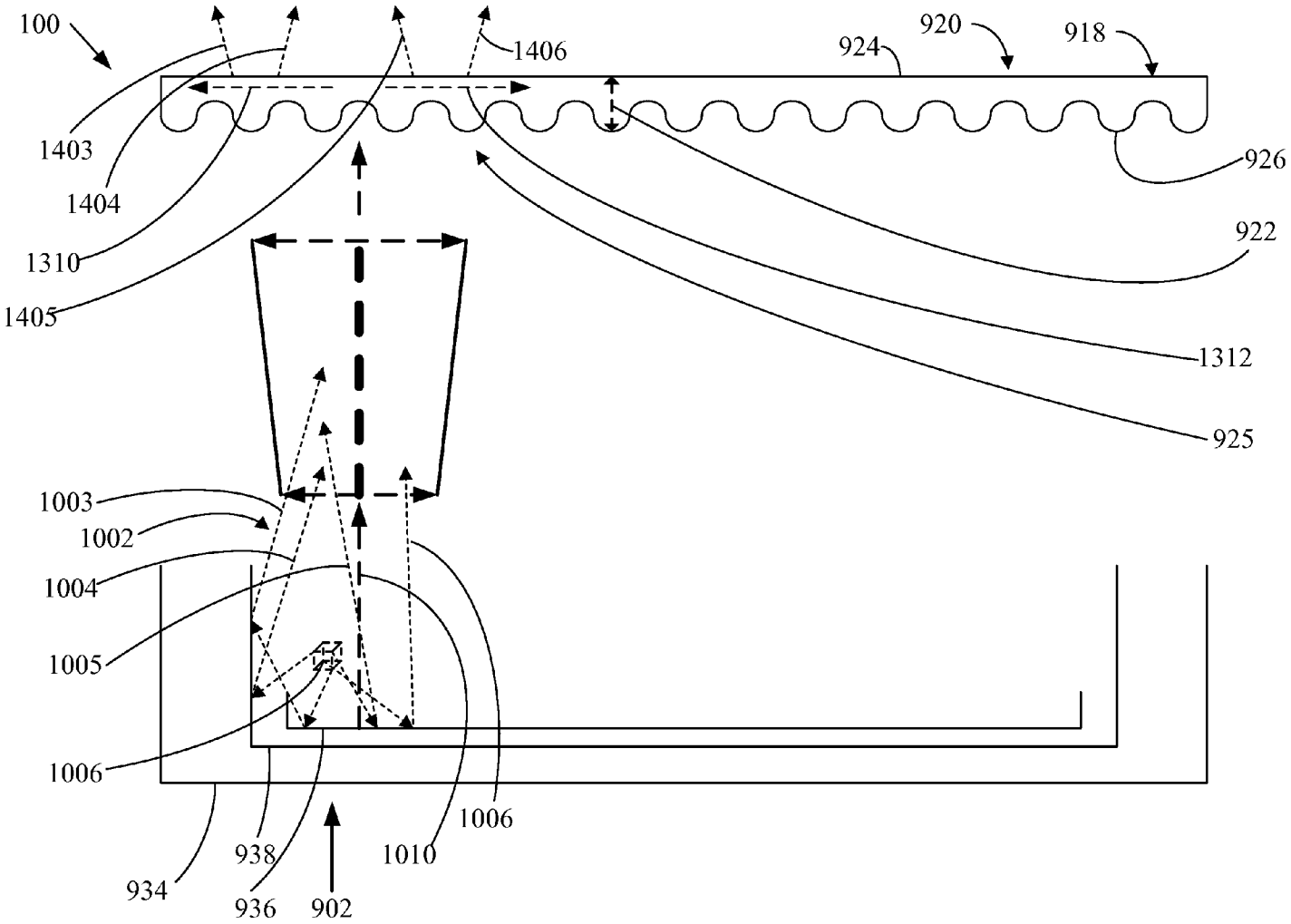
FIG. 14 is a cross-sectional side view taken along the line 14-14, showing the example of the further portion of the second lighting module that may be included in the example [100] of the lighting system.

FIG. 13 is a perspective bottom view showing an example of a further portion of the second lighting module that may be included in the example [100] of an implementation of a lighting system. FIG. 14 is a cross-sectional side view taken along the line 14-14, showing the example of the further portion of the second lighting module that may be included in the example [100] of the lighting system. As shown in FIGS. 9-14, the example [100] of the implementation of the lighting system may include a sixth lens module [918] including a second diverging lens [920] having a sixth lens axis [922], the second diverging lens [920] being configured for causing divergence of some of the converged light emissions [1012], [1212] from each of the lens modules [906], [1106] away from the sixth lens axis [922] by a sixth HWHM represented by each of the arrows [1310], [1312] to form diverged light emissions in directions represented by the arrows [1403], [1404], [1405], [1406] that diverge away from the second central light emission axis [1010]. As shown in FIGS. 9-14, the second diverging lens [920] may have a sixth light output surface [924] being spaced apart along the sixth lens axis [922] from a sixth light input surface [926], the sixth light input surface [926] including a second lens screen [925] having lenticular or microprismatic features.

In examples, the example [100] of the lighting system may be configured for detachably installing the fourth lens module [906] or the fifth lens module [1106] in the second lighting module [902] between the second semiconductor light-emitting device [904] and the sixth lens module [918]; and the example [100] of the lighting system may be configured for aligning the fourth lens axis [1016] or the fifth lens axis [1216] with the second central light emission axis [1010] and the sixth lens axis [922].

In some examples of the example [100] of the lighting system, the third converging lens [908] may be configured for causing convergence of some of the further light emissions [1002] of the second semiconductor light-emitting device [904] to form the converged light emissions [1012] as having the fourth HWHM represented by each of the arrows [910], [912], [914], [916] being: about 3.5 degrees; or about 7.5 degrees; or about 12.5 degrees; or about 20 degrees. In further examples of the example [100] of the lighting system, the fourth converging lens [1108] may be configured for causing convergence of some of the further light emissions [1002] of the second semiconductor light-emitting device [904] to form the converged light emissions [1212] as having the fifth HWHM represented by each of the arrows [1110], [1112], [1114], [1116] being: about 3.5 degrees; or about 7.5 degrees; or about 12.5 degrees; or about 20 degrees. In additional examples of the example [100] of the lighting system, the second diverging lens [920] may be configured for causing divergence of some of the converged light emissions [212], [412], [1012], [1212] away from the sixth lens axis [922] by a sixth HWHM represented by each of the arrows [1310], [1312] being: about 4 degrees; or about 10 degrees; or about 15 degrees; or about 25 degrees; or about 30 degrees. In examples of the example [100] of the lighting system, the second diverging lens [920] may have the second lens screen [925] as including an array of lenticular toroidal lenses. In other examples (not shown) of the example [100] of the lighting system, the second diverging lens [920] may have the second lens screen [925] as including an array of microprismatic lenses.

In some examples of the example [100] of the lighting system, the third converging lens [908] may have a third diameter [1028] transverse to the fourth lens axis [1016] at the fourth light input surface [1018], and the third converging lens [908] may have a fourth diameter [1030] transverse to the fourth lens axis [1016] at the fourth light output surface [1014], and the third diameter [1028] may be smaller than the fourth diameter [1030]. In additional examples of the example [100] of the lighting system, the fourth converging lens [1108] may have a third diameter [1228] transverse to the fifth lens axis [1216] at the fifth light input surface [1218], and the fourth converging lens [1108] may have a fourth diameter [1230] transverse to the fifth lens axis [1216] at the fifth light output surface [1214], and the third diameter [1228] may be smaller than the fourth diameter [1230].

In other examples, the example [100] of the lighting system may include a housing [934] being configured: for positioning the lighting module [102] for emission of the light emissions [202] from the semiconductor light-emitting device [104] along the central light emission axis [210]; and for positioning the second lighting module [902] for emission of the further light emissions [1002] from the second semiconductor light-emitting device [904] along the second central light emission axis [1010]. In further examples, the example [100] of the lighting system may include a carrier [936] being configured: for positioning the first lens module [106] or the second lens module [306] in the housing [934] with the first lens axis [216] or the second lens axis [416] being aligned with the central light emission axis [210]; and for positioning the fourth lens module [906] or the fifth lens module [1106] in the housing [934] with the fourth lens axis [1016] or the fifth lens axis [1216] being aligned with the second central light emission axis [1010]. In additional examples, the example [100] of the lighting system may include a primary visible light reflector [938] configured for being positioned between the housing [934] and the carrier [936], and the primary visible light reflector [938] may be configured for redirecting some of the further light emissions [1002] of the second semiconductor light-emitting device [904] in the directions represented by the arrows [1003], [1004], [1005], [1006] along the second central light emission axis [1010].

Figure 16:
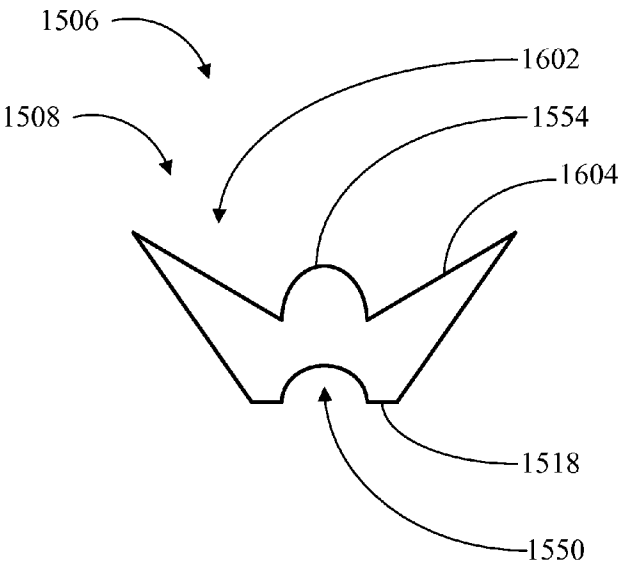
FIG. 16 is a cross-sectional side view taken along the line 16-16, showing the example of the another lens module that may be included in the example [100] of the lighting system.
Figure 15:
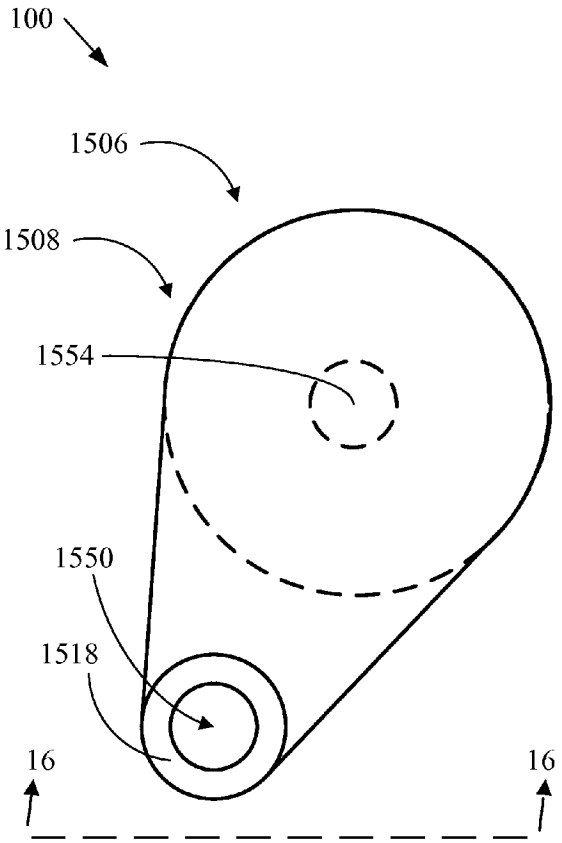
FIG. 15 is a perspective bottom view showing an example of another lens module that may be included in the example [100] of an implementation of a lighting system.

FIG. 15 is a perspective bottom view showing an example of another lens module that may be included in the example [100] of an implementation of a lighting system. FIG. 16 is a cross-sectional side view taken along the line 16-16, showing the example of the another lens module that may be included in the example [100] of the lighting system. In examples, the example [100] of the lighting system may include a lens module [1506] as being: the first lens module [106]; or the second lens module [306]; or the fourth lens module [906]; or the fifth lens module [1106]. As examples, the lens module [1506] may include a converging lens [1508]. In examples, the converging lens [1508] may include a light input surface [1518] having a central cavity

[1550] being shaped as a portion of a spheroid. In further examples, the converging lens [1508] may include a light output surface [1602] having a bowl-shaped cavity [1604] surrounding a central mound [1554] shaped as a portion of a spheroid. In some examples of the example [100] of the lighting system, the converging lens [1508] may be configured for causing convergence of some of the light emissions [202], [1002] of the semiconductor light-emitting devices [104], [904] to form the converged light emissions [212], [412], [1012], [1212] as having a HWHM being about 3.5 degrees.

Figure 18:
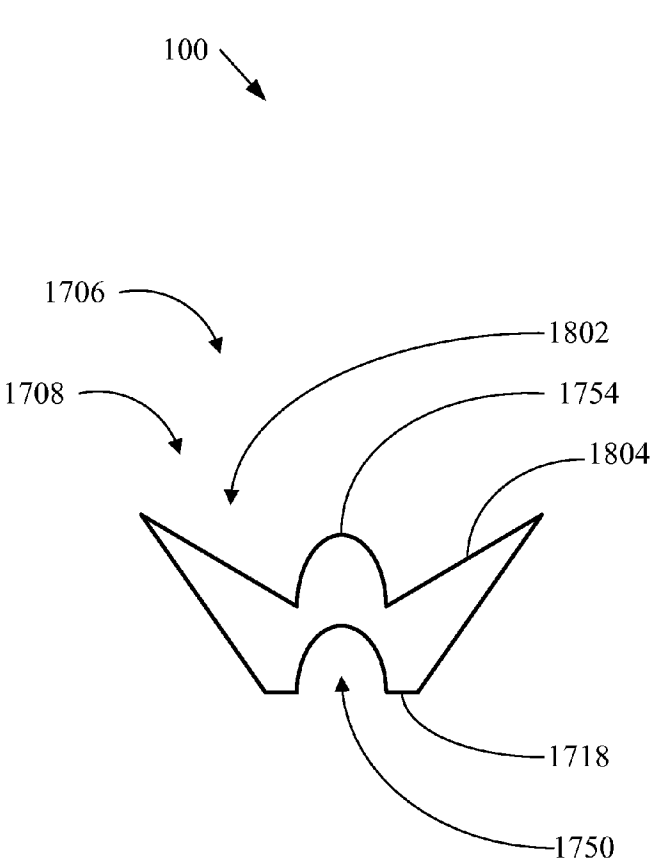
FIG. 18 is a cross-sectional side view taken along the line 18-18, showing the example of the further lens module that may be included in the example [100] of the lighting system.
Figure 17:
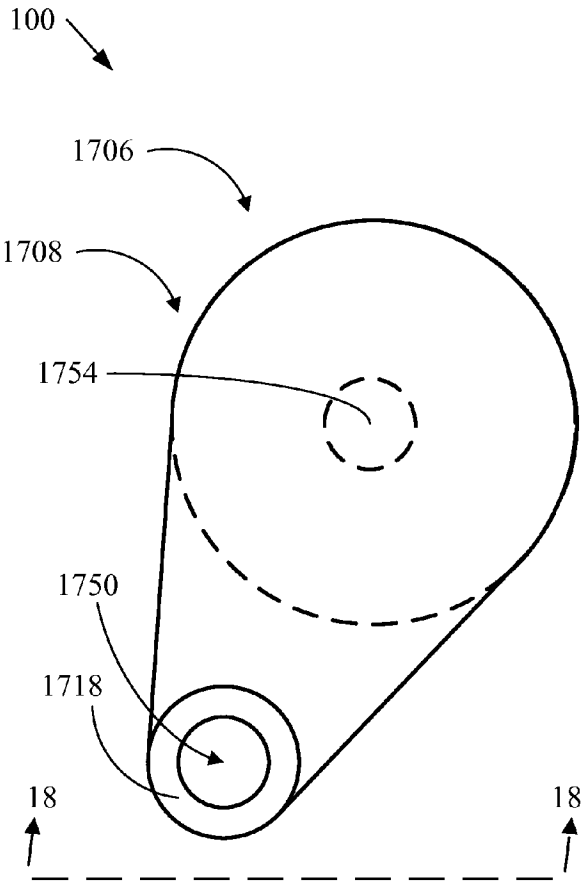
FIG. 17 is a perspective bottom view showing an example of a further lens module that may be included in the example [100] of an implementation of a lighting system.

FIG. 17 is a perspective bottom view showing an example of a further lens module that may be included in the example [100] of an implementation of a lighting system. FIG. 18 is a cross-sectional side view taken along the line 18-18, showing the example of the further lens module that may be included in the example [100] of the lighting system. In examples, the example [100] of the lighting system may include a lens module [1706] as being: the first lens module [106]; or the second lens module [306]; or the fourth lens module [906]; or the fifth lens module [1106]. As examples, the lens module [1706] may include a converging lens [1708]. In examples, the converging lens [1708] may include a light input surface [1718] having a central cavity [1750] being shaped as a portion of a spheroid. In further examples, the converging lens [1708] may include a light output surface [1802] having a bowl-shaped cavity [1804] surrounding a central mound [1754] shaped as a portion of a spheroid. In some examples of the example [100] of the lighting system, the converging lens [1708] may be configured for causing convergence of some of the light emissions [202], [1002] of the semiconductor light-emitting devices [104], [904] to form the converged light emissions [212], [412], [1012], [1212] as having a HWHM being about 7.5 degrees.

Figure 20:
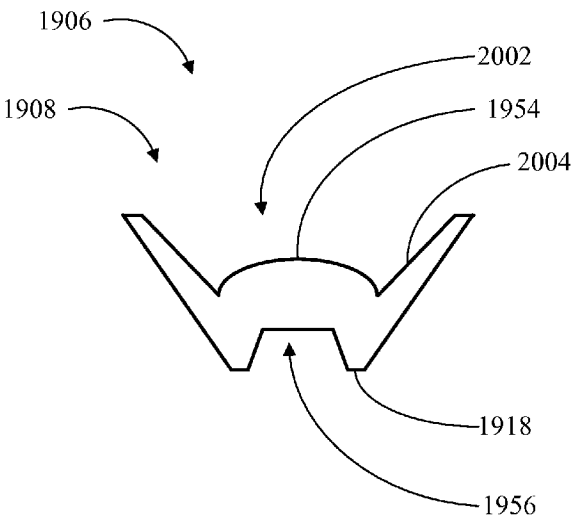
FIG. 20 is a cross-sectional side view taken along the line 20-20, showing the example of the additional lens module that may be included in the example [100] of the lighting system.
Figure 19:
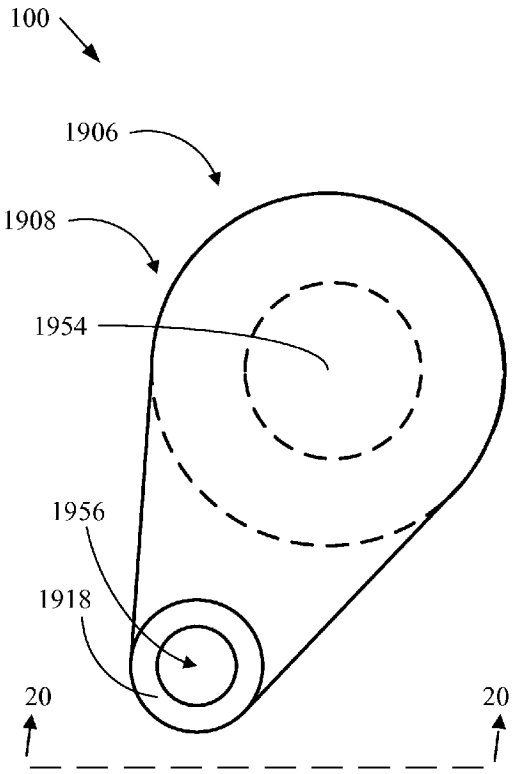
FIG. 19 is a perspective bottom view showing an example of an additional lens module that may be included in the example [100] of an implementation of a lighting system.

FIG. 19 is a perspective bottom view showing an example of an additional lens module that may be included in the example [100] of an implementation of a lighting system. FIG. 20 is a cross-sectional side view taken along the line 20-20, showing the example of the additional lens module that may be included in the example [100] of the lighting system. In examples, the example [100] of the lighting system may include a lens module [1906] as being: the first lens module [106]; or the second lens module [306]; or the fourth lens module [906]; or the fifth lens module [1106]. As examples, the lens module [1906] may include a converging lens [1908]. In examples, the converging lens [1908] may include a light input surface [1918] having a central disk-shaped cavity [1956]. In further examples, the converging lens [1908] may include a light output surface [2002] having a bowl-shaped cavity [2004] surrounding a central mound [1954] shaped as a portion of a spheroid. In some examples of the example [100] of the lighting system, the converging lens [1908] may be configured for causing convergence of some of the light emissions [202], [1002] of the semiconductor light-emitting devices [104], [904] to form the converged light emissions [212], [412], [1012], [1212] as having a HWHM being about 12.5 degrees.

Figure 22:
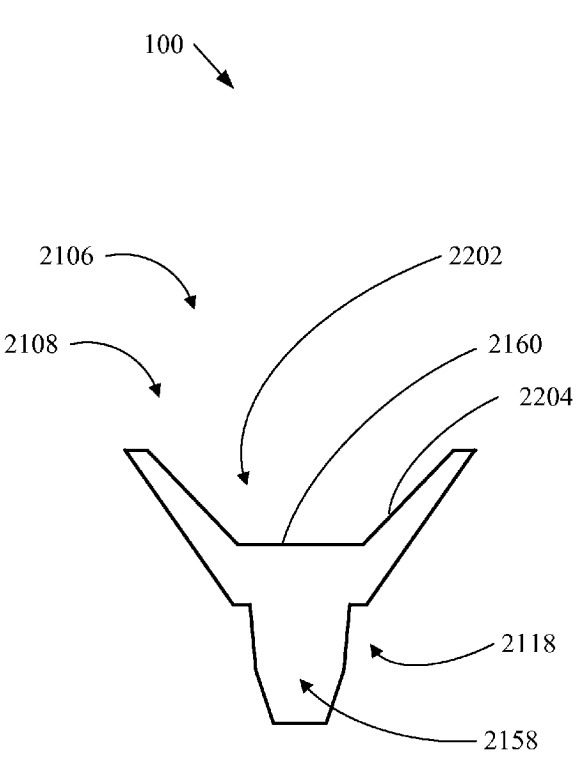
FIG. 22 is a cross-sectional side view taken along the line 22-22, showing the example of the another lens module that may be included in the example [100] of the lighting system.
Figure 21:
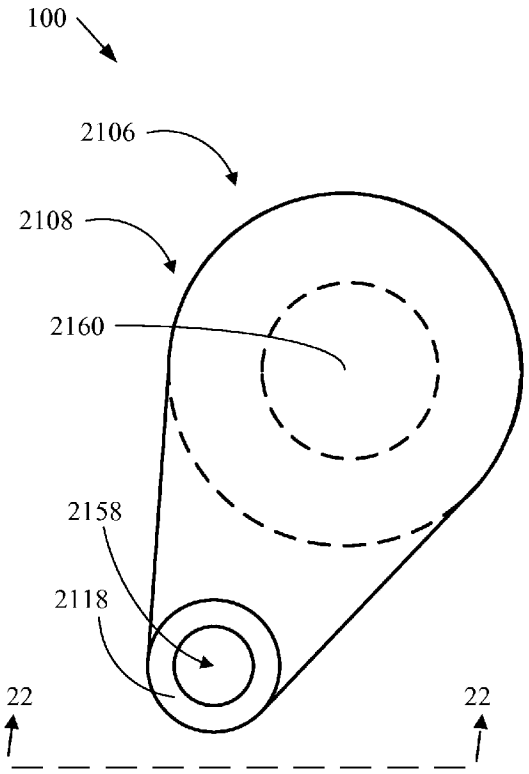
FIG. 21 is a perspective bottom view showing an example of another lens module that may be included in the example [100] of an implementation of a lighting system.

FIG. 21 is a perspective bottom view showing an example of another lens module that may be included in the example [100] of an implementation of a lighting system. FIG. 22 is a cross-sectional side view taken along the line 22-22, showing the example of the another lens module that may be included in the example [100] of the lighting system. In examples, the example [100] of the lighting system may include a lens module [2106] as being: the first lens module [106]; or the second lens module [306]; or the fourth lens module [906]; or the fifth lens module [1106]. As examples, the lens module [2106] may include a converging lens [2108]. In examples, the converging lens [2108] may include a light input surface [2118] having a central compound parabolic concentrator [2158]. In further examples, the converging lens [2108] may include a light output surface [2202] having a bowl-shaped cavity [2204] surrounding a central flat region [2160]. In some examples of the example [100] of the lighting system, the converging lens [2108] may be configured for causing convergence of some of the light emissions [202], [1002] of the semiconductor light-emitting devices [104], [904] to form the converged light emissions [212], [412], [1012], [1212] as having a HWHM being about 20 degrees.

In some examples, the example [100] of the lighting system may be configured for interchangeably installing either: the first lens module [106] in the lighting module [102] and the fourth lens module [906] in the second lighting module [902]; or the second lens module [306] in the lighting module [102] and the fifth lens module [1106] in the second lighting module [902]. In additional examples, the example [100] of the lighting system may include the first lens module [106] as being integral with the fourth lens module [906], and may include the second lens module [306] as being integral with the fifth lens module [1106]. In further examples [100] of the lighting system (not shown), the first lens module [106] may be integral with a plurality of fourth lens modules [906]; and the second lens module [306] may be integral with a plurality of fifth lens modules [1106]. In additional examples [100] of the lighting system (not shown), the first lens module [106] and the plurality of fourth lens modules [906], or the second lens module [306] and the plurality of fifth lens modules [1106], may collectively be integrated in a row, or in a plurality of rows, or in a circle. As further examples [100] of the lighting system (not shown), a plurality of the fourth lens modules [906], being within a range of between one and about twenty, or being within a range of between one and about one hundred, may be integrated together with the first lens module [106]. As other examples [100] of the lighting system (not shown), a plurality of the fifth lens modules [1106], being within a range of between one and about twenty, or being within a range of between one and about one hundred, may be integrated together with the second lens module [306].

Figure 23:
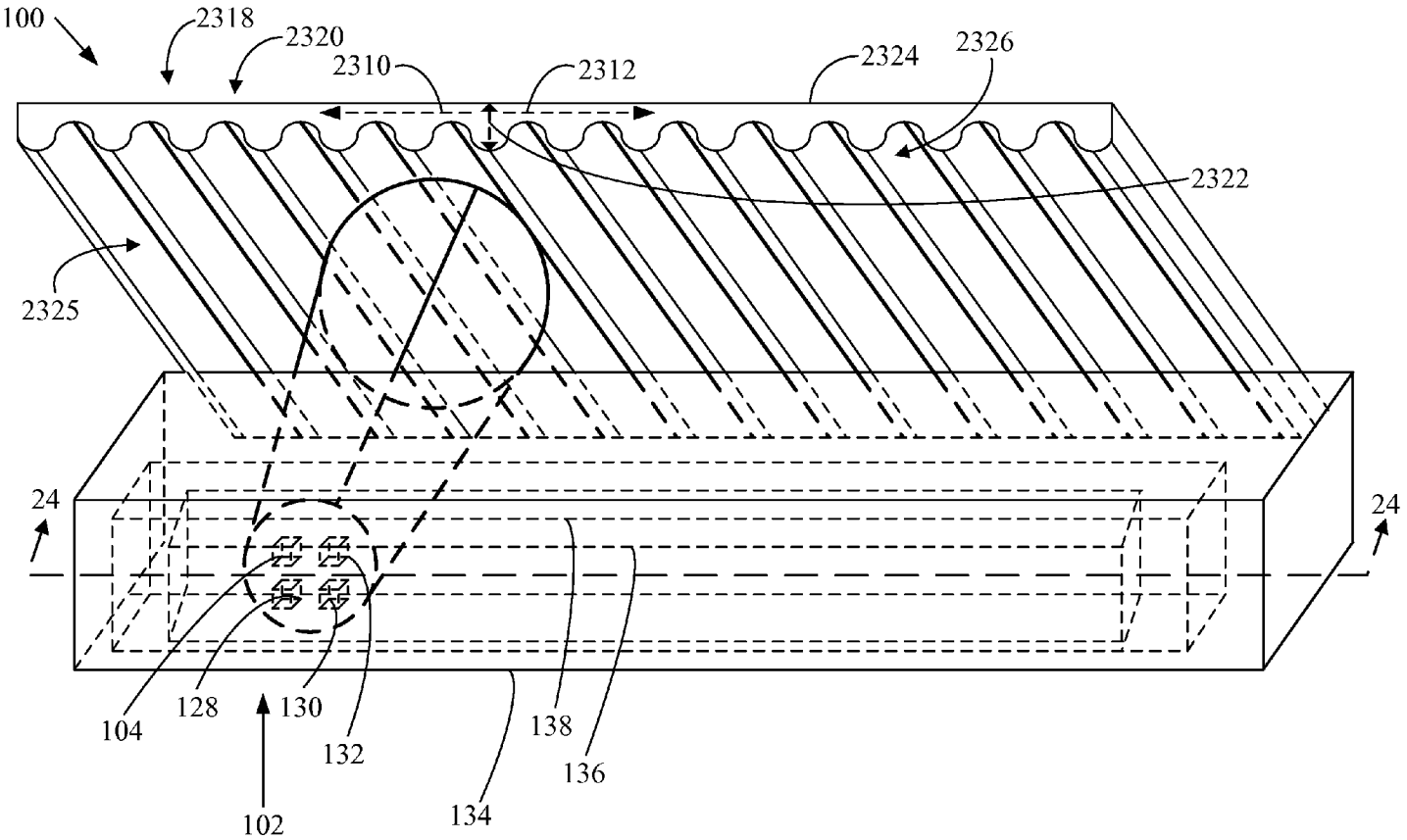
FIG. 23 is a perspective bottom view showing an example of a seventh lens module that may be included in the example [100] of an implementation of a lighting system.
Figure 24:
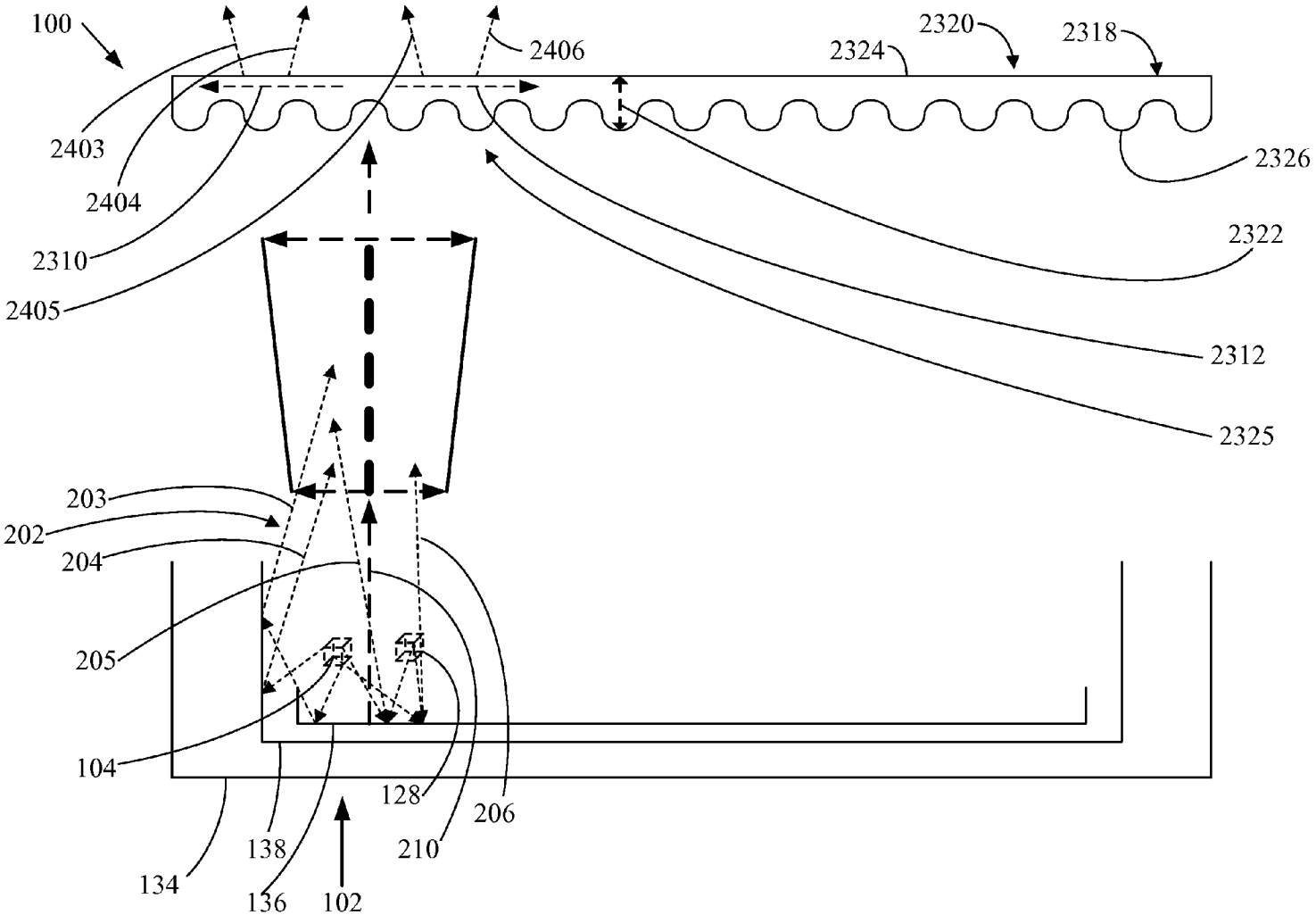
FIG. 24 is a cross-sectional side view taken along the line 24-24, showing the example of the seventh lens module that may be included in the example [100] of the lighting system.

FIG. 23 is a perspective bottom view showing an example of a seventh lens module that may be included in the example [100] of an implementation of a lighting system. FIG. 24 is a cross-sectional side view taken along the line 24-24, showing the example of the seventh lens module that may be included in the example [100] of the lighting system. In some examples [100], the lighting system may include a seventh lens module [2318] including a third diverging lens [2320] having a seventh lens axis [2322], the third diverging lens [2320] being configured for causing divergence of some of the converged light emissions [212], [412] away from the seventh lens axis [2322] by a seventh HWHM represented by each of the arrows [2310], [2312], being different than the third HWHM represented by each of the arrows [510], [512], to form additional diverged light emissions represented by the arrows [2403], [2404], [2405], [2406] that may diverge away from the central light emission axis [210]. As examples, the third diverging lens [2320] may have a seventh light output surface [2324] being spaced apart along the seventh lens axis [2322] from a seventh light input surface [2326], the seventh light input surface [2326] including a third lens screen [2325] having lenticular or micro-prismatic features. In examples, the example [100] of the lighting system may be configured for detachably installing the first lens module [106] or the second lens module [306] in the lighting module [102] between the semiconductor light-emitting device [104] and the seventh lens module [2318]; and the example [100] of the lighting system may be configured for aligning the first lens axis [216] or the second lens axis [416] with the central light emission axis [210] and the seventh lens axis [2322].

Figure 25:
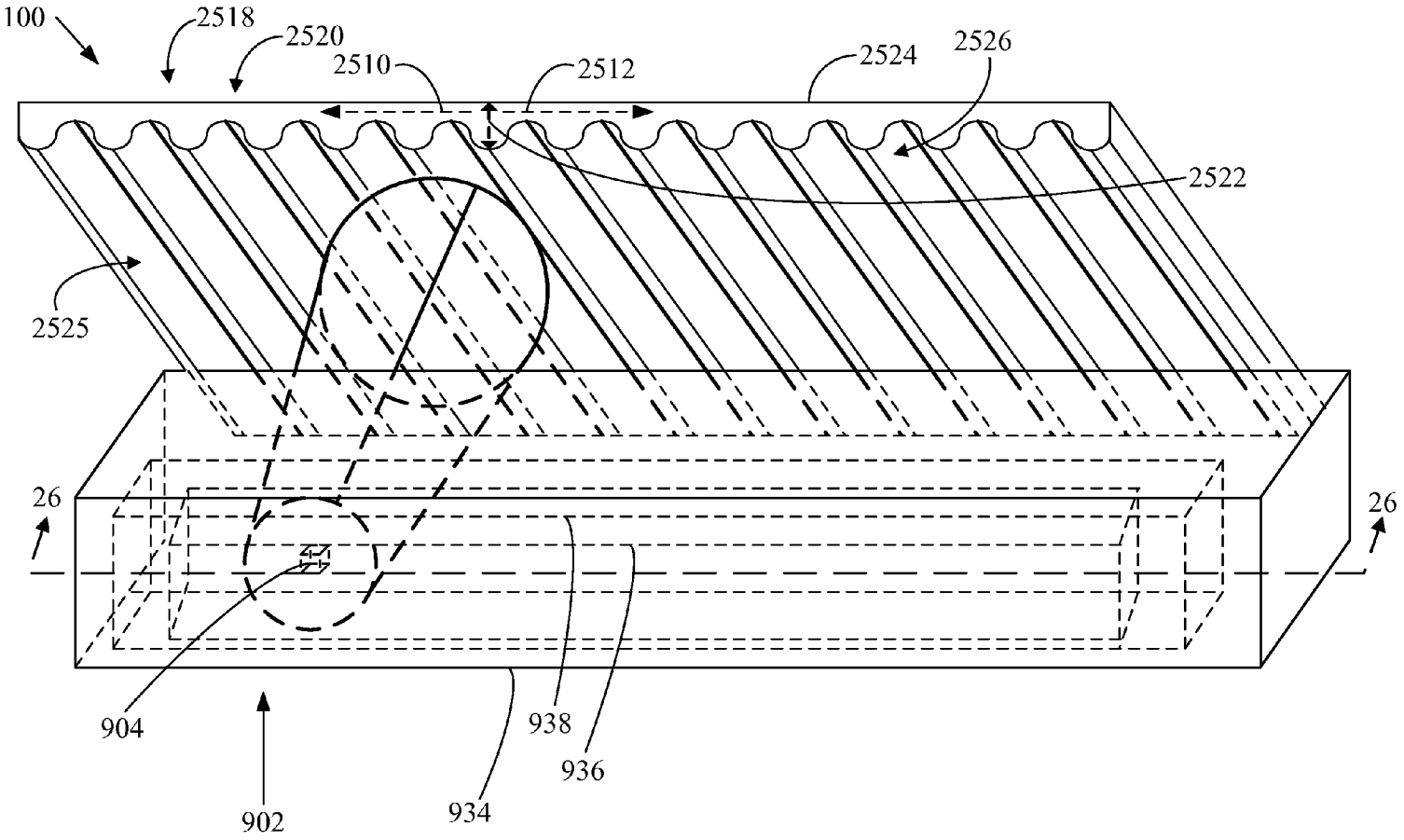
FIG. 25 is a perspective bottom view showing an example of an eighth lens module that may be included in the example [100] of an implementation of a lighting system.
Figure 26:
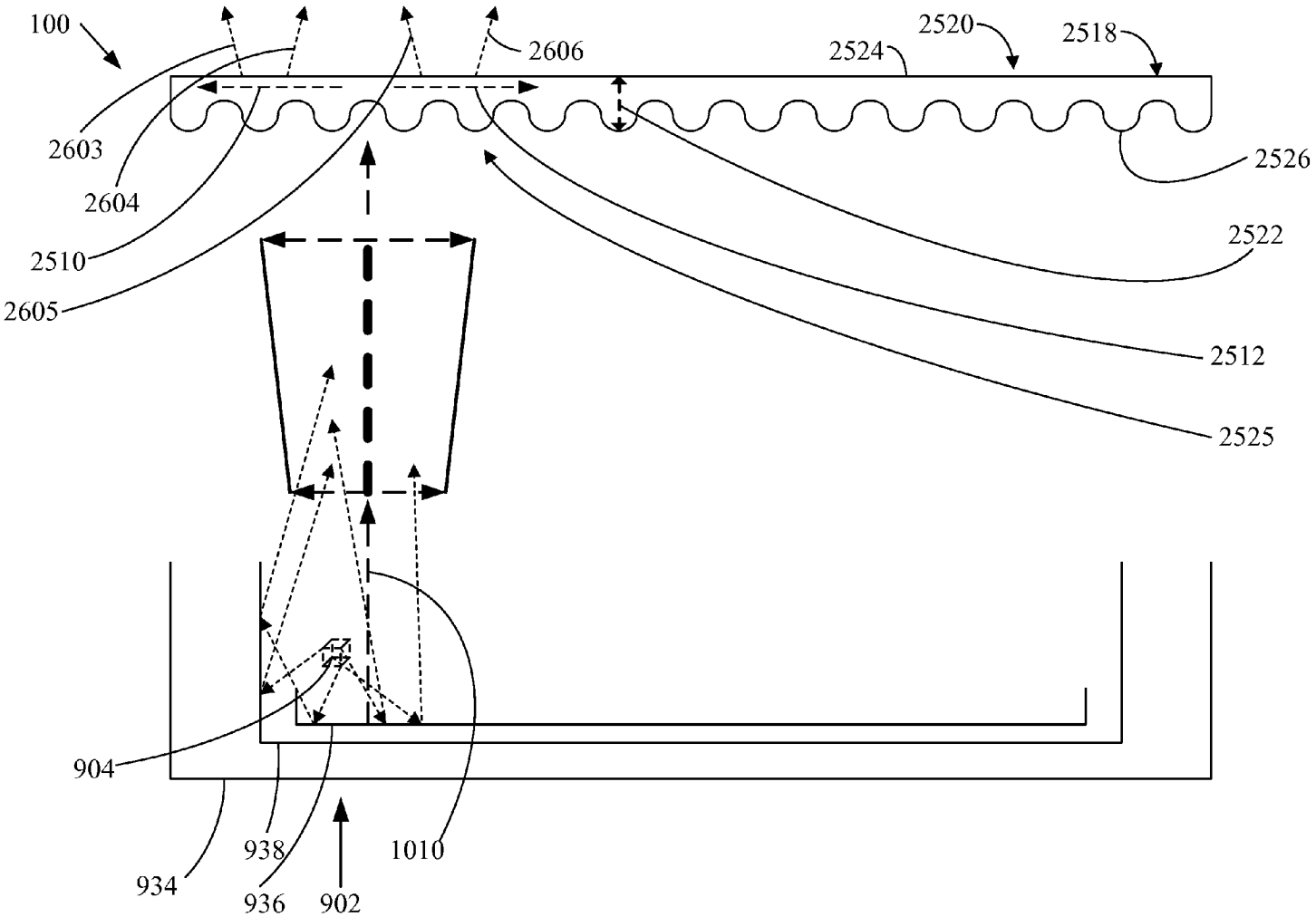
FIG. 26 is a cross-sectional side view taken along the line 26-26, showing the example of the eighth lens module that may be included in the example [100] of the lighting system.

FIG. 25 is a perspective bottom view showing an example of an eighth lens module that may be included in the example [100] of an implementation of a lighting system. FIG. 26 is a cross-sectional side view taken along the line 26-26, showing the example of the eighth lens module that may be included in the example [100] of the lighting system. In some examples [100], the lighting system may include an eighth lens module [2518] including a fourth diverging lens [2520] having an eighth lens axis [2522], the fourth diverging lens [2520] being configured for causing divergence of some of the converged light emissions [1012], [1212] away from the eighth lens axis [2522] by an eighth HWHM represented by each of the arrows [2510], [2512], being different than the sixth HWHM represented by each of the arrows [1310], [1312], to form additional diverged light emissions represented by arrows [2603], [2604], [2605], [2606] that may diverge away from the second central light emission axis [1010]. As examples, the fourth diverging lens [2520] may have an eighth light output surface [2524] being spaced apart along the eighth lens axis [2522] from an eighth light input surface [2526], the eighth light input surface [2526] including a fourth lens screen [2525] having lenticular or microprismatic features. In examples, the example [100] of the lighting system may be configured for detachably installing the fourth lens module [906] or the fifth lens module [1106] in the second lighting module [902] between the second semiconductor light-emitting device [904] and the eighth lens module [2518]; and the example [100] of the lighting system may be configured for aligning the fourth lens axis [1016] or the fifth lens axis [1216] with the second central light emission axis [1010] and the eighth lens axis [2522].

In some examples, the example [100] of the lighting system may be configured for interchangeably installing either: the third lens module [118] in the lighting module [102] and the sixth lens module [918] in the second lighting module [902]; or the seventh lens module [2318] in the lighting module [102] and the eighth lens module [2518] in the second lighting module [902]. In further examples [100] of the lighting system, the third lens module [118] may be integral with the sixth lens module [918], and the seventh lens module [2318] may be integral with the eighth lens module [2518]. In further examples [100] of the lighting system (not shown), the third lens module [118] may be integral with a plurality of sixth lens modules [918]; and the seventh lens module [2318] may be integral with a plurality of eighth lens modules [2518]. In additional examples [100] of the lighting system (not shown), the third lens module [118] and the plurality of sixth lens modules [918], or the seventh lens module [2318] and the plurality of eighth lens modules [2518], may collectively be integrated in a row, or in a plurality of rows, or in a circle. As further examples [100] of the lighting system (not shown), a plurality of the sixth lens modules [918], being within a range of between one and about twenty, or being within a range of between one and about one hundred, may be integrated together with the third lens module [118]. As other examples [100] of the lighting system (not shown), a plurality of the seventh lens modules [2318], being within a range of between one and about twenty, or being within a range of between one and about one hundred, may be integrated together with the eighth lens module [2518].

In additional examples [100] of the lighting system, the third HWHM of the third lens module [118] may be the same as the sixth HWHM of the sixth lens module [918]; and the seventh HWHM of the seventh lens module [2318] may be the same as the eighth HWHM of the eighth lens module [2518]. As other examples, the example [100] of the lighting system may be further configured for interchangeably installing either: the first lens module [106] in the lighting module [102] and the fourth lens module [906] in the second lighting module [902]; or the second lens module [306] in the lighting module [102] and the fifth lens module [1106] in the second lighting module [902]. In additional examples [100] of the lighting system [100], the first lens module [106] may be integral with the fourth lens module [906], and the second lens module [306] may be integral with the fifth lens module [1106].

In some examples [100] of the lighting system, the first diverging lens [120] may be integral with the second diverging lens [920]; and the example [100] of the lighting system may be configured for positioning the semiconductor light-emitting device [104] as being spaced apart on a longitudinal axis [928] away from the second semiconductor light-emitting device [904], and the first and second diverging lenses [120], [920] may be integrally configured for causing divergence of some of the converged light emissions [212], [412], [1012], [1212] away from the central light emission axes [210], [1010] in directions that are spaced apart from directions along the longitudinal axis [928]. In additional examples [100] of the lighting system, each of the first and second diverging lenses [120], [920] may be configured for causing divergence of some of the converged light emissions [212], [412], [1012], [1212] away from the central light emission axes [210], [1010] in directions that are spaced apart from directions along the longitudinal axis [928] by an HWHM being: about 4 degrees; or about 10 degrees; or about 15 degrees; or about 25 degrees; or about 30 degrees.

In some examples [100] of the lighting system, the first, second, third and fourth converging lenses [108], [308], [908], and [1108] may respectively be configured for forming the converged light emissions [212], [412], [1012], [1212] as having the first, second, fourth, and fifth HWHM being within a range of between about 2 degrees and about 5 degrees; and the first and second diverging lenses [120], [920] may be configured for causing divergence of some of the converged light emissions [212], [412], [1012], [1212] away from the central light emission axes [210], [1010] in directions that are spaced apart from directions along the longitudinal axis [928] by an HWHM being within a range of between about 2 degrees and about 6 degrees. Further in those examples [100] of the lighting system, the diverged light emissions may have a cumulative HWHM away from the central light emission axes [210], [1010] in directions that are spaced apart from directions along the longitudinal axis [928] being within a range of between about 4 degrees and about 11 degrees.

In some examples [100] of the lighting system, the first, second, third and fourth converging lenses [108], [308], [908], and [1108] may respectively be configured for forming the converged light emissions [212], [412], [1012], [1212] as having the first, second, fourth, and fifth HWHM being within a range of between about 15 degrees and about 25 degrees; and the first and second diverging lenses [120], [920] may be configured for causing divergence of some of the converged light emissions [212], [412], [1012], [1212]

away from the central light emission axes [210], [1010] in directions that are spaced apart from directions along the longitudinal axis [928] by an HWHM being within a range of between about 25 degrees and about 35 degrees. Further in those examples [100] of the lighting system, the diverged light emissions may have a cumulative HWHM away from the central light emission axes [210], [1010] in directions that are spaced apart from directions along the longitudinal axis [928] being within a range of between about 40 degrees and about 60 degrees.

In some examples [100] of the lighting system, the first, second, third and fourth converging lenses [108], [308], [908], and [1108] may respectively be configured for forming the converged light emissions [212], [412], [1012], [1212] as having the first, second, fourth, and fifth HWHM being within a range of between about 15 degrees and about 25 degrees; and the first and second diverging lenses [120], [920] may be configured for causing divergence of some of the converged light emissions [212], [412], [1012], [1212] away from the central light emission axes [210], [1010] in directions that are spaced apart from directions along the longitudinal axis [928] by an HWHM being within a range of between about 2 degrees and about 6 degrees. Further in those examples [100] of the lighting system, the diverged light emissions may have a cumulative HWHM away from the central light emission axes [210], [1010] in directions that are spaced apart from directions along the longitudinal axis [928] being within a range of between about 17 degrees and about 31 degrees.

In some examples [100] of the lighting system, the first, second, third and fourth converging lenses [108], [308], [908], and [1108] may respectively be configured for forming the converged light emissions [212], [412], [1012], [1212] as having the first, second, fourth, and fifth HWHM being within a range of between about 2 degrees and about 5 degrees; and the first and second diverging lenses [120], [920] may be configured for causing divergence of some of the converged light emissions [212], [412], [1012], [1212] away from the central light emission axes [210], [1010] in directions that are spaced apart from directions along the longitudinal axis [928] by an HWHM being within a range of between about 25 degrees and about 35 degrees. Further in those examples [100] of the lighting system, the diverged light emissions may have a cumulative HWHM away from the central light emission axes [210], [1010] in directions that are spaced apart from directions along the longitudinal axis [928] being within a range of between about 27 degrees and about 40 degrees.

In some examples [100] of the lighting system, the first diverging lens [120] may be integral with the second diverging lens [920]; and the example [100] of the lighting system may be configured for positioning the semiconductor light-emitting device [104] as being spaced apart on the longitudinal axis [928] away from the second semiconductor light-emitting device [904], and the first and second diverging lenses [120], [920] may be integrally configured for causing divergence of some of the converged light emissions [212], [412], [1012], [1212] away from the central light emission axes [210], [1010] in directions that are spaced apart from directions being transverse to the longitudinal axis [928]. As an example, the eighth lens module [904] may be rotated by ninety (90) degrees on the second central light emission axis [1010] to accordingly change the directions of divergence of some of the converged light emissions. In additional examples [100] of the lighting system, each of the first and second diverging lenses [120], [920] may be configured for causing divergence of some of the converged light emissions [212], [412], [1012], [1212] away from the central light emission axes [210], [1010] in directions that are spaced apart from directions being transverse to the longitudinal axis [928] by an HWHM being: about 4 degrees; or about 10 degrees; or about 15 degrees; or about 25 degrees; or about 30 degrees.

In some examples [100] of the lighting system, the first, second, third and fourth converging lenses [108], [308], [908], and [1108] may respectively be configured for forming the converged light emissions [212], [412], [1012], [1212] as having the first, second, fourth, and fifth HWHM being within a range of between about 2 degrees and about 25 degrees; and the first and second diverging lenses [120], [920] may be configured for causing divergence of some of the converged light emissions [212], [412], [1012], [1212] away from the central light emission axes [210], [1010] in directions that are spaced apart from directions being transverse to the longitudinal axis [928] by an HWHM being within a range of between about 4 degrees and about 30 degrees. Further in those examples [100] of the lighting system, the diverged light emissions may have a cumulative HWHM away from the central light emission axes [210], [1010] in directions that are spaced apart from directions being transverse to the longitudinal axis [928] being within a range of between about 6 degrees and about 55 degrees.

Figure 28:
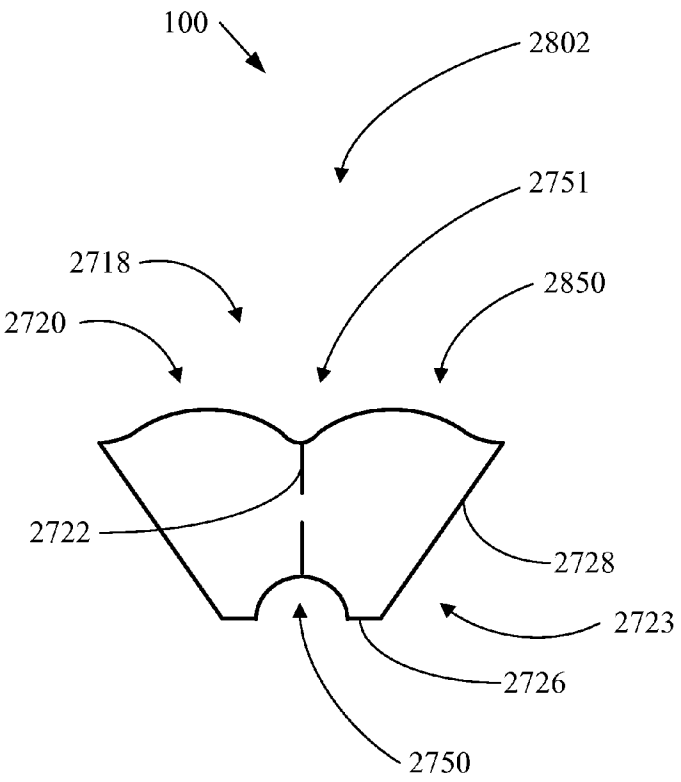
FIG. 28 is a cross-sectional side view taken along the line 28-28, showing the example of the ninth lens module that may be included in the example [100] of the lighting system.
Figure 27:
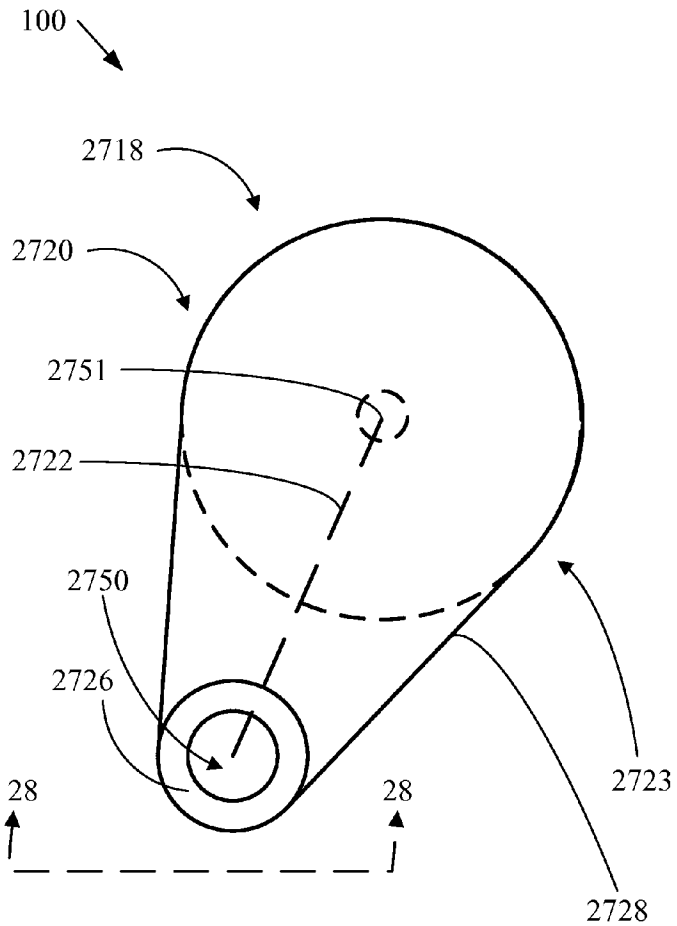
FIG. 27 is a perspective bottom view showing an example of a ninth lens module that may be included in the example [100] of an implementation of a lighting system.

FIG. 27 is a perspective bottom view showing an example of a ninth lens module that may be included in the example [100] of an implementation of a lighting system. FIG. 28 is a cross-sectional side view taken along the line 28-28, showing the example of the ninth lens module that may be included in the example [100] of the lighting system. In some examples, the example [100] of the lighting system may include a ninth lens module [2718] including a fifth diverging lens [2720]. The fifth diverging lens [2720] may have a ninth light output surface [2802] being spaced apart along a ninth lens axis [2722] from a ninth light input surface [2726], the fifth diverging lens [2720] having a fifth total internal reflection side surface [2728] being spaced apart around the ninth lens axis [2722] and having a fifth frusto-conical shape [2723] extending between the ninth light input surface [2726] and the ninth light output surface [2802] of the fifth diverging lens [2720]. Further, for example, the ninth light input surface [2726] of the fifth diverging lens [2720] may include a central cavity [2750] being shaped as a portion of a spheroid. Additionally, for example, the ninth light output surface [2802] of the fifth diverging lens [2720] may include a first raised region [2850] being shaped as a sliced torus having a second central cavity [2751]. In examples, the example [100] of the lighting system may be configured for detachably installing the ninth lens module [2718] in the lighting module [102] between the semiconductor light-emitting device [104] and the third lens module [118]; and the example [100] of the lighting system may be configured for aligning the ninth lens axis [2722] with the central light emission axis [210] and the third lens axis [122]. In further examples [100] of the lighting system, the first raised region [2850] of the fifth diverging lens [2720], being shaped as a sliced torus, may be configured for causing some of the light emissions [202] to pass through the ninth light output surface [2802] at a plurality of spread-apart points. In some examples [100] of the lighting system, the first raised region [2850] of the fifth diverging lens [2720] may be configured for causing some of the light emissions [202] to pass through the ninth light output surface [2802] at spread-apart points being distributed throughout the ninth light output surface [2802].

Figure 29:
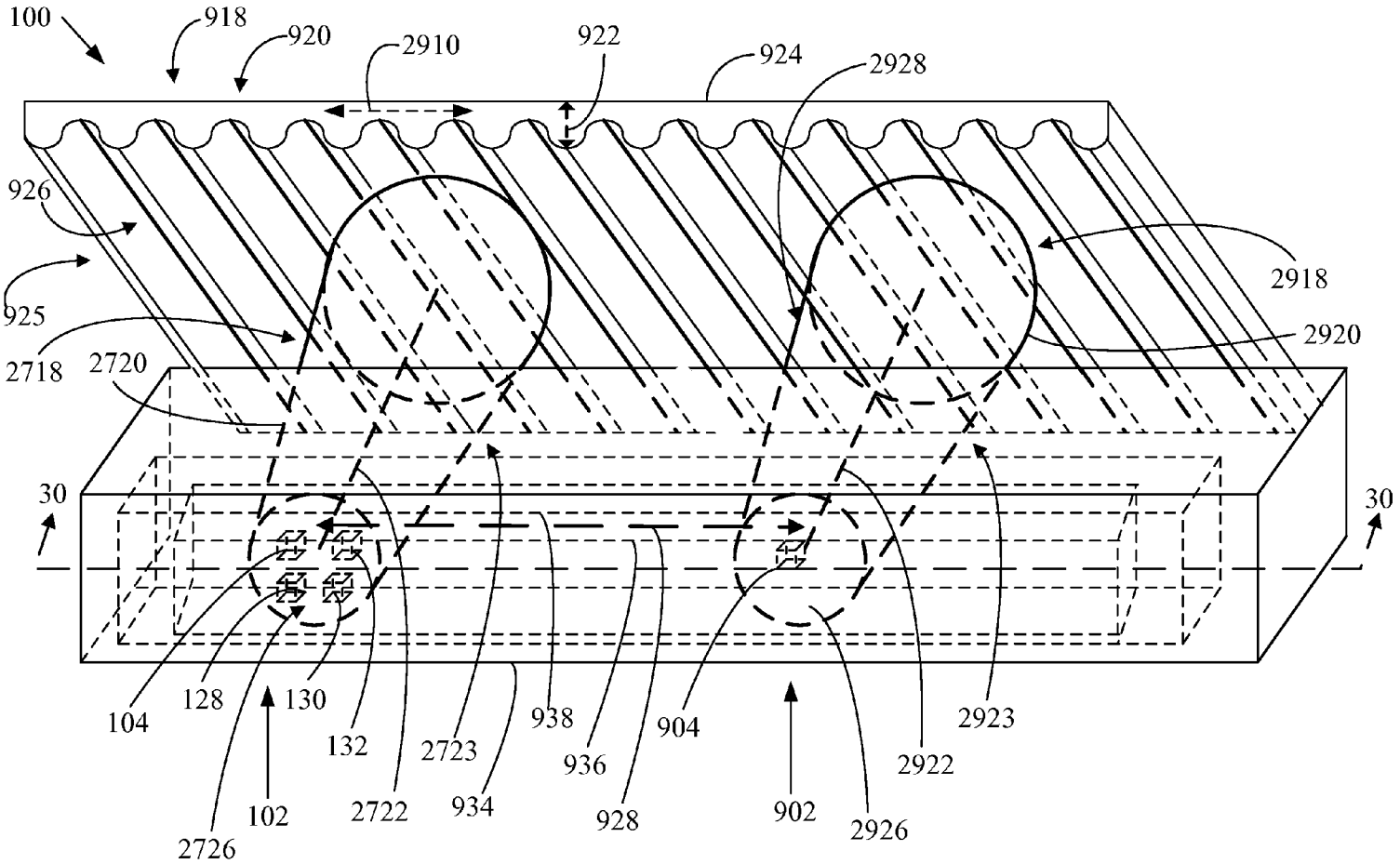
FIG. 29 is a perspective bottom view showing the example of the ninth lens module; and showing an example of a tenth lens module that may be included in the example [100] of an implementation of a lighting system.
Figure 30:
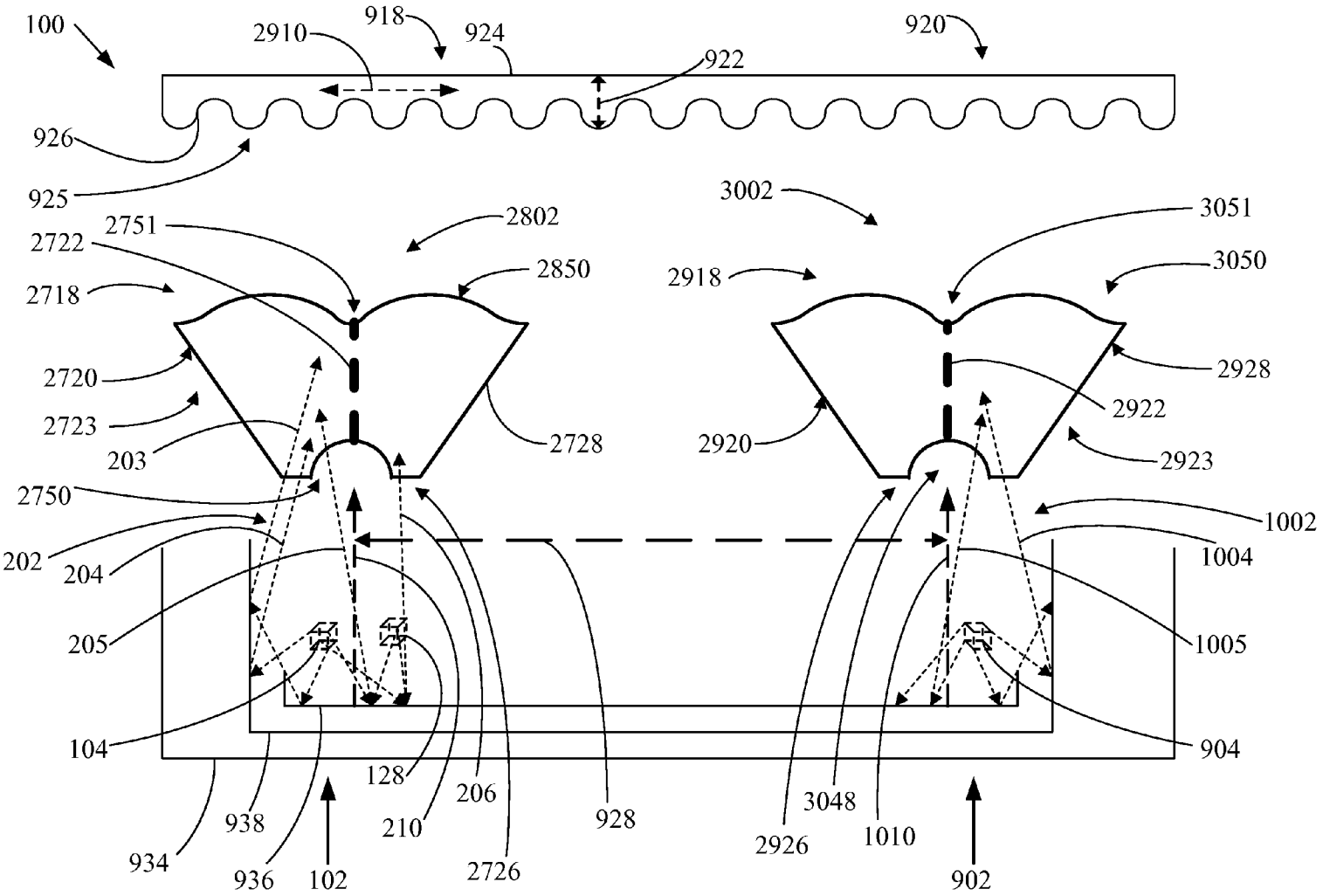
FIG. 30 is a cross-sectional side view taken along the line 30-30, showing the example of the ninth lens module; and showing the example of the tenth lens module that may be included in the example [100] of the lighting system.

FIG. 29 is a perspective bottom view showing the example of the ninth lens module; and showing an example of a tenth lens module that may be included in the example [100] of an implementation of a lighting system. FIG. 30 is a cross-sectional side view taken along the line 30-30, showing the example of the ninth lens module; and showing the example of the tenth lens module that may be included in the example [100] of the lighting system. In some examples, the example [100] of the lighting system may include a tenth lens module [2918] including a sixth diverging lens [2920]. The sixth diverging lens [2920] may have a tenth light output surface [3002] being spaced apart along a tenth lens axis [2922] from a tenth light input surface [2926], the sixth diverging lens [2920] having a sixth total internal reflection side surface [2928] being spaced apart around the tenth lens axis [2922] and having a sixth frusto-conical shape [2923] extending between the tenth light input surface [2926] and the tenth light output surface [3002] of the sixth diverging lens [2920]. Further, for example, the tenth light input surface [2926] of the sixth diverging lens [2920] may include a central cavity [3048] being shaped as a portion of a spheroid. Additionally, for example, the tenth light output surface [3002] of the sixth diverging lens [2920] may include a second raised region [3050] being shaped as a sliced torus having a second central cavity [3051]. In examples, the example [100] of the lighting system may be configured for detachably installing the tenth lens module [2918] in the second lighting module [902] between the second semiconductor light-emitting device [904] and the sixth lens module [918]; and the example [100] of the lighting system may be configured for aligning the tenth lens axis [2922] with the second central light emission axis [1010]. In further examples [100] of the lighting system, the second raised region [3050] of the sixth diverging lens [2920], being shaped as a sliced torus, may be configured for causing some of the light emissions [1002] to pass through the tenth light output surface [3002] at a plurality of spread-apart points. In some examples [100] of the lighting system, the second raised region [3050] of the sixth diverging lens [2920] may be configured for causing some of the light emissions [1002] to pass through the tenth light output surface [3002] at spread-apart points being distributed throughout the tenth light output surface [3002].

In some examples [100], the lighting system may be configured for positioning the semiconductor light-emitting device [104] as being spaced apart on the longitudinal axis [928] away from the second semiconductor light-emitting device [904], for causing the central light emission axis [210] to be spaced apart from the second central light emission axis [1010]. Further, for example, the fifth diverging lens [2720] of the ninth lens module [2718] may be integral with the sixth diverging lens [2920] of the tenth lens module [2918]; and the fifth and sixth diverging lenses [2720], [2920] may be integrally configured for causing some of the light emissions [202], [1002] to pass through the sixth light output surface [924] at a plurality of spread-apart points. In some examples [100] of the lighting system, the first and second raised regions [2850], [3050] of the fifth and sixth diverging lenses [2720], [2920] may be configured for causing some of the light emissions [202], [1002] to pass through the sixth light output surface [924] at a plurality of spread-apart points being distributed throughout the sixth light output surface [924].

As additional examples [100] of the lighting system, the fifth diverging lens [2720] of the ninth lens module [2718], the sixth diverging lens [2920] of the tenth lens module [2918], and the second diverging lens [920] of the sixth lens module [918] may be collectively configured for causing the sixth light output surface [924] to emit a perceived line of light. As an example [100] of the lighting system, the perceived line of light may extend in the directions represented by the arrow [2910]. As another example, the sixth lens module [918] may be rotated by ninety (90) degrees on a central light emission axis [210], [1010] to accordingly change the directions of divergence of some of the converged light emissions. In other examples [100] of the lighting system (not shown), the only lens modules included in a lighting system may be: the ninth lens module [2718]; the tenth lens module [2918]; and the sixth lens module [918]. Further in those other examples [100] of the lighting system, the ninth lens module [2718] may be integral with the tenth lens module [2918]; and as shown in FIGS. 29-30, the sixth lens module [918] may extend in directions that are spaced apart from directions along the longitudinal axis [928] between and beyond both the ninth light output surface [2802] and the tenth light output surface [3002]. Additionally, for example, the third lens module [118] (not shown) may be integral with the sixth lens module [918] as so extending between and beyond the ninth and tenth light output surfaces [2802], [3002]. In additional examples [100] of the lighting system (not shown), the ninth lens module [2718] may be integral with a plurality of tenth lens modules [2918]. In additional examples [100] of the lighting system (not shown), the ninth lens module [2718] and the plurality of tenth lens modules [2918] may collectively be integrated in a row, or in a plurality of rows, or in a circle. As further examples [100] of the lighting system (not shown), a plurality of the tenth lens modules [2918], being within a range of between one and about twenty, or being within a range of between one and about one hundred, may be integrated together with the ninth lens module [2718]. In further examples [100] of the lighting system (not shown), the lighting system may include a plurality of ninth lens modules [2718], each being integral with a tenth lens module [2918]. In those further examples [100] of the lighting system (not shown), each of a plurality of the accordingly integrated light output surfaces [2802], [3002] may include: a different depth of the central cavities [2750], [3048] or of the second central cavities [2751], [3051] along the lens axes [2722], [2922]; a different diameter of the central cavities [2750], [3048] or of the second central cavities [2751], [3051] transversely to the lens axes [2722], [2922]; or a different height of the raised regions [2850], [3050] above the second central cavities [2751], [3051] along the lens axes [2722], [2922].

Figure 31:
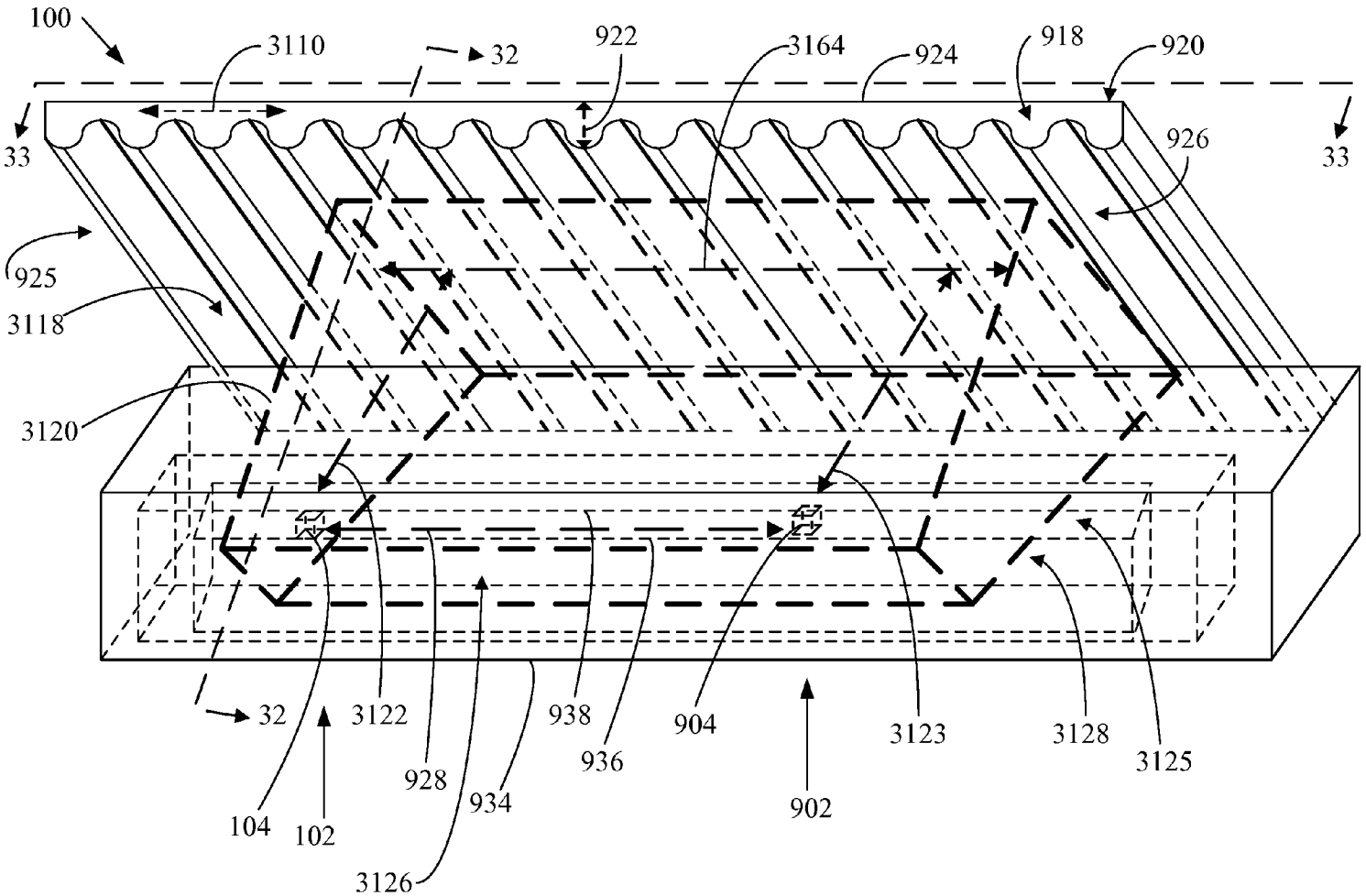
FIG. 31 is a perspective bottom view showing an example of an eleventh lens module that may be included in the example [100] of an implementation of a lighting system.
Figure 32:
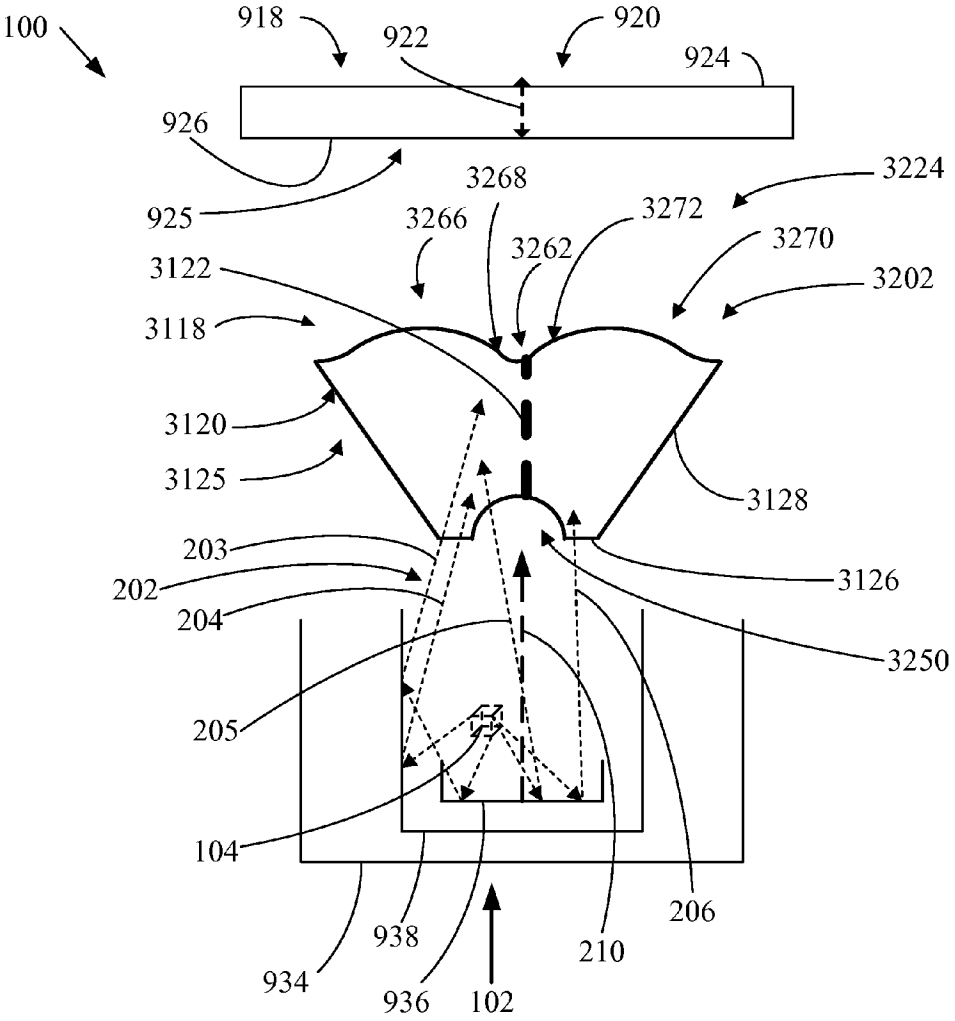
FIG. 32 is cross-sectional view taken along the line 32-32, showing the example of the eleventh lens module that may be included in the example [100] of the lighting system.
Figure 33:
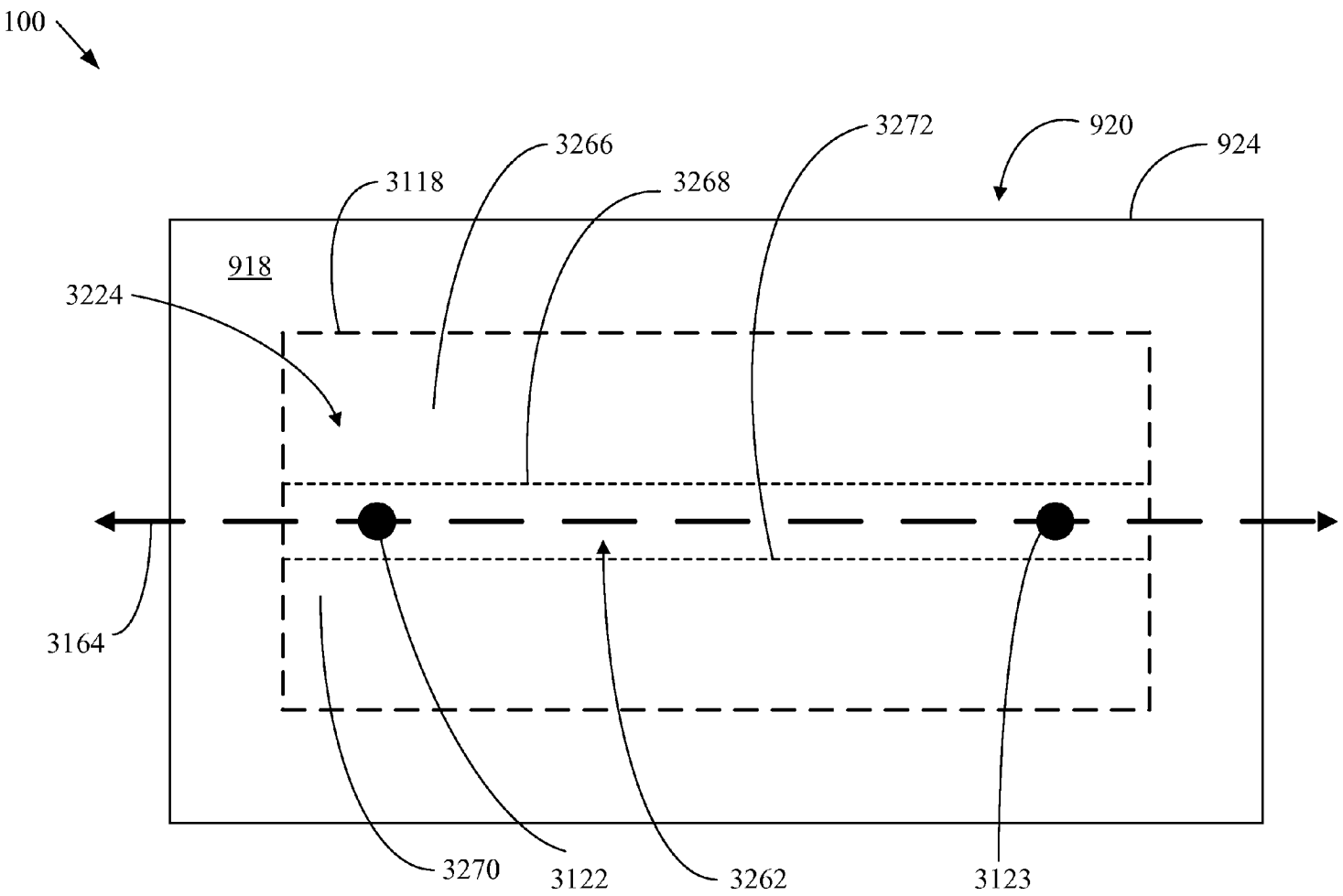
FIG. 33 is a top view taken along the line 33-33, showing the example of the eleventh lens module that may be included in the example [100] of the lighting system.

FIG. 31 is a perspective bottom view showing an example of an eleventh lens module that may be included in the example [100] of an implementation of a lighting system. FIG. 32 is a cross-sectional view taken along the line 32-32, showing the example of the eleventh lens module that may be included in the example [100] of the lighting system. FIG. 33 is a top view taken along the line 33-33, showing the example of the eleventh lens module that may be included in the example [100] of the lighting system. In some examples, the example [100] of the lighting system may include an eleventh lens module [3118] including a seventh diverging lens [3120]. In examples [100] of the lighting system, the seventh diverging lens [3120] may have one lens axis [3122] being spaced apart from another lens axis [3123]. For example, the example [100] of the lighting system may be configured for detachably installing the seventh diverging lens [3120] with the one lens axis [3122] being aligned with the central light emission axis [210] and with the another lens axis [3123] being aligned with the second central light emission axis [1010]. In some examples [100] of the lighting system, the seventh diverging lens [3120] may have a seventh total internal reflection side surface [3128] having a seventh frusto-conical shape [3125] extending between an eleventh light input surface [3126] and an eleventh light output surface [3202], the eleventh light output surface [3202] including a contoured lens screen [3224] having lenticular or microprismatic features. In some examples [100] of the lighting system, the seventh diverging lens [3120] may have the contoured lens screen [3224] as including an array of lenticular toroidal lenses. In other examples (not shown) of the example [100] of the lighting system, the seventh diverging lens [3120] may have the contoured lens screen [3224] as including an array of microprismatic lenses.

In further examples [100] of the lighting system, the eleventh light input surface [3126] may include one cavity [3250] aligned with the one lens axis [3122] and shaped as a portion of a spheroid; and the eleventh light input surface [3126] may include another cavity (not shown) aligned with the another lens axis [3123] and shaped as a portion of a spheroid. In additional examples [100], the lighting system may be configured for positioning the semiconductor light-emitting device [104] as being spaced apart on the longitudinal axis [928] away from the second semiconductor light-emitting device [904] for causing the central light emission axis [210] to be spaced apart from the second central light emission axis [1010]. Further in those examples [100] of the lighting system, the contoured lens screen [3224] may have a central concave surface [3262], having a lens screen axis [3164] that extends in directions that are similar to and spaced apart from directions along the longitudinal axis [928]. In some examples [100] of the lighting system, the lens screen axis [3164] may intersect the one lens axis [3122] and the another lens axis [3123], the lens axes [3122], [3123] being represented as dots in FIG. 33. As further examples [100] of the lighting system, the contoured lens screen [3224] may have one convex surface [3266] extending in directions along the lens screen axis [3164], and one edge [3268] of the central concave surface [3262] may extend adjacent to the one convex surface [3266] in directions along the lens screen axis [3164]. In additional examples [100] of the lighting system, the contoured lens screen [3224] may have another convex surface [3270] extending in directions along the lens screen axis [3164], and another edge [3272] of the central concave surface [3262] may extend adjacent to the another convex surface [3270] in directions along the lens screen axis [3164]. In other examples [100] of the lighting system, the contoured lens screen [3224] may be configured for causing divergence of some of the converged light emissions [212], [412], [1012], [1212] away from the lens screen axis [3164].

In some examples [100] of the lighting system, the eleventh lens module [3118] may be configured for causing some of the light emissions [202], [1002] to pass through the contoured lens screen [3224] at a plurality of spread-apart points. In some examples [100] of the lighting system, the eleventh lens module [3118] may be configured for causing some of the light emissions [202], [1002] to pass through the contoured lens screen [3224] at spread-apart points being distributed throughout the contoured lens screen [3224]. As additional examples [100] of the lighting system, the seventh diverging lens [3120] of the eleventh lens module [3118] and the second diverging lens [920] of the sixth lens module [918] may be collectively configured for causing the sixth light output surface [924] to emit a perceived line of light. As an example [100] of the lighting system, the perceived line of light may extend in the directions represented by the arrow [3110]. As another example, the sixth lens module [918] may be rotated by ninety (90) degrees on a central light emission axis [210], [1010] to accordingly change the directions of divergence of some of the converged light emissions. In other examples [100] of the lighting system (not shown), the only lens modules included in a lighting system may be: the eleventh lens module [3118]; and the sixth lens module [918]. Further in those other examples [100] of the lighting system, as shown in FIGS. 31-33, the sixth lens module [918] may extend in directions that are spaced apart from directions along the longitudinal axis [928] between and beyond both the one lens axis [3122] and the another lens axis [3123]. Additionally, for example, the third lens module [118] (not shown) may be integral with the sixth lens module [918] as so extending between and beyond the lens axes [3122], [3123]. In additional examples [100] of the lighting system (not shown), the eleventh lens module [3118] may include the seventh diverging lens [3120] as having one or more further lens axes being spaced apart along the longitudinal axis [928] in addition to the one lens axis [3122] and the another lens axis [3123], and the eleventh lens module [3118] may be configured for being aligned with one or more further central light emission axes of additional semiconductor light-emitting devices in addition to the central light emission axes [210], [1010]. As additional examples, the example [100] of the lighting system may include one or more additional eleventh lens modules [3118]. In those additional examples [100] of the lighting system (not shown), each of a plurality of the light output surfaces [3202] may include: a different depth of the central cavity [3250] or of the central concave surface [3262] along the lens axes [3122], [3123]; a different diameter of the central cavity [3250] or of the central concave surface [3262] transversely to the lens axes [3122], [3123]; or a different height of the convex surfaces [3266], [3270] above the central concave surface [3262] along the lens axes [3122], [3123].

In other examples [100], the lighting system may include the housing [934]. As examples [100] of the lighting system, the housing [934] may be configured for positioning the lighting module [102] for emission of the light emissions [202] from the semiconductor light-emitting device [104] along the central light emission axis [210]; and the housing [934] may be configured for positioning the second lighting module [902] for emission of the further light emissions [1002] from the second semiconductor light-emitting device [904] along the second central light emission axis [1010]. Further in those examples, the example [100] of the lighting system may include the carrier [936]. Additionally in those examples [100] of the lighting system, the carrier [936] may be configured for positioning the eleventh lens module [3118] in the housing [934] with the one lens axis [3122] being aligned with the central light emission axis [210] and with the another lens axis [3123] being aligned with the second central light emission axis [1010]. Additionally in those examples, the example [100] of the lighting system may include the primary visible light reflector [938]. In those examples [100] of the lighting system, the primary visible light reflector [938] may be configured for being positioned between the housing [934] and the carrier [936], and the primary visible light reflector [938] may be configured for redirecting some of the light emissions [202] of the semiconductor light-emitting device [104] along the central light emission axis [210], and the primary visible light reflector [938] may be configured for redirecting some of the further light emissions [1002] of the second semiconductor light-emitting device [904] along the second central light emission axis [1010].

Figure 34:
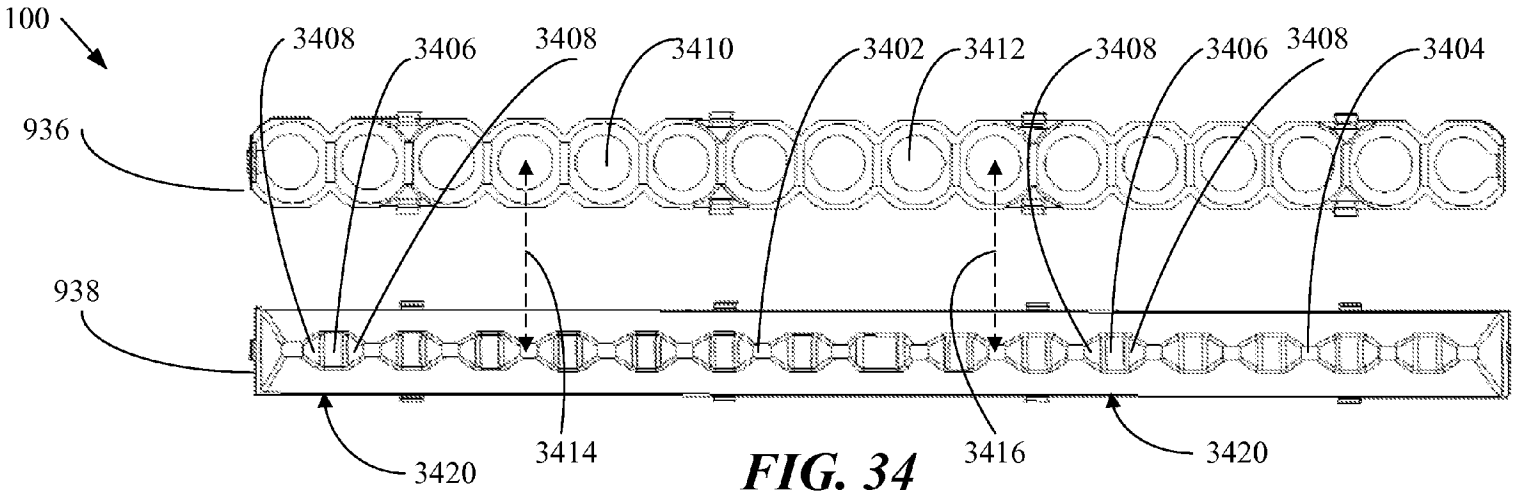
FIG. 34 is a top view showing examples of the carrier and the primary visible light reflector that may be included in the example [100] of an implementation of a lighting system.
Figure 35:
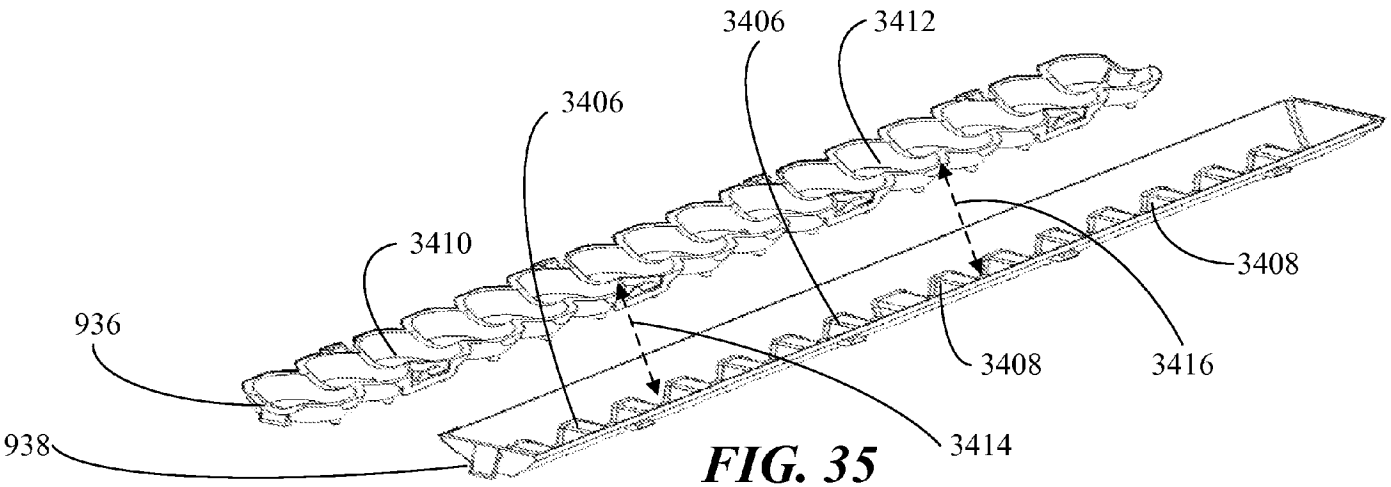
FIG. 35 is a perspective view showing the examples of the carrier and the primary visible light reflector as shown in FIG. 34.
Figure 36:
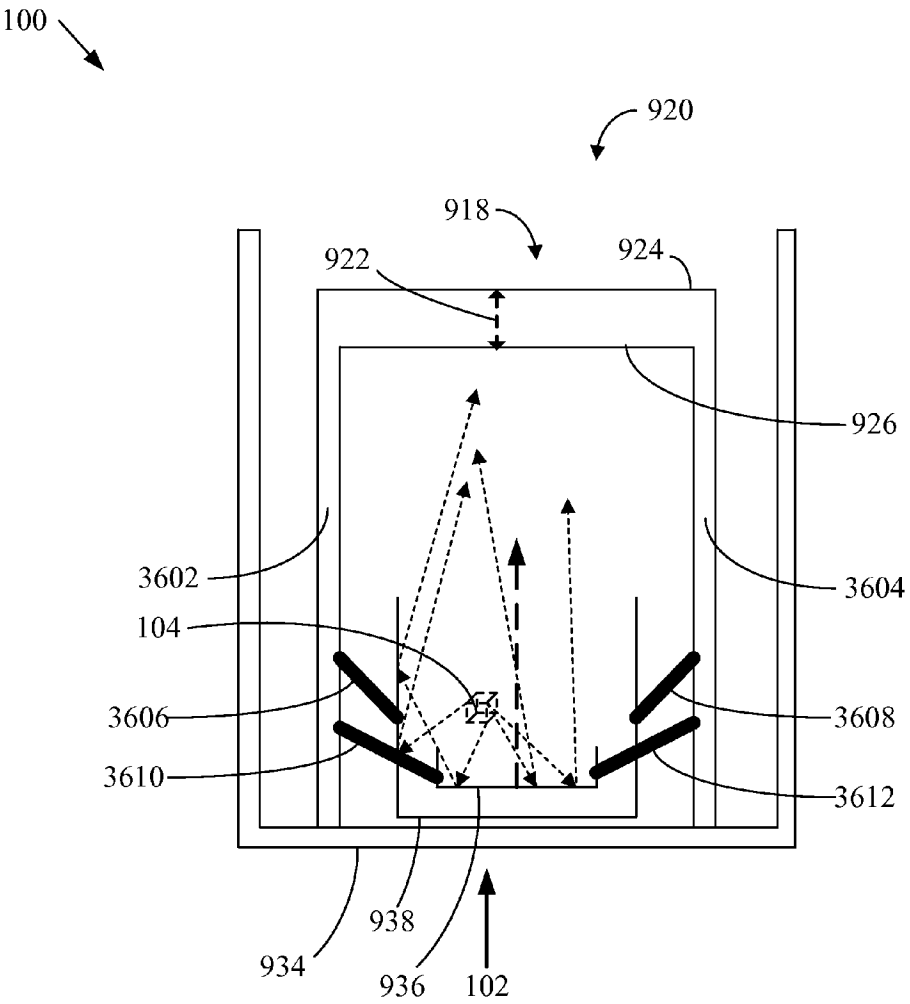
FIG. 36 is a schematic cross-sectional view of the examples [100] of the lighting system shown in FIGS. 34-35.

FIG. 34 is a top view showing examples of the carrier [136], [936] and the primary visible light reflector [138], [938] that may be included in the example [100] of an implementation of a lighting system. FIG. 35 is a perspective view showing the examples of the carrier [136], [936] and the primary visible light reflector [138], [938] as shown in FIG. 34. FIG. 36 is a schematic cross-sectional view of the examples [100] of the lighting system shown in FIGS. 34-35. As shown in this example [100] of the lighting system, the primary visible light reflector [938] may include a plurality of apertures [3402], [3404] being spaced apart in a row extending in directions that are spaced apart from directions along the longitudinal axis [928] (not shown) for receiving light emissions [202], [1002] from semiconductor light-emitting devices [104], [904] (not shown) being positioned underneath the primary visible light reflector [938] with their central light emission axes [210], [1010] aligned with the apertures [3402], [3404]. As an example, the primary visible light reflector [938] may include sixteen of the apertures [3402], [3404] for receiving light emissions [202], [1002] from sixteen corresponding semiconductor light-emitting devices [104], [904] (not shown), one of which being positioned with its central light emission axis [210], [1010] aligned with each one of the sixteen apertures [3402], [3404]. In other examples [100] of the lighting system (not shown), the primary visible light reflector [938] may include a different quantity of the apertures [3402], [3404] for receiving light emissions [202], [1002] from a corresponding different number of semiconductor light-emitting devices [104], [904] (not shown), one of which being positioned with its central light emission axis [210], [1010] aligned with each one of the apertures [3402], [3404]. In other examples [100] of the lighting system, the primary visible light reflector [938] may include a quantity of the apertures [3402], [3404] being within a range of between one and about twenty apertures, or being within a range of between one and about one hundred apertures. Further, for example, more than one semiconductor light-emitting device [104], [904] may be positioned with its central light emission axis [210], [1010] being aligned with each one of the apertures [3402], [3404]. In examples [100] of the lighting system, the primary visible light reflector [938] may include each of the apertures [3402], [3404] as being located between a pair of reflector elements [3420]. In examples [100] of the lighting system, each of the reflector elements [3420] may include a top reflective surface [3406] being oriented to reflect light emissions [202], [1002] along the central light emission axes [210], [1010], the top reflective surface [3406] being located between two tangential reflective surfaces [3408]. As further shown in this example [100] of the lighting system, the carrier [936] may include a plurality of apertures [3410], [3412] being spaced apart in a row extending in directions that are spaced apart from directions along the longitudinal axis [928] (not shown) for receiving light emissions [202], [1002] from semiconductor light-emitting devices [104], [904] (not shown) with their central light emission axes [210], [1010] being aligned with the apertures [3410], [3412]. In these examples [100] of the lighting system, the carrier [936] may be placed over the primary visible light reflector [938] with the apertures [3410], [3412] being aligned with the apertures [3402], [3404] as represented by the arrows [3414], [3416], and the semiconductor light-emitting devices [104], [904] may be placed below the primary visible light reflector [938]. Further, for example, the apertures [3410], [3412] of the carrier [936] may be configured and shaped for receiving and holding in place the lens modules [106], [306], [906], [1106], [1506], [1706], [1906], [2106], [2718], and [2918]. As an example, the carrier [936] may include sixteen of the apertures [3410], [3412] for receiving light emissions [202], [1002] from sixteen corresponding semiconductor light-emitting devices [104], [904] (not shown), one of which being positioned with its central light emission axis [210], [1010] aligned with each one of the sixteen apertures [3410], [3412]. In other examples [100] of the lighting system (not shown), the carrier [936] may include a different quantity of the apertures [3410], [3412] for receiving light emissions [202], [1002] from a corresponding different number of semiconductor light-emitting devices [104], [904] (not shown), one of which being positioned with its central light emission axis [210], [1010] aligned with each one of the apertures [3410], [3412]. In some examples [100] of the lighting system, the carrier [936] may include a quantity of the apertures [3410], [3412] being within a range of between one and about twenty apertures, or being within a range of between one and about one hundred apertures. Further, for example, more than one semiconductor light-emitting device [104], [904] may be positioned with its central light emission axis [210], [1010] being aligned with each one of the apertures [3410], [3412]. In these examples [100] of the lighting system, the primary visible light reflector [938] may be configured for being positioned between the housing [934] (not shown) and the carrier [936]. Further, for example, the carrier [936] may be configured for redirecting some of the light emissions [202], [1002] of the semiconductor light-emitting devices [104], [904] (not shown) along the central light emission axes [210], [1010]. In other examples [100], the lighting system may include the carrier [936] being configured for being placed in direct contact with the housing [934]. In other examples [100] of the lighting system (not shown), the primary visible light reflector [938] and the carrier [936] may include their respective apertures [3402], [3404], [3410], [3412] being spaced apart in a plurality of rows, or in another formation such as a rectangle or a circle. In further examples [100], the lighting system may include the sixth lens module [918]. Further, for example, the sixth lens module [918] may have walls [3602], [3604] reaching downward in the housing [934]. Additionally, for example, the walls [3602], [3604] of the sixth lens module [918] may have members [3606], [3608], [3610], [3612] configured for holding the primary visible light reflector [938] and the carrier [936] in place within the housing [934].

Figure 37:
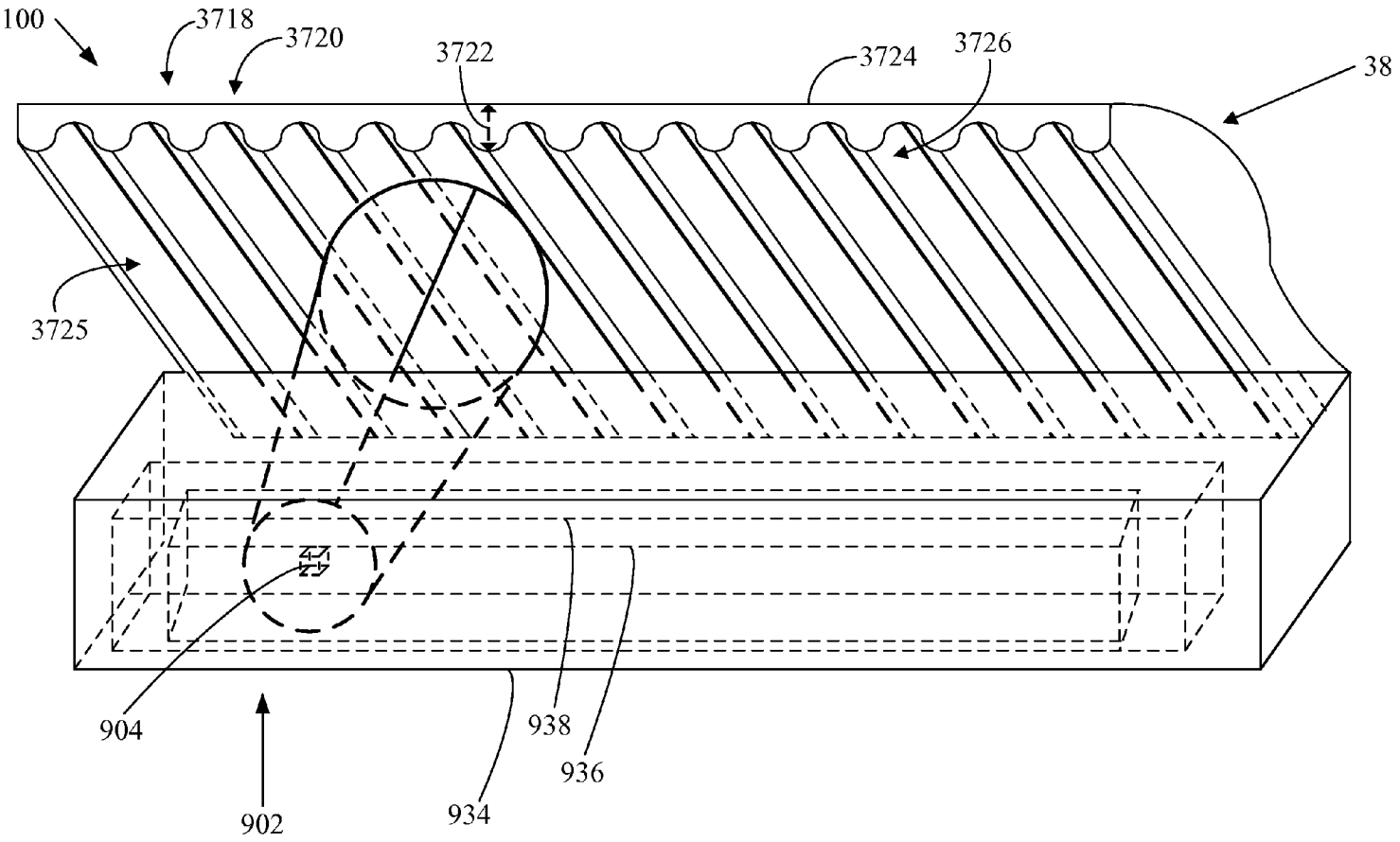
FIG. 37 is a perspective bottom view showing an example of an asymmetric twelfth lens module that may be included in the example [100] of an implementation of a lighting system.
Figure 38:
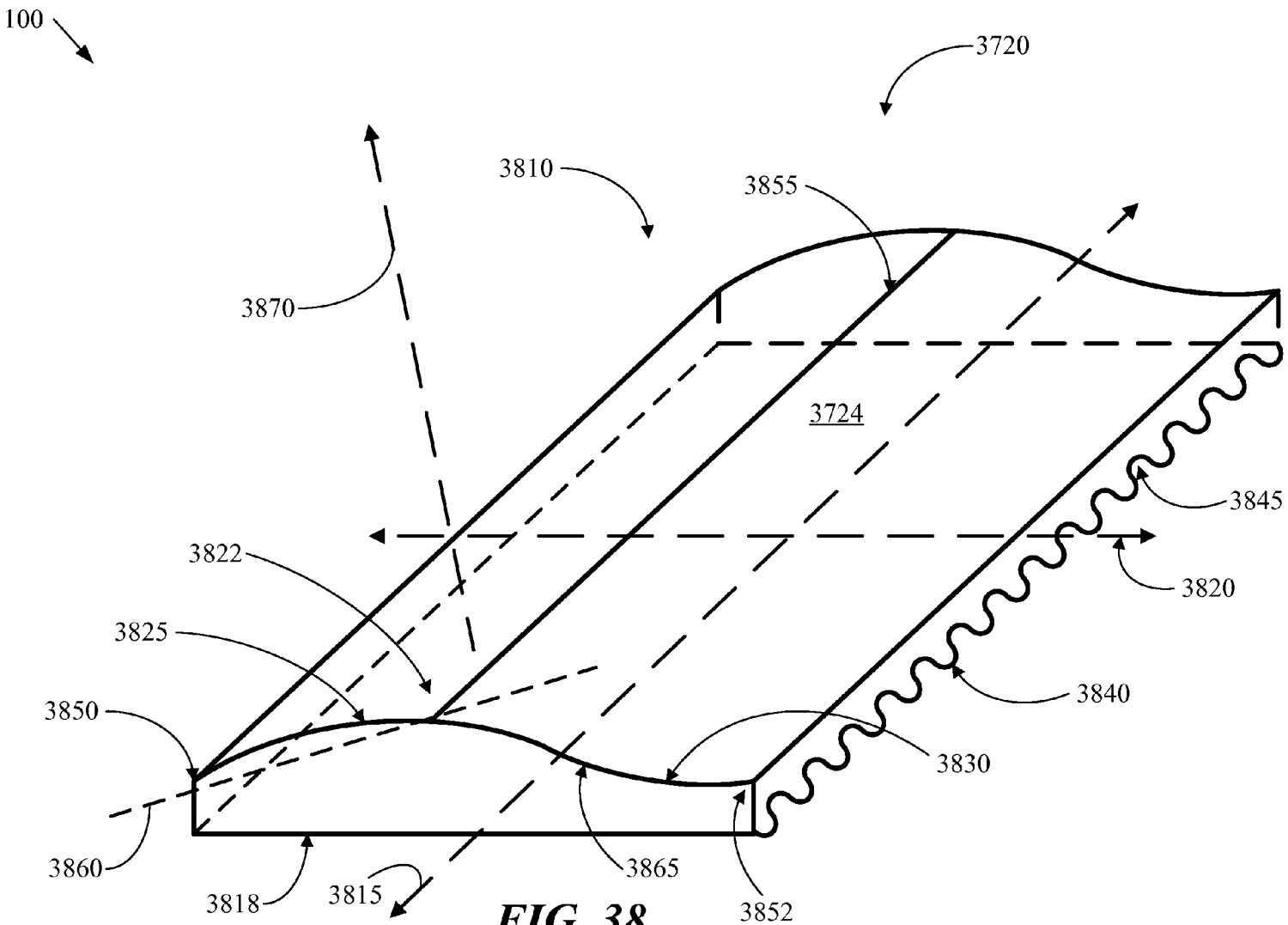
FIG. 38 is a side view taken along the line 38, showing the example of the twelfth lens module including a sixth diverging lens having a twelfth lens axis, that may be included in the example [100] of the lighting system.

FIG. 37 is a perspective bottom view showing an example of an asymmetric twelfth lens module [3718] that may be included in the example [100] of an implementation of a lighting system. FIG. 38 is a side view taken along the line 38, showing the example of the twelfth lens module [3718] including a sixth diverging lens [3720] having a twelfth lens axis [3722], that may be included in the example [100] of the lighting system. As examples, the sixth diverging lens [3720] may have a twelfth light output surface [3724] being spaced apart along the twelfth lens axis [3722] from a twelfth light input surface [3726]. The example [3718] of the twelfth lens module includes a lens body [3810] having the light output surface [3724] spaced apart along the light transmission axis [3722] from a light input surface [3818]. The lens body [3810] has a longitudinal axis [3815] and a lateral axis [3820], where the longitudinal and lateral axes [3815], [3820] are transverse to the light transmission axis [3722]. In the example [3718] of the twelfth lens module, the light input surface [3818] may, in an example, include an array of diverging lenses being configured for causing divergence of light away from the light transmission axis [3722] in directions along the longitudinal axis [3815] of the lens body [3810]. Further in the example [3718] of the twelfth lens module, the light output surface [3724] has an asymmetric curvilinear contour [3822] being formed by a convex region [3825] overlapping in directions along the lateral axis [3820] with a concave region [3830], the asymmetric curvilinear contour [3822] uniformly extending in directions along the longitudinal axis [3815]. Further, for example, the twelfth light input surface [3818] may, as an example, have an array of diverging lenses including a fourth lens screen [3725] having lenticular or microprismatic features. In other examples (not shown) the asymmetric twelfth lens module [3718] may not include an array of diverging lenses at the light input surface [3818]. Further, as examples, the light input surface [3726] of the example [3718] of the twelfth lens module may, for example, have a lens screen [3725] including an array of lenticular toroidal lenses. As another example, the example [3718] of the twelfth lens module may include the light input surface [3726] as having an array of lenticular toroidal lenses including a plurality of convex regions [3840] being interposed between a plurality of concave regions [3845], each of the pluralities of the convex regions [3840] and of the concave region [3845] extending in directions along the lateral axis [3820].

In examples of the example [3718] of the twelfth lens module, the light output surface [3724] may include a first end [3850] being spaced apart along the lateral axis [3820] from a second end [3852]; and the asymmetric curvilinear contour [3822] may extend from the first end [3850] to the second end [3852]. As additional examples of the example [3718] of the twelfth lens module, the convex region [3825] of the asymmetric curvilinear contour [3822] may extend from the first end [3850] of the light output surface [3724] towards the light transmission axis [3722]. Further, for example, the concave region [3830] of the asymmetric curvilinear contour [3822] may extend from the second end [3852] of the light output surface [3724] towards the light transmission axis [3722]. In additional examples of the examples of the example [3718] of the twelfth lens module, the light output surface [3724] may have a ridge [3855] extending in directions along the longitudinal axis [3815] and being located at a greatest distance, in directions along the light transmission axis [3722], of the light output surface [3724] away from the light input surface [3818]. In some examples of the example [3718] of the twelfth lens module, the ridge [3855] may be at a location, in directions along the lateral axis [3820], being between the light transmission axis [3722] and the first end [3850] of the light output surface [3724]. In further examples of the example [3718] of the twelfth lens module, a portion of the light output surface [3724] may extend for a distance in directions along the lateral axis [3820] from the first end [3850] to the light transmission axis [3722], and the ridge [3855] may be on that portion of the light output surface [3724] at a location being at within a range of between about 30% and about 70% along the distance extending from the first end [3850] to the light transmission axis [3722]. In additional examples of the example [3718] of the twelfth lens module, a portion of the light output surface [3724] may extend for a distance in directions along the lateral axis [3820] from the first end [3850] to the light transmission axis [3722], and the ridge [3855] may be on that portion of the light output surface [3724] at a location being at within a range of between about 40% and about 60% along the distance extending from the first end [3850] to the light transmission axis [3722]. As further examples of the example [3718] of the twelfth lens module, the convex region [3825] of the asymmetric curvilinear contour [3822] may have an angle of elevation [3860] at the first end [3850] of the light output surface [3724] measured from the lateral axis [3820] rising to the ridge [3855], and the angle of elevation [3860] may be within a range of between about 30 degrees and about 40 degrees. In some examples of the example [3718] of the twelfth lens module, the convex region [3825] of the asymmetric curvilinear contour [3822] may have an angle of elevation [3860] at the first end [3850] of the light output surface [3724] from the lateral axis [3820] to the ridge [3855], and the angle of elevation [3860] may be within a range of between about 33 degrees and about 37 degrees. As other examples of the example [3718] of the twelfth lens module, the convex region [3825] of the asymmetric curvilinear contour [3822] may have an angle of elevation [3860] at the first end [3850] of the light output surface [3724] from the lateral axis [3820] to the ridge [3855], and the angle of elevation [3860] may be about 35 degrees. In examples of the example [3718] of the twelfth lens module, the asymmetric curvilinear contour [3822] of the light output surface [3724] may have an inflection point [3865] between the convex region [3825] and the concave region [3830]. Further, as examples of the example [3718] of the twelfth lens module, the light output surface [3724] may extend for a distance in directions along the lateral axis [3820] from the first end [3850] to the second end [3852], and the inflection point [3865] may be on the light output surface [3724] at a location being at within a range of between about 40% and about 60% along the distance extending from the first end [3850] to the second end [3852]. In some examples, the example [3718] of the twelfth lens module may be configured for emitting light having a full width half maximum beam width being within a range of between about 7 degrees and about 30 degrees. As another example, examples [3718] of the twelfth lens module may be configured for emitting light having a full width half maximum beam width being within a range of between about 10 degrees and about 20 degrees. In further examples, the example [3718] of the twelfth lens module may be configured for emitting light as being distributed on a planar surface. For example, the example [3718] of the twelfth lens module may be located in a cove near a room ceiling, positioned with the light transmission axis oriented along, e.g. parallel with, the plane of the ceiling. In examples, the example [3718] of the twelfth lens module may asymmetrically shift light away from the light transmission axis [3722] as represented by the arrow [3870]. In examples, examples of the example [3718] of the twelfth lens module may be configured for causing a luminance of light reflected by the planar surface to have a ratio of maximum luminance divided by minimum luminance being about 4 or less. Further, for example, examples of the example [3718] of the twelfth lens module may be configured for causing a luminance of light reflected by the planar surface to have a ratio of maximum luminance divided by minimum luminance being within a range of between about 4.0 and about 1.8. Additionally, for example, the examples [3718] of the twelfth lens module may be configured for causing a luminance of light reflected by the planar surface to have a ratio of average luminance divided by minimum luminance being about 2 or less. In other examples, examples of the example [3718] of the twelfth lens module may be configured for causing a luminance of light reflected by the planar surface to have a ratio of average luminance divided by minimum luminance being within a range of between about 2.1 and about 1.2. In other examples, where the angle of elevation [3860] is outside the range of between about 30 degrees and about 40 degrees, uniformity of the illumination of a planar surface such as a ceiling or wall by the example [3718] of the twelfth lens module may become degraded. In addition, where the angle of elevation [3860] is outside that range, bands of relative darkness may appear on the illuminated surface, e.g. next to a cove, or in the middle of the illuminated planar surface.

In examples, the example [100] of the lighting system may be configured for detachably installing the fourth lens module [906] or the fifth lens module [1106] in the second lighting module [902] between the second semiconductor light-emitting device [904] and the twelfth lens module [3718]; and the example [100] of the lighting system may be configured for aligning the fourth lens axis [1016] or the fifth lens axis [1216] with the second central light emission axis [1010] and the twelfth lens axis [3722]. In some examples, the example [100] of the lighting system may be configured for interchangeably installing either: a one of the twelfth lens module [3718] in the lighting module [102], and another of the twelfth lens module [3718] in the second lighting module [902]; or the third lens module [118] in the lighting module [102] and the sixth lens module [918] in the second lighting module [902]; or the seventh lens module [2318] in the lighting module [102] and the eighth lens module [2518] in the second lighting module [902]. In further examples [100] of the lighting system, two of the twelfth lens modules [3718] may be integrated together, or additional ones of the twelfth lens module [3718] may further be integrated together. In additional examples [100] of the lighting system (not shown), the plurality of twelfth lens modules [3718] may collectively be integrated in a row, or in a plurality of rows, or in a circle. As further examples [100] of the lighting system (not shown), a plurality of the sixth lens modules [918], being within a range of between one and about twenty, or being within a range of between one and about one hundred, may be integrated together with the twelfth lens module [3718]. As other examples [100] of the lighting system (not shown), a plurality of the seventh lens modules [2318], being within a range of between one and about twenty, or being within a range of between one and about one hundred, may be integrated together with the twelfth lens module [3718].

The examples [100] of lighting systems may generally be utilized in end-use applications where interchangeable lens modules are needed, enabling a lighting system to be easily and repeatedly reconfigured by removal and substitution of lens modules. Further, the examples [100] of lighting systems may generally be utilized in end-use applications where lens modules are needed enabling a lighting system to emit a perceived line of light. The examples of lighting systems that are disclosed herein may also be fabricated and utilized together with the teachings disclosed in the following two commonly-owned U.S. patent applications, the entireties of both of which are hereby incorporated herein by reference: U.S. patent application Ser. No. 14/636,204 filed on Mar. 3, 2015, entitled "Lighting Systems Including Lens Modules For Selectable Light Distribution"; and U.S. patent application Ser. No. 14/636,205 filed on Mar. 3, 2015, entitled "Low-Profile Lighting System Having Pivotable Lighting Enclosure."

While the present invention has been disclosed in a presently defined context, it will be recognized that the present teachings may be adapted to a variety of contexts consistent with this disclosure and the claims that follow. For example, the lighting systems shown in the figures and discussed above can be adapted in the spirit of the many optional parameters described.

What is claimed is:

1. A lighting system, comprising:

a lighting module including a semiconductor light-emitting device configured for emitting light emissions along a central light emission axis;

a first lens module including a first converging lens, the first converging lens being configured for causing convergence of some of the light emissions of the semiconductor light-emitting device to form converged light emissions along the central light emission axis having a first half-width-half-maximum (HWHM), the first converging lens having a first light output surface being spaced apart along a first lens axis from a first light input surface, the first converging lens further having a first total internal reflection side surface being spaced apart around the first lens axis and having a first frusto-conical shape extending between the first light input and output surfaces of the first converging lens;

a second lens module including a second converging lens, the second converging lens being configured for causing convergence of some of the light emissions of the semiconductor light-emitting device to form converged light emissions along the central light emission axis having a second HWHM being different than the first HWHM, the second converging lens having a second light output surface being spaced apart along a second lens axis from a second light input surface, the second converging lens further having a second total internal reflection side surface being spaced apart around the second lens axis and having a second frusto-conical shape extending between the second light input and output surfaces of the second converging lens; and a third lens module including a first diverging lens having a third lens axis, the first diverging lens being configured for causing divergence of some of the converged light emissions away from the third lens axis, the third lens module including:

a lens body having a light output surface spaced apart along a light transmission axis from a light input surface, the lens body having a longitudinal axis and a lateral axis, the longitudinal and lateral axes being transverse to the light transmission axis; the light output surface having an asymmetric curvilinear contour being formed by a convex region overlapping in directions along the lateral axis with a concave region, the asymmetric curvilinear contour uniformly extending in directions along the longitudinal axis;

wherein the lighting system is configured for detachably installing the first lens module or the second lens module in the lighting module between the semiconductor light-emitting device and the third lens module; and wherein the lighting system is configured for aligning the first or second lens axis with the central light emission axis and the third lens axis.

2. The lighting system of claim 1, wherein the light input surface of the third lens module includes an array of diverging lenses being configured for causing divergence of light away from the light transmission axis in directions along the longitudinal axis of the lens body.

3. The lighting system of claim 1, further including:

a second lighting module including a second semiconductor light-emitting device configured for emitting further light emissions along a second central light emission axis;

a fourth lens module including a third converging lens, the third converging lens being configured for causing convergence of some of the light emissions of the second semiconductor light-emitting device to form further converged light emissions along the second central light emission axis having a fourth HWHM, the third converging lens having a fourth light output surface being spaced apart along a fourth lens axis from a fourth light input surface, the third converging lens further having a third total internal reflection side surface being spaced apart around the fourth lens axis and having a third frusto-conical shape extending between the fourth light input and output surfaces of the third converging lens;

a fifth lens module including a fourth converging lens, the fourth converging lens being configured for causing convergence of some of the light emissions of the second semiconductor light-emitting device to form further converged light emissions along the second central light emission axis having a fifth HWHM being different than the fourth HWHM, the fourth converging lens having a fifth light output surface being spaced apart along a fifth lens axis from a fifth light input surface, the fourth converging lens further having a fourth total internal reflection side surface being spaced apart around the fifth lens axis and having a fourth frusto-conical shape extending between the fifth light input and output surfaces of the fourth converging lens; and a sixth lens module including a second diverging lens having a sixth lens axis, the second diverging lens being configured for causing divergence of some of the converged light emissions away from the sixth lens axis, the sixth lens module including:

another lens body having another light output surface spaced apart along another light transmission axis from another light input surface, the another lens body having another longitudinal axis and another lateral axis, the another longitudinal and lateral axes being transverse to the another light transmission axis; the another light output surface having another asymmetric curvilinear contour being formed by another convex region overlapping in directions along the another lateral axis with another concave region, the another asymmetric curvilinear contour uniformly extending in directions along the another longitudinal axis;

wherein the lighting system is configured for detachably installing the fourth lens module or the fifth lens module in the second lighting module between the second semiconductor light-emitting device and the sixth lens module; and wherein the lighting system is configured for aligning the fourth or fifth lens axis with the second central light emission axis and the sixth lens axis.

4. The lighting system of claim 3, wherein the another light input surface of the sixth lens module includes another array of diverging lenses being configured for causing divergence of light away from the another light transmission axis in directions along the another longitudinal axis of the another lens body.

5. The lighting system of claim 2, wherein the light input surface of the third lens module has the array of diverging lenses as including a lens screen having lenticular or micro-prismatic features.

6. The lighting system of claim 5, wherein the light input surface of the third lens module has the lens screen as including an array of lenticular toroidal lenses.

7. The lighting system of claim 6, wherein the light input surface of the third lens module has the array of lenticular toroidal lenses as including a plurality of convex regions being interposed between a plurality of concave regions, each of the pluralities of the convex regions and of the concave regions extending in directions along the lateral axis.

8. The lighting system of claim 1, wherein the light output surface of the third lens module includes a first end being spaced apart along the lateral axis from a second end; and wherein the asymmetric curvilinear contour extends from the first end to the second end.

9. The lighting system of claim 8, wherein the convex region of the asymmetric curvilinear contour of the third lens module extends from the first end of the light output surface towards the light transmission axis.

10. The lighting system of claim 9, wherein the concave region of the asymmetric curvilinear contour of the third lens module extends from the second end of the light output surface towards the light transmission axis.

11. The lighting system of claim 8, wherein the light output surface of the third lens module has a ridge extending in directions along the longitudinal axis and being located at a greatest distance, in directions along the light transmission axis, of the light output surface away from the light input surface.

12. The lighting system of claim 11, wherein the ridge of the third lens module is at a location, in directions along the lateral axis, being between the light transmission axis and the first end of the light output surface.

13. The lighting system of claim 11, wherein a portion of the light output surface of the third lens module extends for a distance in directions along the lateral axis from the first end to the light transmission axis, and wherein the ridge is on the portion of the light output surface at a location being at within a range of between about 30% and about 70% along the distance extending from the first end to the light transmission axis.

14. The lighting system of claim 11, wherein a portion of the light output surface of the third lens module extends for a distance in directions along the lateral axis from the first end to the light transmission axis, and wherein the ridge is on the portion of the light output surface at a location being at within a range of between about 40% and about 60% along the distance extending from the first end to the light transmission axis.

15. The lighting system of claim 11, wherein the convex region of the asymmetric curvilinear contour of the third lens module has an angle of elevation at the first end of the light output surface from the lateral axis to the ridge, and wherein the angle of elevation is within a range of between about 30 degrees and about 40 degrees.

16. The lighting system of claim 11, wherein the convex region of the asymmetric curvilinear contour of the third lens module has an angle of elevation at the first end of the light output surface from the lateral axis to the ridge, and wherein the angle of elevation is within a range of between about 33 degrees and about 37 degrees.

17. The lighting system of claim 11, wherein the convex region of the asymmetric curvilinear contour of the third lens module has an angle of elevation at the first end of the light output surface from the lateral axis to the ridge, and wherein the angle of elevation is about 35 degrees.

18. The lighting system of claim 8, wherein the asymmetric curvilinear contour of the light output surface of the third lens module has an inflection point between the convex region and the concave region.

19. The lighting system of claim 18, wherein the light output surface of the third lens module extends for a distance in directions along the lateral axis from the first end to the second end, and wherein the inflection point is on the light output surface at a location being at within a range of between about 40% and about 60% along the distance extending from the first end to the second end.

20. The lighting system of claim 1, being configured for emitting light having a full width half maximum beam width being within a range of between about 7 degrees and about 30 degrees.

21. The lighting system of claim 1, being configured for emitting light having a full width half maximum beam width being within a range of between about 10 degrees and about 20 degrees.

22. The lighting system of claim 1, being configured for emitting light as being distributed on a planar surface.

23. The lighting system of claim 22, being configured for causing a luminance of light reflected by the planar surface to have a ratio of maximum luminance divided by minimum luminance being about 4 or less.

24. The lighting system of claim 22, being configured for causing a luminance of light reflected by the planar surface to have a ratio of maximum luminance divided by minimum luminance being within a range of between about 4.0 and about 1.8.

25. The lighting system of claim 22, being configured for causing a luminance of light reflected by the planar surface to have a ratio of average luminance divided by minimum luminance being about 2 or less.

26. The lighting system of claim 22, being configured for causing a luminance of light reflected by the planar surface to have a ratio of average luminance divided by minimum luminance being within a range of between about 2.1 and about 1.2.

27. A lens device, comprising:

a lens body having a light output surface spaced apart along a light transmission axis from a light input surface, the lens body having a longitudinal axis and a lateral axis, the longitudinal and lateral axes being transverse to the light transmission axis;

the light input surface including an array of diverging lenses being configured for causing divergence of light away from the light transmission axis in directions along the longitudinal axis of the lens body;

the light output surface having an asymmetric curvilinear contour being formed by a convex region overlapping in directions along the lateral axis with a concave region, the asymmetric curvilinear contour uniformly extending in directions along the longitudinal axis.

28. The lens device of claim 27, wherein the light output surface includes a first end being spaced apart along the lateral axis from a second end; and wherein the asymmetric curvilinear contour extends from the first end to the second end.

29. The lens device of claim 28, wherein the convex region of the asymmetric curvilinear contour extends from the first end of the light output surface towards the light transmission axis.

30. The lens device of claim 29, wherein the concave region of the asymmetric curvilinear contour extends from the second end of the light output surface towards the light transmission axis.

31. The lens device of claim 28, wherein the light output surface has a ridge extending in directions along the longitudinal axis and being located at a greatest distance, in directions along the light transmission axis, of the light output surface away from the light input surface.

32. The lens device of claim 31, wherein the ridge is at a location, in directions along the lateral axis, being between the light transmission axis and the first end of the light output surface.

33. The lens device of claim 31, wherein a portion of the light output surface extends for a distance in directions along the lateral axis from the first end to the light transmission axis, and wherein the ridge is on the portion of the light output surface at a location being at within a range of between about 30% and about 70% along the distance extending from the first end to the light transmission axis.

34. The lens device of claim 31, wherein a portion of the light output surface extends for a distance in directions along the lateral axis from the first end to the light transmission axis, and wherein the ridge is on the portion of the light output surface at a location being at within a range of between about 40% and about 60% along the distance extending from the first end to the light transmission axis.

35. The lens device of claim 31, wherein the convex region of the asymmetric curvilinear contour has an angle of elevation at the first end of the light output surface from the lateral axis to the ridge, and wherein the angle of elevation is within a range of between about 30 degrees and about 40 degrees.

36. The lens device of claim 31, wherein the convex region of the asymmetric curvilinear contour has an angle of elevation at the first end of the light output surface from the lateral axis to the ridge, and wherein the angle of elevation is within a range of between about 33 degrees and about 37 degrees.

37. The lens device of claim 31, wherein the convex region of the asymmetric curvilinear contour has an angle of elevation at the first end of the light output surface from the lateral axis to the ridge, and wherein the angle of elevation is about 35 degrees.

38. The lens device of claim 28, wherein the asymmetric curvilinear contour of the light output surface has an inflection point between the convex region and the concave region.

39. The lens device of claim 38, wherein the light output surface extends for a distance in directions along the lateral axis from the first end to the second end, and wherein the inflection point is on the light output surface at a location being at within a range of between about 40% and about 60% along the distance extending from the first end to the second end.

40. The lens device of claim 27, being configured for emitting light as being distributed on a planar surface.

41. The lens device of claim 40, being configured for causing a luminance of light reflected by the planar surface to have a ratio of maximum luminance divided by minimum luminance being about 4 or less.

42. The lens device of claim 40, being configured for causing a luminance of light reflected by the planar surface to have a ratio of maximum luminance divided by minimum luminance being within a range of between about 4.0 and about 1.8.

43. The lens device of claim 40, being configured for causing a luminance of light reflected by the planar surface to have a ratio of average luminance divided by minimum luminance being about 2 or less.

44. The lens device of claim 40, being configured for causing a luminance of light reflected by the planar surface to have a ratio of average luminance divided by minimum luminance being within a range of between about 2.1 and about 1.2.

45. The lighting system of claim 4, wherein the another light input surface of the sixth lens module has the another array of diverging lenses as including a lens screen having lenticular or microprismatic features.

46. The lighting system of claim 3, wherein the another light output surface of the sixth lens module includes a first end being spaced apart along the another lateral axis from a second end; and wherein the another asymmetric curvilinear contour extends from the first end to the second end of the another light output surface.

47. The lighting system of claim 46, wherein the another convex region of the another asymmetric curvilinear contour of the sixth lens module extends from the first end of the another light output surface towards the another light transmission axis.

48. The lighting system of claim 47, wherein the another concave region of the another asymmetric curvilinear contour of the sixth lens module extends from the second end of the another light output surface towards the another light transmission axis.

49. The lighting system of claim 46, wherein the another light output surface of the sixth lens module has another ridge extending in directions along the another longitudinal axis and being located at a greatest distance, in directions along the another light transmission axis, of the another light output surface away from the another light input surface.

50. The lighting system of claim 49, wherein the another ridge of the sixth lens module is at a location, in directions along the another lateral axis, being between the another light transmission axis and the first end of the another light output surface.

51. The lighting system of claim 49, wherein a portion of the another light output surface of the sixth lens module extends for a distance in directions along the another lateral axis from the first end to the another light transmission axis, and wherein the another ridge is on the portion of the another light output surface at a location being at within a range of between about 30% and about 70% along the distance extending from the first end to the another light transmission axis.

52. The lighting system of claim 49, wherein the another convex region of the another asymmetric curvilinear contour of the sixth lens module has another angle of elevation at the first end of the another light output surface from the another lateral axis to the another ridge, and wherein the another angle of elevation is within a range of between about 30 degrees and about 40 degrees.

53. The lighting system of claim 46, wherein the another light output surface of the sixth lens module extends for a distance in directions along the another lateral axis from the first end to the second end, and wherein the another asymmetric curvilinear contour of the another light output surface of the sixth lens module has an inflection point on the another light output surface between the another convex region and the another concave region at a location being at within a range of between about 40% and about 60% along the distance extending from the first end to the second end of the another lateral axis.

54. The lighting system of claim 1, having another lens module including another diverging lens having another lens axis, the another diverging lens being configured for causing divergence of some of the converged light emissions away from the another lens axis, the another lens module including:

another lens body having another light output surface spaced apart along another light transmission axis from another light input surface, the another lens body having another longitudinal axis and another lateral axis, the another longitudinal and lateral axes being transverse to the another light transmission axis; the another light output surface having another asymmetric curvilinear contour being formed by another convex region overlapping in directions along the another lateral axis with another concave region, the another asymmetric curvilinear contour uniformly extending in directions along the another longitudinal axis;

wherein the lighting system is configured for detachably installing the first lens module or the second lens module in the lighting module between the semiconductor light-emitting device and the another lens module; and wherein the lighting system is configured for aligning the first or second lens axis with the central light emission axis and the another lens axis.

55. The lighting system of claim 54, wherein the lighting system is configured for interchangeably installing either the first lens module or the second lens module in the lighting module between the semiconductor light-emitting device and either the third lens module or the additional lens module.

56. The lighting system of claim 1, wherein: the first converging lens is configured for causing convergence of some of the light emissions of the semiconductor light-emitting device to form the converged light emissions as having the first HWHM as being about 3.5 degrees or about 7.5 degrees; and the first light input surface of the first converging lens includes a central cavity being shaped as a portion of a spheroid; and the first light output surface of the first converging lens includes a bowl-shaped cavity surrounding a central mound shaped as a portion of a spheroid.

57. The lighting system of claim 1, wherein: the first converging lens is configured for causing convergence of some of the light emissions of the semiconductor light-emitting device to form the converged light emissions as having the first HWHM as being about 12.5 degrees; and the first light input surface of the first converging lens includes a central disk-shaped cavity; and the first light output surface of the first converging lens includes a bowl-shaped cavity surrounding a central mound shaped as a portion of a spheroid.

58. The lighting system of claim 1, wherein: the first converging lens is configured for causing convergence of some of the light emissions of the semiconductor light-emitting device to form the converged light emissions as having the first HWHM as being about 20 degrees; and the first light input surface of the first converging lens includes a central compound parabolic concentrator; and the first light output surface of the first converging lens includes a bowl-shaped cavity surrounding a central flat region.

59. The lighting system of claim 1, wherein the first diverging lens is configured for causing divergence of some of the converged light emissions away from the third lens axis by a third HWHM being: about 4 degrees, or about 10 degrees, or about 15 degrees, or about 25 degrees, or about 30 degrees.

60. The lighting system of claim 3, wherein: the third converging lens is configured for causing convergence of some of the light emissions of the second semiconductor light-emitting device to form the further converged light emissions as having the fourth HWHM as being about 3.5 degrees or about 7.5 degrees; and the fourth light input surface of the third converging lens includes a central cavity being shaped as a portion of a spheroid; and the fourth light output surface of the third converging lens includes a bowl-shaped cavity surrounding a central mound shaped as a portion of a spheroid.

61. The lighting system of claim 3, wherein: the third converging lens is configured for causing convergence of some of the light emissions of the second semiconductor light-emitting device to form the further converged light emissions as having the fourth HWHM as being about 12.5 degrees; and the fourth light input surface of the third converging lens includes a central disk-shaped cavity; and the fourth light output surface of the third converging lens includes a bowl-shaped cavity surrounding a central mound shaped as a portion of a spheroid.

62. The lighting system of claim 3, wherein: the third converging lens is configured for causing convergence of some of the light emissions of the second semiconductor light-emitting device to form the further converged light emissions as having the fourth HWHM as being about 20 degrees; and the fourth light input surface of the third converging lens includes a central compound parabolic concentrator; and the fourth light output surface of the third converging lens includes a bowl-shaped cavity surrounding a second central flat region.

63. The lighting system of claim 3, further including a housing, wherein: the housing is configured for positioning the lighting module for emission of the light emissions from the semiconductor light-emitting device along the central light emission axis; and the housing is configured for positioning the second lighting module for emission of the further light emissions from the second semiconductor light-emitting device along the second central light emission axis.

64. The lighting system of claim 63 further including a carrier, wherein: the carrier is configured for positioning the first or second lens module in the housing with the first or second lens axis being aligned with the central light emission axis; and the carrier is configured for positioning the fourth or fifth lens module in the housing with the fourth or fifth lens axis being aligned with the second central light emission axis.

65. The lighting system of claim 64, further including a primary visible light reflector, wherein: the primary visible light reflector is configured for being positioned between the housing and the carrier; and the primary visible light reflector is configured for redirecting some of the light emissions of the semiconductor light-emitting device along the central light emission axis; and the primary visible light reflector is configured for redirecting some of the further light emissions of the second semiconductor light-emitting device along the second central light emission axis.

66. The lighting system of claim 4, wherein the lighting system is configured for interchangeably installing either: the first lens module in the lighting module and the fourth lens module in the second lighting module; or the second lens module in the lighting module and the fifth lens module in the second lighting module.

67. The lighting system of claim 66, wherein: the first lens module is integral with the fourth lens module; and the second lens module is integral with the fifth lens module.

68. The lighting system of claim 3, having a seventh lens module including a third diverging lens having a seventh lens axis, the third diverging lens being configured for causing divergence of some of the converged light emissions away from the seventh lens axis, the seventh lens module including:

a further lens body having a further light output surface spaced apart along a further light transmission axis from a further light input surface, the further lens body having a further longitudinal axis and a further lateral axis, the further longitudinal and lateral axes being transverse to the further light transmission axis; the further light output surface having a further asymmetric curvilinear contour being formed by a further convex region overlapping in directions along the further lateral axis with a further concave region, the further asymmetric curvilinear contour uniformly extending in directions along the further longitudinal axis;

wherein the lighting system is configured for detachably installing the first lens module or the second lens module in the lighting module between the semiconductor light-emitting device and the further lens module; and wherein the lighting system is configured for aligning the first or second lens axis with the central light emission axis and the further lens axis.

69. The lighting system of claim 68, having an eighth lens module including a fourth diverging lens having an eighth lens axis, the fourth diverging lens being configured for causing divergence of some of the further converged light emissions away from the eighth lens axis, the eighth lens module including:

an additional lens body having an additional light output surface spaced apart along an additional light transmission axis from an additional light input surface, the additional lens body having an additional longitudinal axis and an additional lateral axis, the additional longitudinal and lateral axes being transverse to the additional light transmission axis; the additional light output surface having an additional asymmetric curvilinear contour being formed by an additional convex region overlapping in directions along the additional lateral axis with an additional concave region, the additional asymmetric curvilinear contour uniformly extending in directions along the additional longitudinal axis;

wherein the lighting system is configured for detachably installing the fourth lens module or the fifth lens module in the second lighting module between the second semiconductor light-emitting device and the additional lens module; and wherein the lighting system is configured for aligning the fourth or fifth lens axis with the second central light emission axis and the additional lens axis.

70. The lighting system of claim 69, wherein the lighting system is configured for interchangeably installing either: the third lens module in the lighting module and the sixth lens module in the second lighting module; or the seventh lens module in the lighting module and the eighth lens module in the second lighting module.

71. The lighting system of claim 70, wherein: the third lens module is integral with the sixth lens module; and the seventh lens module is integral with the eighth lens module.

72. The lens device of claim 27, wherein the light input surface has the array of diverging lenses as including a lens screen having lenticular or microprismatic features.

73. The lens device of claim 72, wherein the light input surface has the lens screen as including an array of lenticular toroidal lenses.

74. The lens device of claim 73, wherein the light input surface has the array of lenticular toroidal lenses as including a plurality of convex regions being interposed between a plurality of concave regions, each of the pluralities of the convex regions and of the concave regions extending in directions along the lateral axis.

75. The lens device of claim 27, wherein the lens device is configured for emitting light having a full width half maximum beam width being within a range of between about 7 degrees and about 30 degrees.

76. The lens device of claim 27, wherein the lens device is configured for emitting light having a full width half maximum beam width being within a range of between about 10 degrees and about 20 degrees.

* * * * *